US011828041B2

(12) United States Patent
Kean et al.

(10) Patent No.: US 11,828,041 B2
(45) Date of Patent: Nov. 28, 2023

(54) APPARATUSES AND METHODS FOR MEASURING SADDLE LINKAGE POSITION OF A MOTOR GRADER

(71) Applicant: Deere & Company, Moline, IL (US)

(72) Inventors: Michael G. Kean, Dubuque, IA (US); Michael D. Peat, Dubuque, IA (US); David A. Veasy, Dubuque, IA (US)

(73) Assignee: DEERE & COMPANY, Moline, IL (US)

( * ) Notice: Subject to any disclaimer, the term of this patent is extended or adjusted under 35 U.S.C. 154(b) by 240 days.

(21) Appl. No.: 17/399,102

(22) Filed: Aug. 11, 2021

(65) Prior Publication Data

US 2021/0372084 A1 Dec. 2, 2021

Related U.S. Application Data

(62) Division of application No. 16/283,103, filed on Feb. 22, 2019, now Pat. No. 11,124,943.

(51) Int. Cl.
*E02F 3/84* (2006.01)
*E02F 3/76* (2006.01)

(52) U.S. Cl.
CPC ..... *E02F 3/845* (2013.01); *E02F 3/7654* (2013.01); *E02F 3/847* (2013.01)

(58) Field of Classification Search
CPC ..... E02F 3/764; E02F 3/765; E02F 3/7654; E02F 3/845; E02F 3/847; E02F 9/264
See application file for complete search history.

(56) References Cited

U.S. PATENT DOCUMENTS

| | | | | |
|---|---|---|---|---|
| 3,786,871 | A | 1/1974 | Long et al. | |
| 5,495,898 | A * | 3/1996 | McGugan | E02F 3/7654 172/780 |
| 7,647,983 | B2 | 1/2010 | Gharsalli | |
| 9,228,316 | B2 | 1/2016 | Staade et al. | |
| 9,856,627 | B2 * | 1/2018 | Copeland | E05B 51/02 |
| 9,880,560 | B2 * | 1/2018 | Han | G05D 1/0234 |
| 10,030,366 | B2 * | 7/2018 | Tevis | E02F 3/7654 |
| 11,124,943 | B2 * | 9/2021 | Kean | E02F 3/765 |
| 11,162,246 | B2 * | 11/2021 | Kean | E02F 3/7636 |
| 2007/0235201 | A1 * | 10/2007 | Gharsalli | E02F 3/765 172/80 |
| 2016/0208460 | A1 | 7/2016 | Kirsch | |
| 2016/0362870 | A1 | 12/2016 | Elkins | |
| 2019/0021218 | A1 * | 1/2019 | Sheppard | G05D 1/0088 |

(Continued)

*Primary Examiner* — Gary S Hartmann
(74) *Attorney, Agent, or Firm* — Taft Stettinius & Hollister LLP; Stephen F. Rost

(57) ABSTRACT

A grader includes a chassis, a saddle linkage, and a motion measurement system. The saddle linkage is supported for movement relative to the chassis and includes a mount movably coupled to the chassis, first and second arms each movably coupled to the mount, and a crossbar movably coupled to each of the first and second arms. The mount has a lock pin aperture, each of the first and second arms has a locking hole, and the crossbar has a plurality of locking holes. The lock pin aperture may be aligned with one locking hole of the first arm, the second arm, or the crossbar to position the saddle linkage in use of the grader. The motion measurement system is coupled to the saddle linkage and configured to measure movement or position of one or more components of the grader in use thereof.

21 Claims, 22 Drawing Sheets

(56) References Cited

U.S. PATENT DOCUMENTS

| | | | | |
|---|---|---|---|---|
| 2020/0087887 | A1* | 3/2020 | Kean | E02F 9/006 |
| 2020/0087888 | A1* | 3/2020 | Kean | E02F 9/2041 |
| 2022/0018099 | A1* | 1/2022 | Kean | E02F 3/7636 |

* cited by examiner

APPARATUSES AND METHODS FOR MEASURING SADDLE LINKAGE POSITION OF A MOTOR GRADER

CROSS-REFERENCE TO RELATED APPLICATIONS

The present application is a divisional application of U.S. patent application Ser. No. 16/283,103 filed on Feb. 22, 2019, which is incorporated herein by reference in its entirety.

FIELD OF THE DISCLOSURE

The present disclosure relates, generally, to construction machines, and, more specifically, to graders.

BACKGROUND

Graders such as motor graders may include a saddle linkage that is lockable in one of a number of operating positions. Each of the operating positions may be associated with, or characterized by measurement of, certain positional states of one or more components of the device. Measurement of movement and/or positional states of one or more components of motor graders (e.g., the saddle linkage) remains an area of interest.

SUMMARY

The present disclosure may comprise one or more of the following features and combinations thereof.

According to one aspect of the present disclosure, a grader may include a chassis, a saddle linkage, and a motion measurement system. The saddle linkage may be supported for movement relative to the chassis. The saddle linkage may include a mount movably coupled to the chassis, first and second arms each movably coupled to the mount, and a crossbar movably coupled to each of the first and second arms. The mount may have a lock pin aperture, each of the first and second arms may have a locking hole, and the crossbar may have a plurality of locking holes. The lock pin aperture may be aligned with one locking hole of the first arm, the second arm, or the crossbar to position the saddle linkage in use of the grader. The motion measurement system may be coupled to the saddle linkage and configured to measure movement or position of one or more components of the grader in use thereof. The motion measurement system may include at least one sensor mounted to the mount in close proximity to the lock pin aperture and at least one indicator mounted in close proximity to at least one of the locking holes. The at least one sensor may be configured to sense the at least one indicator and provide sensor input indicative of one or more characteristics of the at least one indicator. The motion measurement system may further include a controller that is coupled to the at least one sensor and configured to receive the sensor input and determine a positional state of the saddle linkage based on the sensor input.

In some embodiments, the locking holes may include seven locking holes, and the at least one indicator of the motion measurement system may include a set of indicators that correspond to, and are located in close proximity to, each of the seven locking holes. Each set of indicators may include three indicators.

In some embodiments, the at least one sensor of the motion measurement system may include three hall effect sensors that are spaced from one another and the lock pin aperture. The locking holes may include seven locking holes, and the at least one indicator of the motion measurement system may include a set of three magnets that correspond to, and are spaced from, each of the seven locking holes.

In some embodiments, the at least one sensor of the motion measurement system may include at least one inductive sensor that is spaced from the lock pin aperture. The locking holes may include seven locking holes, and the at least one indicator of the motion measurement system may include a set of one or more machined surfaces that correspond to, and are spaced from, each of the seven locking holes. Each set of one or more machined surfaces may include a first surface that is recessed a first distance from an exterior face of the first arm, the second arm, or the crossbar, a second surface that is recessed a second distance from the exterior face that is different from the first distance, and a third surface that is recessed a third distance from the exterior face that is different from the second distance.

In some embodiments, the at least one sensor of the motion measurement system may include at least one light sensor that is spaced from the lock pin aperture. The locking holes may include seven locking holes, and the at least one indicator of the motion measurement system may include a set of one or more optical targets that correspond to, and are spaced from, each of the seven locking holes. Each set of one or more optical targets may include first, second, and third reflectors that are spaced from one another, and each of the first, second, and third reflectors may be configured to reflect light provided by a light source toward the at least one light sensor so that the reflected light may be detected by the at least one light sensor. The light source may be located in close proximity to the at least one light sensor and the lock pin aperture. Additionally, in some embodiments, each set of one or more optical targets may include first, second, and third markers that are spaced from one another, and the first, second, and third markers may be configured to provide various colors that may be detected by the at least one light sensor.

According to another aspect of the present disclosure, a method of operating a grader including a chassis, a saddle linkage supported for movement relative to the chassis that has a mount movably coupled to the chassis and having a lock pin aperture, first and second arms each movably coupled to the mount and each having one lock hole, and a crossbar movably coupled to each of the first and second arms that has a plurality of locking holes, and a motion measurement system coupled to the saddle linkage that has at least one sensor mounted to the mount in close proximity to the lock pin aperture, at least one indicator mounted in close proximity to at least one of the locking holes, and a controller, may include receiving, by the controller, sensor input provided by the at least one sensor that is indicative of one or more characteristics of the at least one indicator, and determining, by the controller, a positional state of the saddle linkage based on the sensor input. Determining the positional state of the saddle linkage based on the sensor input may include encoding, by the controller, the positional state of the saddle linkage based on the sensor input.

In some embodiments, receiving the sensor input may include receiving, by the controller, sensor input provided by each of three hall effect sensors that are spaced from one another and the lock pin aperture and configured to provide sensor input based on sets of three magnets that correspond to, and are spaced from, each of seven locking holes. Additionally, in some embodiments, receiving the sensor input may include receiving, by the controller, sensor input provided by at least one inductive sensor that is spaced from the lock pin aperture and configured to provide sensor input based on sets of one or more machined surfaces that correspond to, and are spaced from, each of seven locking holes. Receiving the sensor input provided by the at least one inductive sensor based on the sets of one or more machined surfaces may include receiving, by the controller, sensor input provided by the at least one inductive sensor that is based on seven sets of machined surfaces each including a first surface recessed a first distance from an exterior face of the first arm, the second arm, or the crossbar, a second surface recessed a second distance from the exterior face that is different from the first distance, and a third surface recessed a third distance from the exterior face that is different from the second distance.

In some embodiments, receiving the sensor input may include receiving, by the controller, sensor input provided by at least one light sensor that is spaced from the lock pin aperture and configured to provide sensor input based on sets of one or more optical targets that correspond to, and are spaced from, each of seven locking holes. Receiving the sensor input provided by the at least one light sensor based on the sets of one or more optical targets may include receiving, by the controller, sensor input based on sets of one or more optical targets each including at least one of: first, second, and third reflectors spaced from one another and each configured to reflect light provided by a light source toward the at least one light sensor so that the reflected light may be detected by the at least one light sensor; and first, second, and third markers spaced from one another and configured to provide various colors that may be detected by the at least one light sensor.

According to yet another aspect of the present disclosure, a grader may include a chassis, a saddle linkage, a work implement assembly, and a motion measurement system. The saddle linkage may be supported for movement relative to the chassis, and the saddle linkage may include a mount movably coupled to the chassis, first and second arms each movably coupled to the mount, and a crossbar movably coupled to each of the first and second arms. The mount may have a lock pin aperture, each of the first and second arms may have a locking hole, and the crossbar may have a plurality of locking holes. The lock pin aperture may be aligned with one locking hole of the first arm, the second arm, or the crossbar to position the saddle linkage in use of the grader. The work implement assembly may be movably coupled to the chassis and the saddle linkage, and the work implement assembly may include at least one component that is configured to grade a surface in use of the grader. The motion measurement system may be coupled to the saddle linkage and configured to measure movement or position of one or more components of the grader in use thereof. The motion measurement system may include at least one sensor mounted to the mount in close proximity to the lock pin aperture and at least one indicator mounted in close proximity to at least one of the locking holes. The at least one sensor may be configured to sense the at least one indicator and provide sensor input indicative of one or more characteristics of the at least one indicator. The motion measurement system may further include a controller that is coupled to the at least one sensor and configured to receive the sensor input, encode the sensor input based on at least one 3-bit data string, and determine a positional state of the saddle linkage based on the encoded sensor input.

According to yet another aspect of the present disclosure still, a grader may include a chassis, a saddle linkage, a work implement assembly, and a motion measurement system. The saddle linkage may be supported for movement relative to the chassis. The work implement assembly may be coupled to the chassis and the saddle linkage. The work implement assembly may include first and second lift cylinders each coupled to the saddle linkage and configured to drive movement of one or more components of the grader in response to a change in a length of the corresponding lift cylinder, a circle side shift cylinder coupled to the saddle linkage and configured to drive movement of one or more components of the grader in response to a change in a length of the circle side shift cylinder, and a draft frame coupled to the first and second lift cylinders and the circle side shift cylinder. The motion measurement system may be configured to measure movement or position of one or more components of the grader in use thereof. The motion measurement system may include first and second lift cylinder sensors coupled to the corresponding first and second lift cylinders and each configured to provide lift cylinder sensor input indicative of one or more lengths of the corresponding lift cylinder, a circle side shift cylinder sensor coupled to the circle side shift cylinder and configured to provide circle side shift cylinder sensor input indicative of one or more lengths of the circle side shift cylinder, a draft frame sensor coupled to the draft frame and configured to provide draft frame sensor input indicative of one or more characteristics of the draft frame, and a chassis sensor coupled to the chassis and configured to provide chassis sensor input indicative of one or more characteristics of the chassis. The motion measurement system may further include a controller coupled to each of the first and second lift cylinder sensors, the circle side shift cylinder sensor, the draft frame sensor, and the chassis sensor and configured to establish an orientation of the draft frame relative to the chassis based at least partially on the draft frame sensor input and the chassis sensor input and determine operational kinematics of the draft frame relative to the chassis based at least partially on the lift cylinder sensor input and the circle side shift cylinder sensor input.

In some embodiments, to establish the orientation of the draft frame relative to the chassis, the controller may be configured to receive the draft frame sensor input, receive the chassis sensor input, determine one or more characteristics of movement and/or position of the draft frame relative to the chassis based on the draft frame sensor input and the chassis sensor input, and initialize at least one characteristic of movement and/or position of the draft frame relative to the chassis to zero. The draft frame sensor input may be indicative of pitch and/or roll of the draft frame in use of the grader, the chassis sensor input may be indicative of pitch and/or roll of the chassis in the use of the grader, and the one or more characteristics of movement and/or position of the draft frame relative to the chassis may include pitch and/or roll of the draft frame relative to the chassis in use of the grader. The at least one characteristic of movement and/or position of the draft frame relative to the chassis may include yaw of the draft frame relative to the chassis. To determine the operational kinematics of the draft frame relative to the chassis, the controller may be configured to receive the circle side shift cylinder sensor input, receive the lift cylinder sensor input, and determine an estimate of one or more characteristics of movement and/or position of the draft frame relative to the chassis based on the circle side shift cylinder sensor input and the lift cylinder sensor input.

In some embodiments, the saddle linkage may be configured to be locked in one of a plurality of positional states, the motion measurement system may include a lock pin detection sensor coupled to the saddle linkage and configured to provide lock detection sensor input indicative of whether the saddle linkage is locked in one of the plurality of positional states, and the controller may be configured to receive the lock detection sensor input to determine whether the saddle linkage is locked in one of the plurality of positional states. In response to a determination that the saddle linkage is not locked in one of the positional states, the controller may be configured to determine the operational kinematics of the draft frame relative to the chassis based at least partially on the lift cylinder sensor input and the circle side shift cylinder sensor input and to determine an estimate of a positional state of the saddle linkage based on the circle side shift cylinder sensor input and the lift cylinder sensor input. Additionally, in some embodiments, in response to a determination that the saddle linkage is locked in one of the positional states, the controller may be configured to determine whether the saddle linkage was locked in one of the positional states during a previous operational cycle of the grader.

According to a further aspect of the present disclosure, a grader may include a chassis, a saddle linkage, and a motion measurement system. The saddle linkage may be supported for movement relative to the chassis. The saddle linkage may include a mount movably coupled to the chassis, first and second arms each movably coupled to the mount, and a crossbar movably coupled to each of the first and second arms. The mount may have a lock pin aperture, each of the first and second arms may have a locking hole, and the crossbar may have a plurality of locking holes. The lock pin aperture may be aligned with one locking hole of the first arm, the second arm, or the crossbar to position the saddle linkage in use of the grader. The motion measurement system may be configured to measure movement or position of one or more components of the grader in use thereof. The motion measurement system may include a first camera coupled to the chassis and configured to capture one or images of one or more components of the grader in use of the grader and a controller coupled to the first camera. The controller may be configured to determine locations of the locking holes and/or the crossbar based on the one or more images captured by the first camera and to determine a positional state of the saddle linkage based on the determined locations of the locking holes and/or the crossbar.

In some embodiments, the controller may be configured to determine locations of the locking holes and the crossbar based on the one or more images captured by the first camera and to determine the positional state of the saddle linkage based on the determined locations of the locking holes and the crossbar. To determine the locations of the locking holes and the crossbar, the controller may be configured to identify the locking holes based on the one or more images captured by the first camera and to identify the shape of the crossbar based on the one or more images captured by the first camera. In response to a determination that the locking holes and the shape of the crossbar are identified, the controller may be configured to compare the locations of the locking holes with one or more locations of the crossbar to determine whether the locations are consistent with one another. Additionally, in some embodiments, in response to a determination that the locking holes and the shape of the crossbar are not identified, the controller may be configured to estimate a positional state of the saddle linkage based on the lack of identification of the locking holes and the shape of the crossbar. In response to a determination that the locations of the locking holes and the crossbar are inconsistent with one another, the controller may be configured to estimate a positional state of the saddle linkage based on the inconsistent locations of the locking holes and the crossbar. In response to a determination that the locations of the locking holes and the crossbar are consistent with one another, the controller may be configured to determine the positional state of the saddle linkage based on the consistent locations of the locking holes and the crossbar.

In some embodiments, the motion measurement system may include a second camera coupled to the chassis and configured to capture one or images of one or more components of the grader in use of the grader, and the controller may be configured to determine locations of the locking holes and/or the crossbar based on the one or more images captured by the first and second cameras and to determine a positional state of the saddle linkage based on the determined locations of the locking holes and/or the crossbar.

According to a further aspect of the present disclosure, a grader may include a chassis, a saddle linkage, a work implement assembly, and a motion measurement system. The saddle linkage may be supported for movement relative to the chassis. The work implement assembly may be coupled to the chassis and the saddle linkage. The work implement assembly may include first and second lift cylinders each coupled to the saddle linkage and configured to drive movement of one or more components of the grader in response to a change in a length of the corresponding lift cylinder, a circle side shift cylinder coupled to the saddle linkage and configured to drive movement of one or more components of the grader in response to a change in a length of the circle side shift cylinder, and a draft frame coupled to the first and second lift cylinders and the circle side shift cylinder. The motion measurement system may be configured to measure movement or position of one or more components of the grader in use thereof. The motion measurement system may include first and second lift cylinder sensors coupled to the corresponding first and second lift cylinders and each configured to provide lift cylinder sensor input indicative of one or more lengths of the corresponding lift cylinder, a circle side shift cylinder sensor coupled to the circle side shift cylinder and configured to provide circle side shift cylinder sensor input indicative of one or more lengths of the circle side shift cylinder, and a camera coupled to the chassis and configured to capture one or images of one or more components of the grader in use of the grader. The motion measurement system may further include a controller coupled to each of the first and second lift cylinder sensors, the circle side shift cylinder sensor, and the camera and configured to determine operational kinematics of the draft frame relative to the chassis based at least partially on the lift cylinder sensor input, the circle side shift cylinder sensor input, and the one or more images captured by the camera.

In some embodiments, the controller may be configured to locate one or more features of components of the grader based on the images captured by the camera and calculate one or more characteristics of movement and/or position of the components based on the located features. To determine the operational kinematics of the draft frame relative to the chassis, the controller may be configured to receive the lift sensor cylinder input, receive the circle side shift cylinder sensor input, and determine an estimate of one or more characteristics of movement and/or position of the draft frame relative to the chassis based on the circle side shift cylinder sensor input, the lift cylinder sensor input, and the one or more calculated characteristics. The saddle linkage may be configured to be locked in one of a plurality of positional states, the motion measurement system may include a lock pin detection sensor coupled to the saddle linkage and configured to provide lock detection sensor input indicative of whether the saddle linkage is locked in one of the plurality of positional states, and the controller may be configured to receive the lock detection sensor input to determine whether the saddle linkage is locked in one of the plurality of positional states. In response to a determination that the saddle linkage is not locked in one of the positional states, the controller may be configured to determine the operational kinematics of the draft frame relative to the chassis based on the lift cylinder sensor input, the circle side shift cylinder sensor input, and the one or more calculated characteristics and to determine an estimate of a positional state of the saddle linkage based on the circle side shift cylinder sensor input, the lift cylinder sensor input, and the one or more calculated characteristics.

These and other features of the present disclosure will become more apparent from the following description of the illustrative embodiments.

BRIEF DESCRIPTION OF THE DRAWINGS

The invention described herein is illustrated by way of example and not by way of limitation in the accompanying figures. For simplicity and clarity of illustration, elements illustrated in the figures are not necessarily drawn to scale. For example, the dimensions of some elements may be exaggerated relative to other elements for clarity. Further, where considered appropriate, reference labels have been repeated among the figures to indicate corresponding or analogous elements.

DETAILED DESCRIPTION

Figure 1:
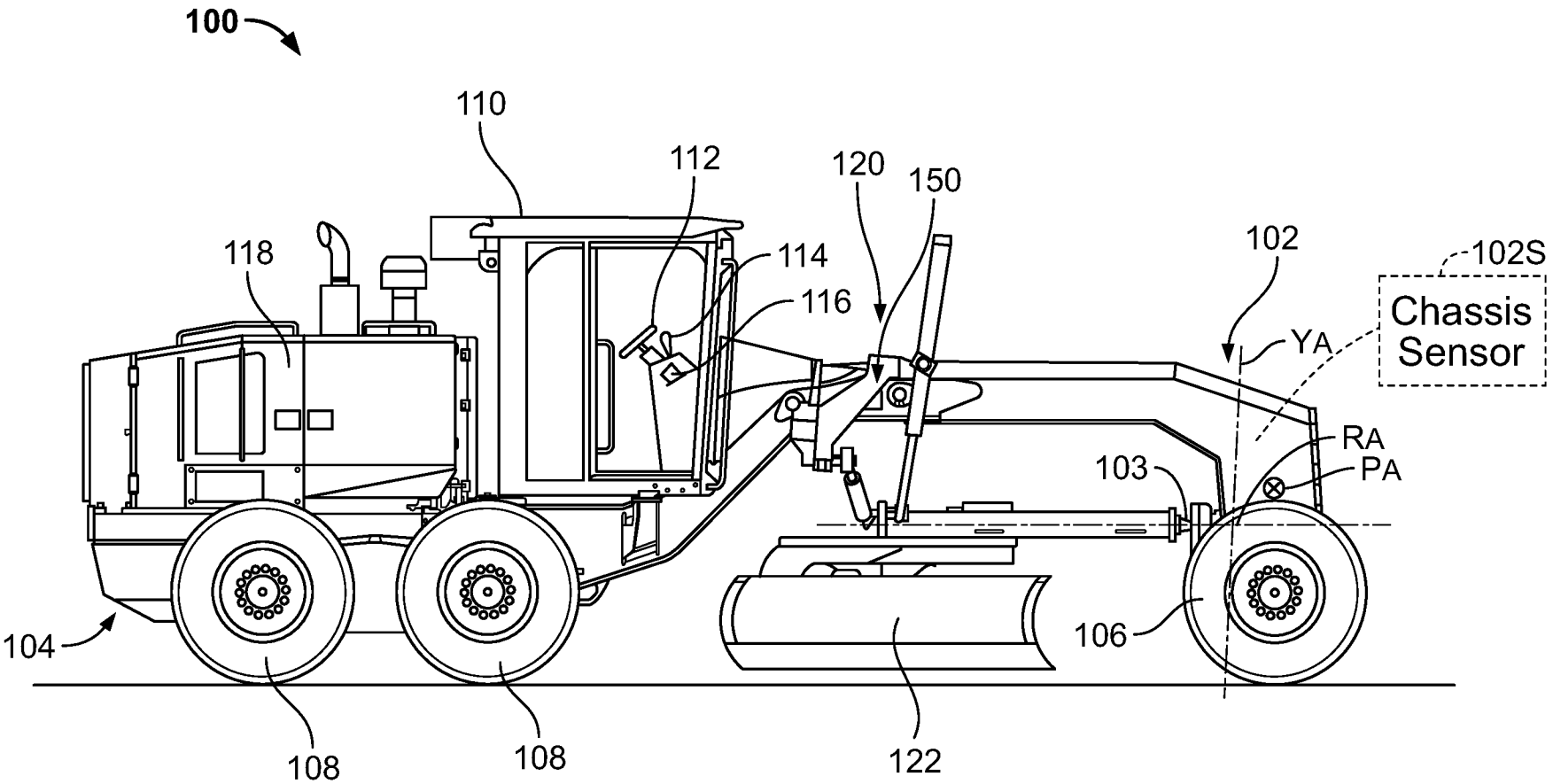
FIG. 1 is a side view of a motor grader.

While the concepts of the present disclosure are susceptible to various modifications and alternative forms, specific embodiments thereof have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described. Additionally, it should be appreciated that items included in a list in the form of "at least one A, B, and C" can mean (A); (B); (C); (A and B); (A and C); (B and C); or (A, B, and C). Similarly, items listed in the form of "at least one of A, B, or C" can mean (A); (B); (C); (A and B); (A and C); (B and C); or (A, B, and C).

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures.

Additionally, the inclusion of a structural or method feature in a particular figure is not meant to imply that such feature is required in all embodiments and, in some embodiments, may not be included or may be combined with other features.

A number of features described below are illustrated in the drawings in phantom. Depiction of certain features in phantom is intended to convey that those features may be hidden or present in one or more embodiments, while not necessarily present in other embodiments. Additionally, in the one or more embodiments in which those features may be present, illustration of the features in phantom is intended to convey that the features may have location(s) and/or position(s) different from the locations(s) and/or position(s) shown.

Referring now to FIG. 1, a construction machine 100 is illustratively embodied as, or otherwise includes, a motor grader. The motor grader 100 includes a front chassis or front frame 102 and a rear chassis or rear frame 104 arranged opposite the front chassis 102 and coupled thereto. The front chassis 102 is supported on a pair of front wheels 106 and the rear chassis is supported on tandem sets of rear wheels 108. The front chassis 102 supports an operator cab 110 in which various operational controls for the motor grader 100 are provided. Among other things, those controls may include a steering wheel 112, a lever assembly 114, and a dashboard 116.

In the illustrative embodiment, a drive unit or engine 118 mounted to the rear chassis 104 supplies driving power to all driven components of the motor grader 100. The drive unit 118 is embodied as, or otherwise includes, any device capable of supplying rotational power to driven components of the motor grader 100 to drive those components. In some embodiments, rotational power supplied by the drive unit 118 may be provided to the driven components of the grader 100 by one or more transmission(s). In one example, the drive unit 118 may be configured to supply power to a transmission that is coupled to the rear wheels 108 and operable to provide various predetermined speed ratios selectable by an operator in either reverse or forward operating modes. In another example, the drive unit 118 may be configured to supply power to a transmission that is coupled to the front wheels 106, such as a hydrostatic front-wheel-assist transmission. Additionally, in some embodiments, the drive unit 118 may be coupled to a pump or generator to provide hydraulic, pneumatic, or electrical power to one or more components of the motor grader 100, as the case may be.

The illustrative motor grader 100 includes a work implement assembly 120 that is movably coupled to the front chassis 102. The work implement assembly 120 includes a blade or moldboard 122 that is configured to grade an underlying surface in use of the grader 100. Of course, it should be appreciated that another suitable device may be employed to grade an underlying surface in use of the grader 100. In any case, and as described in greater detail below, multiple components of the work implement assembly 120 are adjustable and/or repositionable to cooperatively alter an orientation of the blade 122 via a saddle linkage 150 of the motor grader 100.

Figure 3:
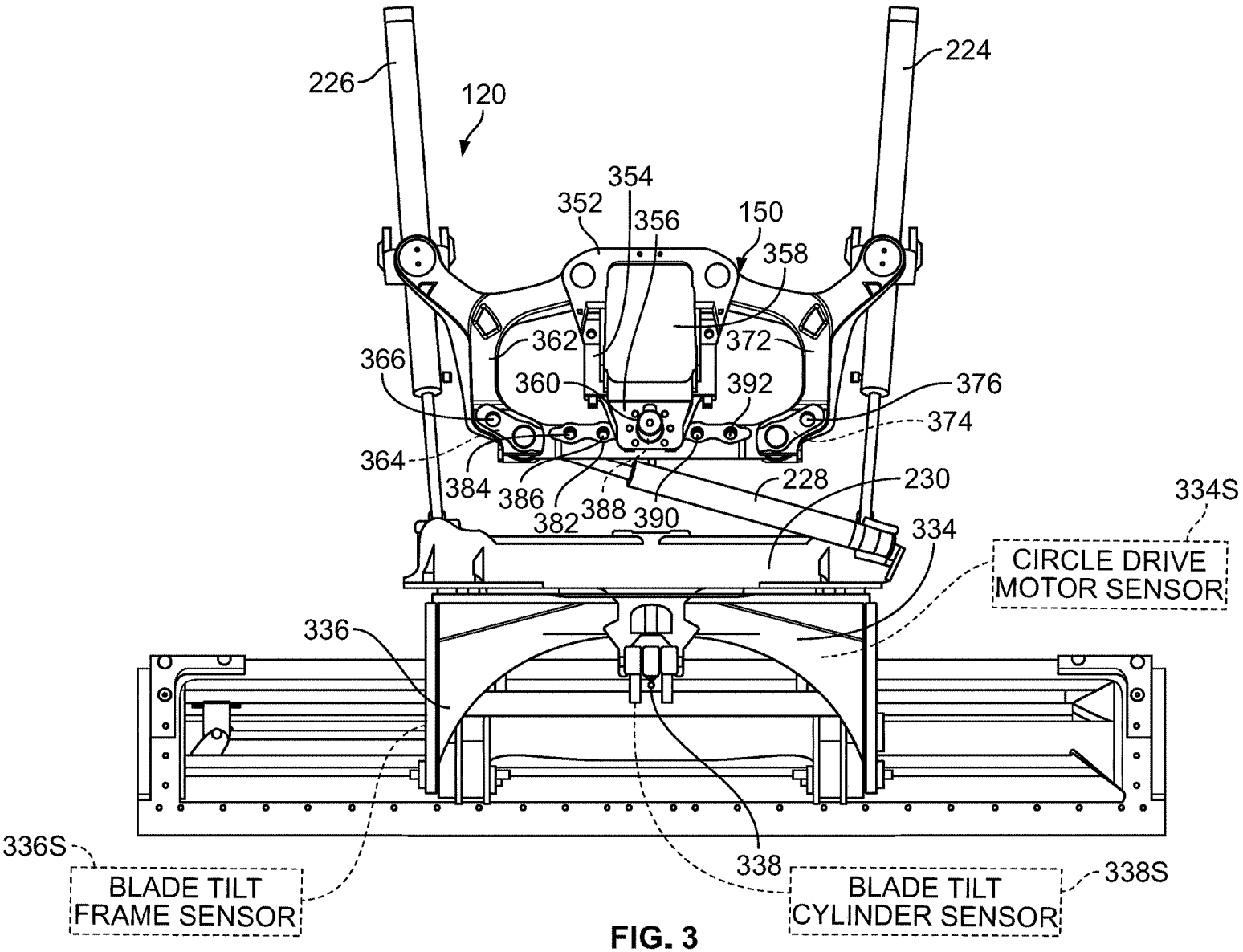
FIG. 3 is a rear view of the saddle linkage and the work implement assembly depicted in FIG. 2.

The saddle linkage 150 is illustratively embodied as, or otherwise includes, a four-bar linkage that is supported for movement relative to the front chassis 102 and coupled to the work implement assembly 120, as shown in FIG. 3. As further discussed below, the saddle linkage 150 is lockable in one of a number of discrete operating positions that may define, be characterized by, or otherwise be associated with, corresponding positional states of one or more components of the saddle linkage 150 and/or the grader 100. In some embodiments, as described in greater detail below, the grader 100 includes a motion measurement system (e.g., one of the motion measurement systems 400, 800, 1300 respectively shown in FIGS. 4, 8, and 13) coupled to the saddle linkage 150 and configured to measure movement or position of one or more components of the grader 100 (e.g., the saddle linkage 150) in use thereof. In those embodiments, the motion measurement system includes one or more indicators and one or more sensors that each provide sensor input indicative of one or more characteristics (e.g., proximity to the one or more sensors) of the one or more indicators, and the motion measurement system is configured to determine a positional state of the saddle linkage 150 based on the sensor input. In other embodiments, as described in greater detail below, the grader 100 includes a motion measurement system (e.g., one of the motion measurement systems 1701, 1900, 2201 respectively shown in FIGS. 17, 19, and 22) that is configured to measure movement or position of one or more components of the grader 100 in use thereof.

In use of the motor grader 100, the position and/or orientation of the front chassis 102 may vary from a reference position and/or orientation. In some embodiments, the reference position and/or orientation of the chassis 102 may be based on, established according to, or otherwise associated with, a particular slope or gradient of one or more surfaces on which the motor grader 100 is positioned. In any case, in the illustrative embodiment, the front chassis 102 is configured for at least one of the following: movement from the reference position and/or orientation about a roll axis RA, which may be referred to herein as roll of the front chassis 102; movement from the reference position and/or orientation about a pitch axis PA, which may be referred to herein as pitch of the front chassis 102; and movement from the reference position and/or orientation about a yaw axis YA, which may be referred to herein as yaw of the front chassis 102. Of course, it should be appreciated that roll, pitch, and/or yaw of the front chassis 102 may be minimal, nominal, or otherwise non-appreciable during operation of the motor grader 100. To measure operational characteristics such as roll, pitch, and/or yaw of the front chassis 102 in use of the motor grader 100, or to measure other operational characteristics of the front chassis 102, one or more chassis sensors 102S may be coupled to the front chassis 102. The one or more chassis sensors 102S may each be any device capable of measuring roll, pitch, and/or yaw of the front chassis 102 from the reference position and/or orientation and providing sensor input indicative of the measured movement. The one or more chassis sensors 102S may each be embodied as, or otherwise include, an accelerometer or the like, for example.

Figure 2:
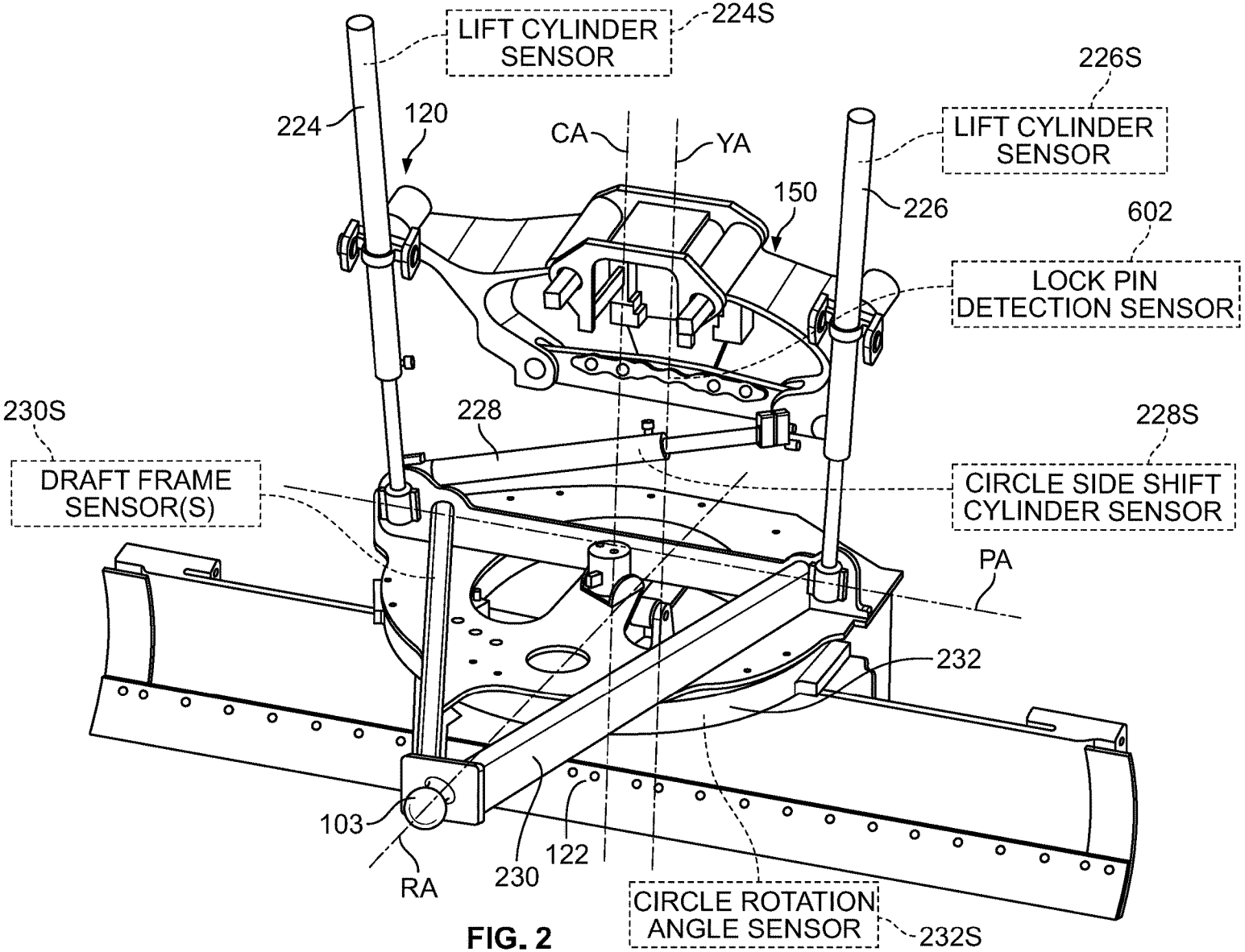
FIG. 2 is a front perspective view of a saddle linkage and a work implement assembly included in the motor grader of FIG. 1, with certain elements omitted for the sake of simplicity.

Referring now to FIGS. 2 and 3, the work implement assembly 120 and the saddle linkage 150 are shown with the front chassis 102 omitted for the sake of simplicity. Components of the work implement assembly 120 are described below with reference to FIGS. 2 and 3. Components of the saddle linkage 150 are described below with reference to FIG. 3.

The illustrative work implement assembly 120 includes a lift cylinder 224, a lift cylinder 226, a circle side shift cylinder 228, a draft frame or drawbar 230, a circle frame 232, a circle drive motor 334, a blade tilt frame 336, and a blade tilt cylinder 338. The lift cylinders 224, 226 are each coupled to the saddle linkage 150 and configured to drive movement of one or more components of the motor grader 100 (e.g., the saddle linkage 150, the draft frame 230, and/or the blade 122) in response to a change in length of the corresponding lift cylinder 224, 226. The circle side shift cylinder 228 is coupled to the saddle linkage 150 and configured to drive movement of one or more components of the grader 100 (e.g., the saddle linkage 150, the draft frame 230, and/or the blade 122) in response to a change in length of the circle side shift cylinder 228. The draft frame 230 is coupled to the lift cylinders 224, 226 and the circle side shift cylinder 228 such that the position of the draft frame 230 is substantially set or defined by the components 224, 226, 228. The circle frame 232 is coupled to the draft frame 230 for rotation relative thereto when driven by the circle drive motor 334 supported by the circle frame 232. The blade tilt frame 336 is interconnected with the circle frame 232 and configured to support the blade 122 for movement relative to an underlying surface. The blade tilt cylinder 338 is supported by the blade tilt frame 336 and configured to drive movement of the blade tilt frame 336 and the blade 122.

In the illustrative embodiment, each of the lift cylinders 224, 226 is embodied as, or otherwise includes, a hydraulic actuator such as a double-acting cylinder, for example. Of course, it should be appreciated that each of the lift cylinders 224, 226 may be embodied as, or otherwise include, another suitable actuator. In any case, the lift cylinders 224, 226 are extendable and retractable to adjust the length thereof and thereby drive movement of one or more components of the motor grader 100, as indicated above. To measure the length and/or movement of the lift cylinders 224, 226, or to otherwise measure the positional state of the lift cylinders 224, 226, lift cylinder sensors 224S, 226S may be coupled to the respective lift cylinders 224, 226. The lift cylinder sensors 224S, 226S may each be embodied as, or otherwise include, any device capable of measuring one or more length(s) of the corresponding lift cylinder 224, 224 and providing sensor input indicative of the one or more measured lengths.

In the illustrative embodiment, the circle side shift cylinder 228 is embodied as, or otherwise includes, a hydraulic actuator such as a double-acting cylinder, for example. Of course, it should be appreciated that the circle side shift cylinder 228 may be embodied as, or otherwise include, another suitable actuator. In any case, the circle side shift cylinder 228 is extendable and retractable to adjust the length thereof and thereby drive movement of one or more components of the motor grader 100, as indicated above. To measure the length and/or movement of the cylinder 228, or to otherwise measure the positional state of the circle side shift cylinder 228, a circle side shift cylinder sensor 228S may be coupled to the cylinder 228. The sensor 228S may each be embodied as, or otherwise include, any device capable of measuring one or more length(s) of the circle side shift cylinder 228 and providing sensor input indicative of the one or more measured lengths.

The illustrative draft frame 230 is embodied as, or otherwise includes, an A-shaped structure pivotally coupled to the front chassis 102 via a ball and socket coupling 103 to permit movement of the draft frame 230 relative to the front chassis 102 about at least one axis. In the illustrative embodiment, the draft frame 230 is configured for at least one of the following: movement relative to the front chassis 102 about the roll axis RA, which may be referred to herein as roll of the draft frame 230; and movement relative to the front chassis 102 about the pitch axis PA, which may be referred to herein as pitch of the draft frame 230. In some embodiments, the draft frame 230 may be configured for movement relative to the front chassis 102 about the yaw axis YA, which may be referred to herein as yaw of the draft frame 230, although such movement may be minimal, nominal, or otherwise non-appreciable during operation of the motor grader 100. In any case, to measure operational characteristics such as roll, pitch, and/or yaw of the draft frame 230 relative to the front chassis 102 in use of the motor grader 100, or to measure other operational characteristics of the draft frame 230 relative to the front chassis 102, one or more draft frame sensors 230S may be coupled to the draft frame 230. The one or more draft frame sensors 230S may each be any device capable of measuring roll, pitch, and/or yaw of the draft frame 230 relative to the front chassis 102 and providing sensor input indicative of the measured movement. The one or more draft frame sensors 230S may each be embodied as, or otherwise include, an accelerometer configured to measure movement of the draft frame 230 based on an inertial reference frame, or the like, for example.

The illustrative circle frame 232 is embodied as, or otherwise includes, a circular structure that is pivotally coupled to the draft frame 230 to permit movement relative thereto. More specifically, in response to being driven by the circle drive motor 334 coupled thereto, the circle frame 232 is configured to rotate relative to the draft frame 230 about a circle axis CA, which may be substantially parallel to the yaw axis YA in some embodiments. In any case, to measure rotation of the circle frame 232 relative to the draft frame 230 about the axis CA, a circle rotation angle sensor 232S may be coupled to the circle frame 232. The circle rotation angle sensor 232S may be any device capable of measuring rotation of the circle frame 232 relative to the draft frame 230 about the axis CA and providing sensor input indicative of the measured movement. The circle rotation angle sensor 232S may be embodied as, or otherwise include, an accelerometer configured to measure movement of the circle frame 232 based on an inertial reference frame, or the like, for example.

In the illustrative embodiment, the circle drive motor 334 is embodied as, or otherwise includes, any device capable of driving movement of the circle frame 232 as indicated above. In some embodiments, the circle drive motor 334 may be embodied as, or otherwise include, a hydraulic actuator that may be extended and retracted to vary a length of the hydraulic actuator. Of course, in other embodiments, it should be appreciated that the circle drive motor 334 may be embodied as, or otherwise include, another suitable actuator. In any case, to measure one or more operational characteristics of the circle drive motor 334 (e.g., one or more lengths of the circle drive motor 334), a circle drive motor sensor 334S may be coupled to the circle drive motor 334. The sensor 334S may be embodied as, or otherwise include, any device capable of measuring one or more length(s) of the circle drive motor 334 and providing sensor input indicative of the one or more measured lengths, at least in some embodiments.

The illustrative blade tilt frame 336 is embodied as, or otherwise includes, a structure interconnected with the circle frame 232 that supports the blade 122 for movement relative to an underlying surface as indicated above. In some embodiments, the blade tilt frame 336 may be integrally formed with the circle frame 232. However, in other embodiments, the blade tilt frame 336 and the circle frame 232 may be formed separately. In any case, to measure one or more operational characteristics of the blade tilt frame 336 (e.g., movement and/or position of the blade tilt frame 336 relative to the circle frame 232), a blade tilt frame sensor 336S may be coupled to the blade tilt frame 336. The sensor 336S may be embodied as, or otherwise include, any device capable of measuring the one or more operational characteristics and providing sensor input indicative of the one or more operational characteristics, such as an accelerometer or the like, for example.

The illustrative blade tilt cylinder 338 is embodied as, or otherwise includes, any device capable of driving movement of the blade tilt frame 336 and the blade 122 as indicated above. In some embodiments, the blade tilt cylinder 338 may be embodied as, or otherwise include, a hydraulic actuator that may be extended and retracted to vary a length of the hydraulic actuator. Of course, in other embodiments, it should be appreciated that the blade tilt cylinder 338 may be embodied as, or otherwise include, another suitable actuator. In any case, to measure one or more operational characteristics of the blade tilt cylinder 338 (e.g., one or more lengths of the cylinder 338), a blade tilt cylinder sensor 338S may be coupled to the blade tilt cylinder 338. The sensor 338S may be embodied as, or otherwise include, any device capable of measuring one or more length(s) of the blade tilt cylinder 338 and providing sensor input indicative of the one or more measured lengths.

Referring only to FIG. 3, the illustrative saddle linkage 150 includes a mount 352, an arm 362, an arm 372, and a crossbar 382, each of which serves as a component of the aforementioned four-bar linkage. The mount 352 is movably coupled to the front chassis 102 and each of the arms 362, 372 is movably coupled to the mount 352. The crossbar 382 is movably coupled to each of the arms 362, 372.

The illustrative mount 352 is embodied as, or otherwise include, a structure adapted to mount to the front chassis 102 such that the saddle linkage 150 is suspended by the front chassis 102. The mount 352 includes a bracket 354 and a flange 356. The bracket 354 is pivotally coupled to the arms 362, 372 and formed to include a cutout 358 sized to receive the front chassis 102. The flange 356 is coupled to the bracket 354 and extends downwardly therefrom toward the surface(s) on which the motor grader 100 is positioned. As described in greater detail below, the flange 356 is configured for securement to the arm 362, the arm 372, or the crossbar 382 via a lock pin 394 to position the saddle linkage 150 in use of the motor grader 100. To that end, at least in some embodiments, the flange 356 is formed to include a lock pin aperture 360 that is sized to receive the lock pin 394.

The illustrative arms 362, 372 receive, and are suspended on, respective lift cylinders 226, 224. Additionally, the arms 362, 372 each receive, and are each pivotally coupled to, the crossbar 382. More specifically, slots 364, 374 formed in the arms 362, 372, respectively, receive the crossbar 382. The arms 362, 372 are formed to include respective locking holes 366, 376 extending therethrough, which are each sized to receive the lock pin 394.

The illustrative crossbar 382 is formed to include locking holes 384, 386, 388, 390, 392 each sized to receive the lock pin 394. The lock pin aperture 360 of the mount 352 may be aligned with the locking hole 366 of the arm 362, the locking hole 376 of the arm 372, or one of the locking holes 384, 386, 388, 390, 392 of the crossbar 382 to position the saddle linkage 150 in use of the motor grader 100. When the lock pin aperture 360 and the one of the locking holes 366, 376, 384, 386, 388, 390, 392 are aligned, the lock pin 394 may be received by the lock pin aperture 360 and the one of the locking holes 366, 376, 384, 386, 388, 390, 392 to secure the flange 356 to the arm 362, the arm 372, or the crossbar 382.

Figure 4:
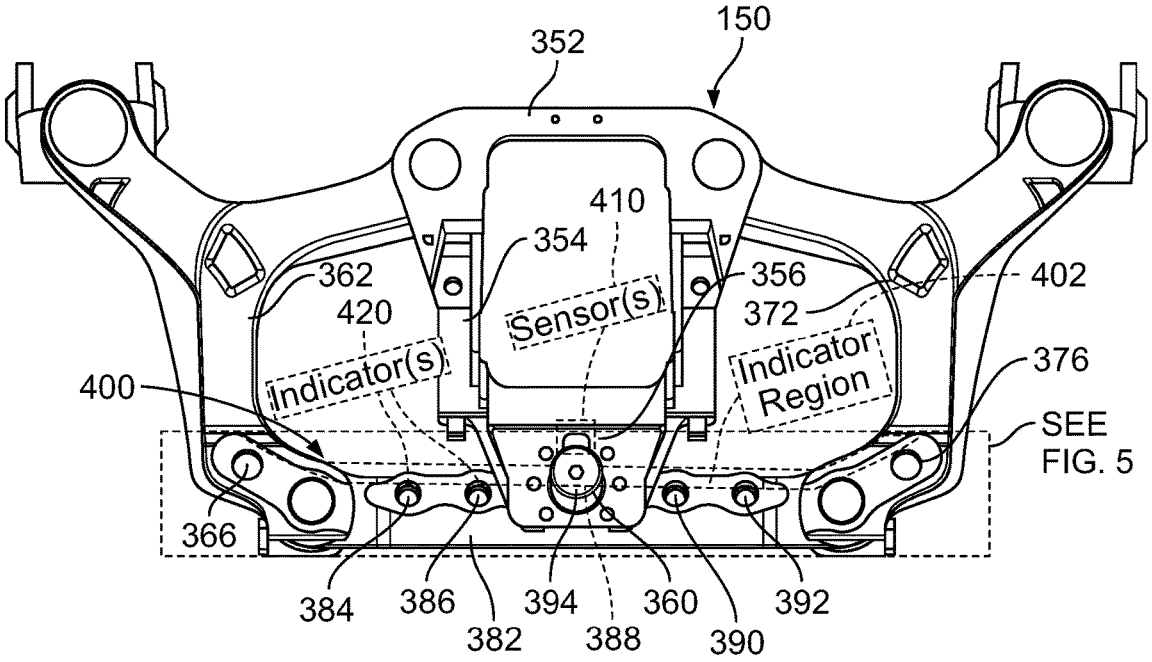
FIG. 4 is an elevation view of the saddle linkage shown in FIG. 3 and one embodiment of a motion measurement system coupled to the saddle linkage.

Referring now to FIG. 4, the saddle linkage 150 is shown with the work implement assembly 120 omitted for the sake of simplicity. In the illustrative embodiment, a motion measurement system 400 coupled to the saddle linkage 150 is configured to measure movement or position of one or more components of the motor grader 100 in use thereof. The motion measurement system 400 includes at least one sensor 410 mounted to the mount 352 in close proximity to the lock pin aperture 360 and at least one indicator 420 mounted in close proximity to at least one of the locking holes 366, 376, 384, 386, 388, 390, 392, as further discussed below. The at least one sensor 410 is configured to sense the at least one indicator 420 and provide sensor input indicative of one or more characteristics of the at least one indicator 420, as further discussed below. The motion measurement system 400 also includes a controller 610 (see FIG. 6) that is coupled to the at least one sensor 410 and configured to receive the sensor input and determine a positional state of the saddle linkage 150 based on the sensor input, as further discussed below.

In the illustrative embodiment, the at least one sensor 410 is embodied as, or otherwise includes, at least one hall effect sensor mounted to the flange 356 and spaced from the lock pin aperture 360. The at least one hall effect sensor 410 is illustratively configured to sense the proximity of at least one of the indicators 420 based on a magnetic field and provide sensor data indicative of the proximity of the at least one indicator 420 to the at least one hall effect sensor 410. In other embodiments, however, the at least one sensor 410 may be embodied as, or otherwise include, another suitable sensor, such as a magnetoresistance-based sensor, for example.

In the illustrative embodiment, the at least one indicator 420 is mounted in a indicator region 402 that extends across the crossbar 382 and over a portion of each of the arms 362, 372. The illustrative indicator region 402 is located on the crossbar 382 above each of the locking holes 384, 386, 388, 390, 392 relative to the ground and on the arms 362, 372 above the respective locking holes 366, 376 relative to the ground such that the indicator region 402 is in close proximity to each of the locking holes 366, 376, 384, 386, 388, 390, 392. In other embodiments, however, the indicator region 402 may have another suitable location on each of the crossbar 382, the arm 362, and the arm 372.

In the illustrative embodiment, the at least one indicator 420 is embodied as, or otherwise includes, at least one magnet mounted in the indicator region 402. The at least one magnet 420 is illustratively configured to produce a magnetic field that may be sensed by the at least one hall effect sensor 410 as discussed above. In some embodiments, the at least one magnet 420 may be embodied as, or otherwise include, a permanent magnet containing ferromagnetic materials. In other embodiments, however, the at least one magnet 420 may be embodied as, or otherwise include, another suitable magnet.

Figure 5:
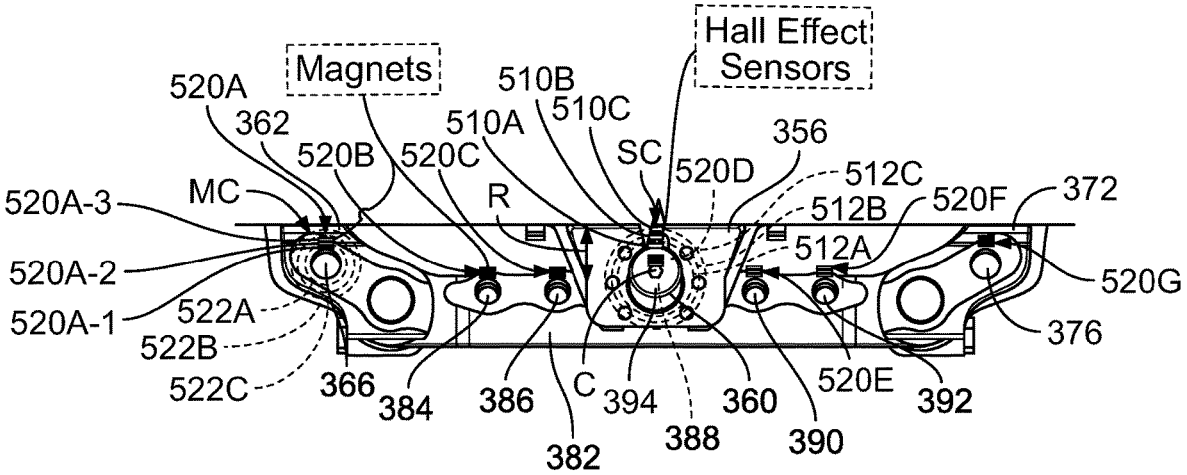
FIG. 5 is a detail view of the saddle linkage and the motion measurement system shown in FIG. 4.

Referring now to FIG. 5, the at least one hall effect sensor 410 illustratively includes hall effect sensors 510A, 510B, 510C. In the illustrative embodiment, the hall effect sensors 510A, 510B, 510C are spaced from one another and the lock pin aperture 360 in a radial direction R such that the sensors 510A, 510B, 510C form a sensor column SC. The sensors 510A, 510B, 510C are illustratively arranged radially outward of the lock pin aperture 360 on the flange 356. Of course, in other embodiments, the hall effect sensors 510A, 510B, 510C may have another suitable arrangement relative to one another and the lock pin aperture 360 on the flange 356.

In some embodiments, the hall effect sensors 510A, 510B, 510C may have, correspond to, or otherwise be associated with, respective sensing zones 512A, 512B, 512C. Each sensing zone 512A, 512B, 512C may be a circular zone concentric with a center C of the lock pin aperture 360, and each of the sensors 510A, 510B, 510C may lie on a radially-outermost periphery of the corresponding sensing zone 512A, 512B, 512C. In such embodiments, the sensing zone 512B may extend radially outward from the sensing zone 512A, and the sensing zone 512C may extend radially outward from the sensing zone 512B. Of course, in other embodiments, the hall effect sensors 510A, 510B, 510C may have, correspond to, or otherwise be associated with, other suitable sensing zones.

The at least one magnet 420 illustratively includes magnet sets 520A, 520B, 520C, 520D, 520E, 520F, 520G. The illustrative magnet sets 520A, 520B, 520C, 520D, 520E, 520F, 520G correspond to, and are located in close proximity to, respective locking holes 366, 384, 386, 388, 390, 392, 376. In the illustrative embodiment, each of the magnet sets 520A, 520B, 520C, 520D, 520E, 520F, 520G includes three magnets. Because the magnets sets 520A, 520B, 520C, 520D, 520E, 520F, 520G are identical to one another, only one magnet set (i.e., magnet set 520A) is discussed below. Of course, in other embodiments, the at least one magnet 420 may include another suitable number of magnets, and, presuming inclusion of the magnet sets 520A, 520B, 520C, 520D, 520E, 520F, 520G, each magnet set may include another suitable number of magnets.

The illustrative magnet set 520A includes magnets 520A-1, 520A-2, 520A-3. In the illustrative embodiment, the magnets 520A-1, 520A-2, 520A-3 are radially spaced from one another and the locking hole 366 such that the magnets 520A-1, 520A-2, 520A-3 form a magnet column MC. The magnets 520A-1, 520A-2, 520A-3 are illustratively arranged radially outward of the locking hole 366 on the arm 362. Of course, in other embodiments, the magnets 520A-1, 520A-2, 520A-3 may have another suitable arrangement relative to one another and the locking hole 366 on the arm 362.

In some embodiments, the magnets 520A-1, 520A-2, 520A-3 may have, correspond to, or otherwise be associated with, respective indicating zones 522A, 522B, 522C that may be sensed by the sensing zones 512A, 512B, 512C, respectively. Each indicating zone 522A, 522B, 522C may be a circular zone concentric with a center Cl of the locking hole 366, and each of the magnets 520A-1, 520A-2, 520A-3 may lie on a radially-outermost periphery of the corresponding indicating zone 522A, 522B, 522C. In such embodiments, the indicating zone 522B may extend radially outward from the indicating zone 522A, and the indicating zone 522C may extend radially outward from the indicating zone 522B. Of course, in other embodiments, the magnets 520A-1, 520A-2, 520A-3 may have, correspond to, or otherwise be associated with, other suitable indicating zones.

Figure 6:
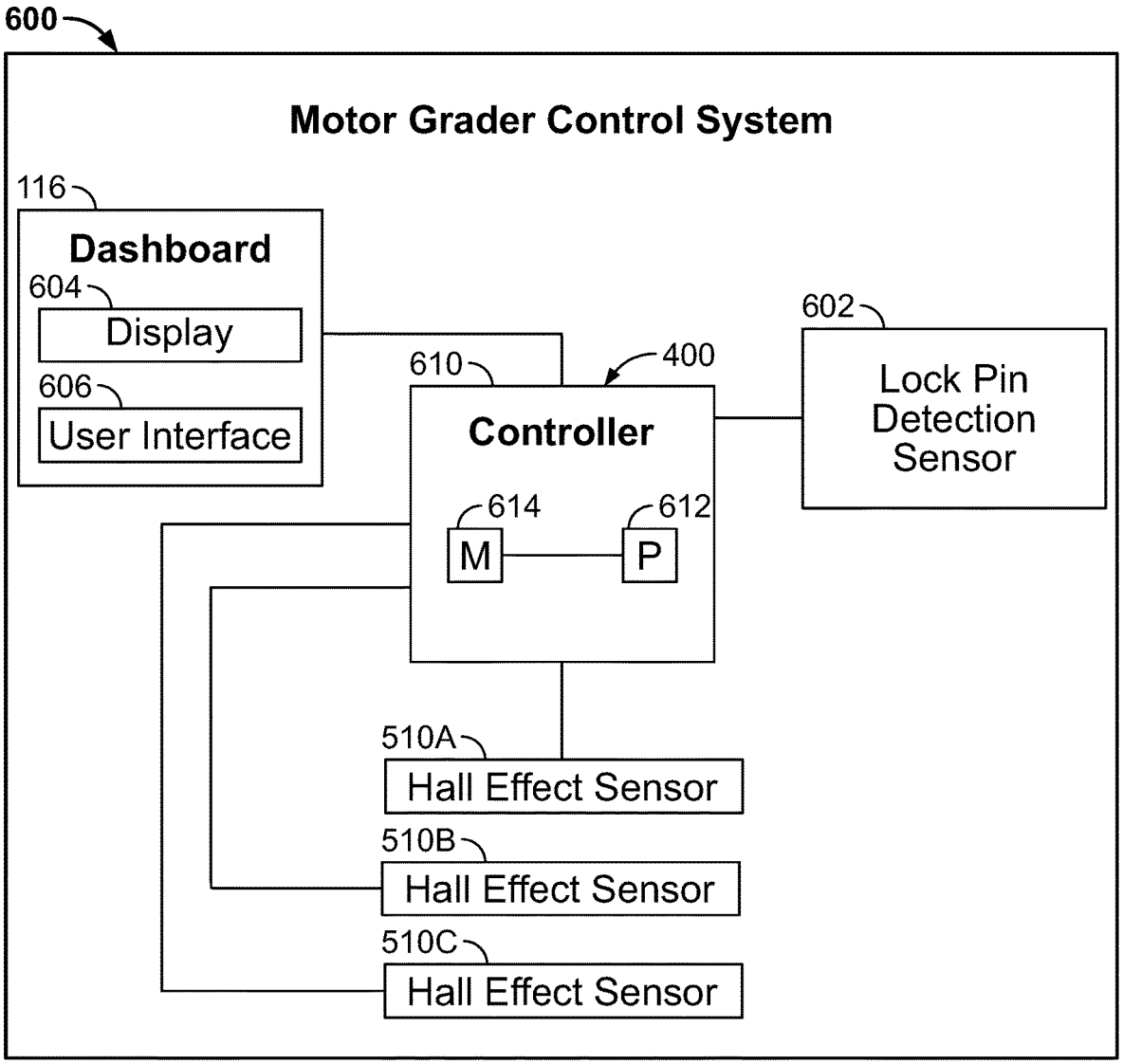
FIG. 6 is a diagrammatic view of a motor grader control system adapted for use with the motion measurement system shown in FIG. 4.

Referring now to FIG. 6, an illustrative control system 600, which may be used to control operation of some components of the motor grader 100 in some embodiments, includes, is coupled to, or is otherwise adapted for use with, the motion measurement system 400. As such, for ease of discussion, the control system 600 is shown to include the controller 610 and the hall effect sensors 510A, 510B, 510C each coupled thereto. The controller 610 illustratively includes a processor 612 and a memory device 614 coupled to the processor 612.

The processor 612 may be embodied as, or otherwise include, any type of processor, controller, or other compute circuit capable of performing various tasks such as compute functions and/or controlling the functions of the motor grader 100 and/or the motion measurement system 400. For example, the processor 612 may be embodied as a single or multi-core processor(s), a microcontroller, or other processor or processing/controlling circuit. In some embodiments, the processor 612 may be embodied as, include, or be coupled to an FPGA, an application specific integrated circuit (ASIC), reconfigurable hardware or hardware circuitry, or other specialized hardware to facilitate performance of the functions described herein. Additionally, in some embodiments, the processor 612 may be embodied as, or otherwise include, a high-power processor, an accelerator co-processor, or a storage controller. In some embodiments still, the processor 612 may include more than one processor, controller, or compute circuit.

The memory device 614 may be embodied as any type of volatile (e.g., dynamic random access memory (DRAM), etc.) or non-volatile memory capable of storing data therein. Volatile memory may be embodied as a storage medium that requires power to maintain the state of data stored by the medium. Non-limiting examples of volatile memory may include various types of random access memory (RAM), such as dynamic random access memory (DRAM) or static random access memory (SRAM). One particular type of DRAM that may be used in a memory module is synchronous dynamic random access memory (SDRAM). In particular embodiments, DRAM of a memory component may comply with a standard promulgated by JEDEC, such as JESD79F for DDR SDRAM, JESD79-2F for DDR2 SDRAM, JESD79-3F for DDR3 SDRAM, JESD79-4A for DDR4 SDRAM, JESD209 for Low Power DDR (LPDDR), JESD209-2 for LPDDR2, JESD209-3 for LPDDR3, and JESD209-4 for LPDDR4 (these standards are available at www.jedec.org). Such standards (and similar standards) may be referred to as DDR-based standards and communication interfaces of the storage devices that implement such standards may be referred to as DDR-based interfaces.

In some embodiments, the memory device 614 may be embodied as a block addressable memory, such as those based on NAND or NOR technologies. The memory device 614 may also include future generation nonvolatile devices, such as a three dimensional crosspoint memory device (e.g., Intel 3D XPoint™ memory), or other byte addressable write-in-place nonvolatile memory devices. In some embodiments, the memory device 614 may be embodied as, or may otherwise include, chalcogenide glass, multi-threshold level NAND flash memory, NOR flash memory, single or multi-level Phase Change Memory (PCM), a resistive memory, nanowire memory, ferroelectric transistor random access memory (FeTRAM), anti-ferroelectric memory, magnetoresistive random access memory (MRAM) memory that incorporates memristor technology, resistive memory including the metal oxide base, the oxygen vacancy base and the conductive bridge Random Access Memory (CB-RAM), or spin transfer torque (STT)-MRAM, a spintronic magnetic junction memory based device, a magnetic tunneling junction (MTJ) based device, a DW (Domain Wall) and SOT (Spin Orbit Transfer) based device, a thyristor based memory device, or a combination of any of the above, or other memory. The memory device may refer to the die itself and/or to a packaged memory product. In some embodiments, 3D crosspoint memory (e.g., Intel 3D XPoint™ memory) may comprise a transistor-less stackable cross point architecture in which memory cells sit at the intersection of word lines and bit lines and are individually addressable and in which bit storage is based on a change in bulk resistance.

The illustrative control system 600 includes a lock pin detection sensor 602 coupled to the controller 610. In some embodiments, the lock pin detection sensor 602 may be included in the motion measurement system 400. The lock pin detection sensor 602 is coupled to the saddle linkage 150 as best seen in FIG. 2. The lock pin detection sensor 602 is configured to provide lock detection sensor input indicative of whether the saddle linkage 150 is locked in one of a plurality of positional states (i.e., whether the lock pin 394 is received by the lock pin aperture 360 and the one of the locking holes 366, 376, 384, 386, 388, 390, 392) in use of the motor grader 100.

The illustrative control system 600 includes the dashboard 116 that is coupled to the controller 610 and includes a display 604 and a user interface 606. The display 604 is configured to output or display various indications, messages, and/or prompts to an operator, which may be generated by the control system 600. The user interface 606 is configured to provide various inputs to the control system 600 based on various actions, which may include actions performed by an operator.

Of course, it should be appreciated that the control system 600 may include components in addition to, and/or in lieu of, the components depicted in FIG. 6. However, for the sake of simplicity, discussion of those additional and/or alternative components is omitted.

Figure 7:
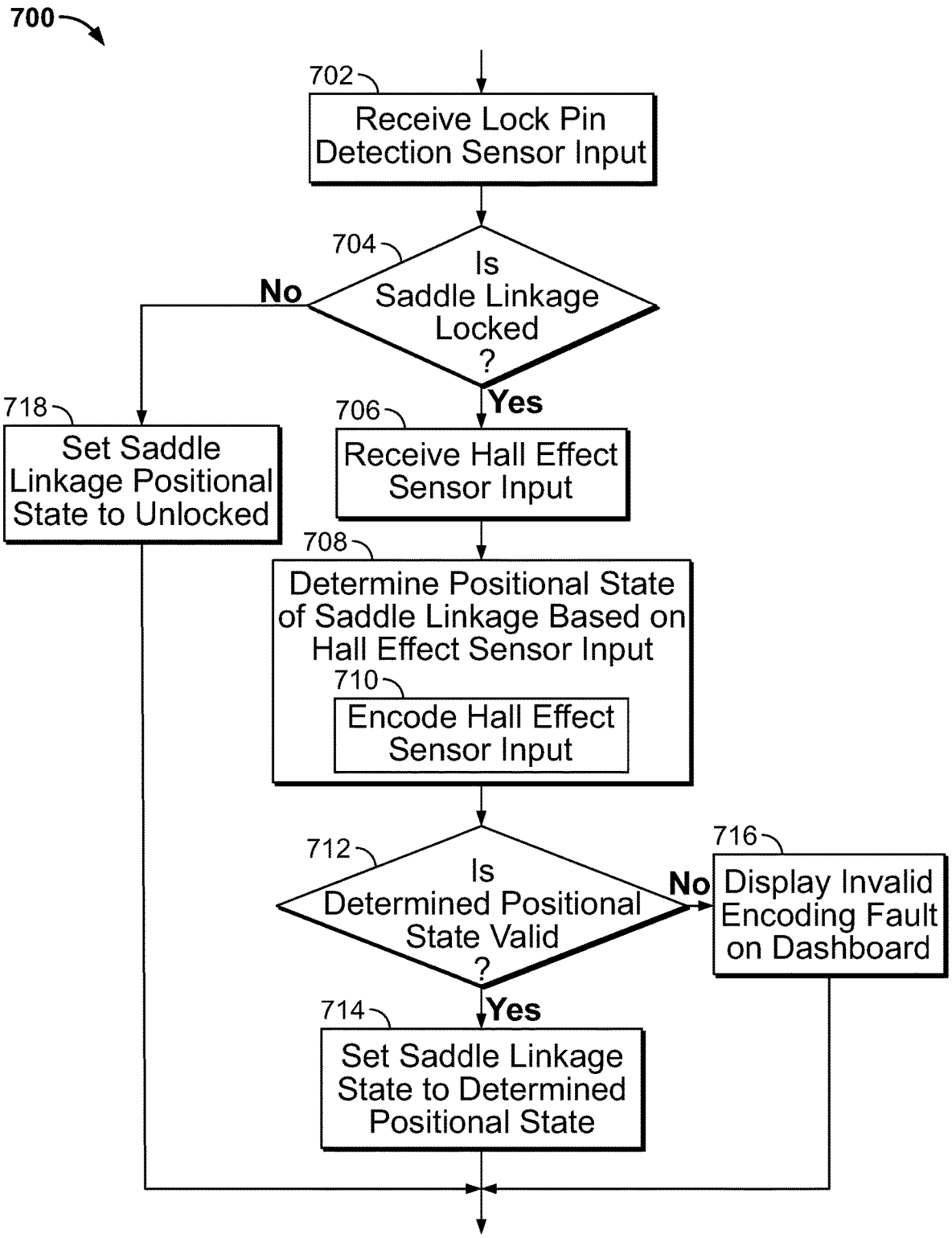
FIG. 7 is a simplified flowchart of a method of operating a motor grader that may be performed by the motor grader control system of FIG. 6.

Referring now to FIG. 7, an illustrative method 700 of operating the motor grader 100 (i.e., in embodiments in which the motor grader 100 includes the motion measurement system 400) may be embodied as, or otherwise include, a set of instructions that are executable by the control system 600 to control operation of the motor grader 100 and/or the motion measurement system 400. The method 700 corresponds to, or is otherwise associated with, performance of the blocks described below in the illustrative sequence of FIG. 7. It should be appreciated, however, that the method 700 may be performed in one or more sequences different from the illustrative sequence.

The illustrative method 700 begins with block 702. In block 702, the controller 610 receives the lock detection sensor input provided by the lock pin detection sensor 602. From the block 702, the method 700 subsequently proceeds to block 704.

In block 704 of the illustrative method 700, the controller 610 determines whether the saddle linkage 150 is locked in one of a plurality of positional states (i.e., whether the lock pin 394 is received by the lock pin aperture 360 and the one of the locking holes 366, 376, 384, 386, 388, 390, 392) based on the lock detection sensor input received in block 702. If the controller 610 determines that the saddle linkage 150 is locked in block 704, the method 700 subsequently proceeds to block 706.

In block 706 of the illustrative method 700, the controller 610 receives the sensor input provided by the hall effect sensors 510A, 510B, 510C. In the illustrative embodiment, the sensor input provided by the hall effect sensors 510A, 510B, 510C is based on the detection, or lack of detection, of the magnet sets 520A, 520B, 520C, 520D, 520E, 520F, 520G corresponding to the locking holes 366, 384, 386, 388, 390, 392, 376. As such, in block 706, each of the hall effect sensors 510A, 510B, 510C provides sensor input based on the detection, or lack of detection, of the magnet sets 520A, 520B, 520C, 520D, 520E, 520F, 520G at each of the locking holes 366, 384, 386, 388, 390, 392, 376. From block 706, the method 700 subsequently proceeds to block 708.

In block 708 of the illustrative method 700, the controller 610 determines a positional state of the saddle linkage 150 based on the sensor input provided by the hall effect sensors 510A, 510B, 510C in block 706. To do so, in block 710, the controller 610 encodes the sensor input provided by the hall effect sensors 510A, 510B, 510C. Each sensor 510A, 510B, 510C provides sensor input based on magnet proximity sensing at each of the seven locking holes 366, 384, 386, 388, 390, 392, 376, as indicated above. Consequently, for each of the seven locking holes 366, 384, 386, 388, 390, 392, 376, each of the sensors 510A, 510B, 510C provides sensor input (e.g., a "0" or a "1") such that each of the locking holes 366, 384, 386, 388, 390, 392, 376 is characterized by, or otherwise associated with, a 3-bit data string (e.g., "111"). Therefore, to encode the sensor input in block 710, the controller 610 encodes a 3-bit data string corresponding to each locking hole 366, 384, 386, 388, 390, 392, 376 (i.e., the controller 610 encodes a total of seven 3-bit data strings) to determine a positional state of the saddle linkage 150. From block 710, the method 700 subsequently proceeds to block 712.

In block 712 of the illustrative method 700, the controller 610 determines whether the positional state of the saddle linkage 150 determined in block 708 is valid. It should be appreciated that each 3-bit data string encoded in block 710 may be compared to a reference data string corresponding to, or otherwise associated with, a discrete positional state of the saddle linkage 150. Based on that comparison, the controller 610 may determine whether the positional state of the saddle linkage 150 determined in block 708 is valid. If the controller 610 determines in block 712 that the positional state of the saddle linkage 150 determined in step 708 is valid, the method 700 subsequently proceeds to block 714.

In block 714 of the illustrative method 700, the controller 610 sets the positional state of the saddle linkage 150 to the positional state determined in step 708. In some embodiments, performance of the block 714 may correspond to, or otherwise be associated with, execution of one iteration of the method 700 by the controller 610.

Returning to block 712, if the controller 610 determines that the positional state of the saddle linkage 150 determined in step 708 is not valid, the method 700 subsequently proceeds to block 716. In block 716, the controller 610 directs a fault to be displayed on the dashboard 116 (e.g., on the display 604). The fault, which may be displayed on the display 604 as "Invalid Encoding," may indicate that the 3-bit data string encoded in block 710 did not match, or was otherwise inconsistent with, one or more of the reference data strings corresponding to the discrete positional states of the saddle linkage 150.

Returning to block 704, if the controller 610 determines that the saddle linkage 150 is not locked in one of the plurality of positional states, the method 700 subsequently proceeds to block 718. In block 718, the controller 610 sets the positional state of the saddle linkage 150 to unlocked.

Figure 8:
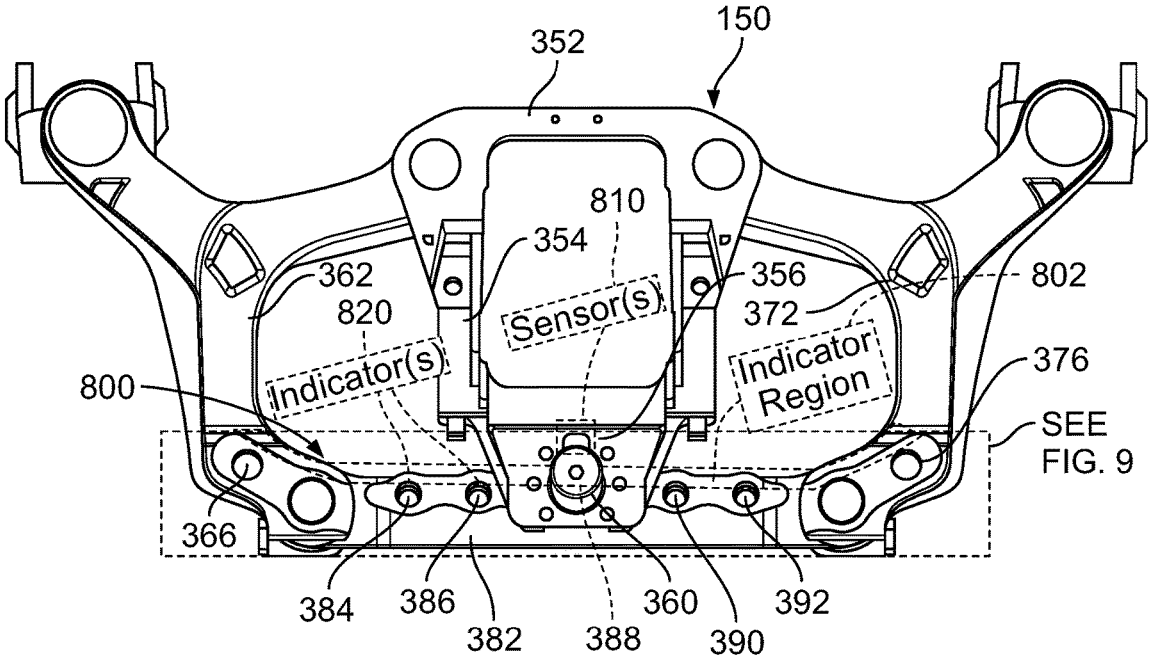
FIG. 8 is an elevation view of the saddle linkage shown in FIG. 3 and another embodiment of a motion measurement system coupled to the saddle linkage.

Referring now to FIG. 8, the saddle linkage 150 is again shown with the work implement assembly 120 omitted for the sake of simplicity. In the illustrative embodiment, a motion measurement system 800 coupled to the saddle linkage 150 is configured to measure movement or position of one or more components of the motor grader 100 in use thereof. The motion measurement system 800 includes at least one sensor 810 mounted to the mount 352 in close proximity to the lock pin aperture 360 and at least one indicator 820 mounted in close proximity to at least one of the locking holes 366, 376, 384, 386, 388, 390, 392, as further discussed below. The at least one sensor 810 is configured to sense the at least one indicator 820 and provide sensor input indicative of one or more characteristics of the at least one indicator 820, as further discussed below. The motion measurement system 800 also includes a controller 1110 (see FIG. 11) that is coupled to the at least one sensor 810 and configured to receive the sensor input and determine a positional state of the saddle linkage 150 based on the sensor input, as further discussed below.

In the illustrative embodiment, the at least one sensor 810 is embodied as, or otherwise includes, at least one inductive sensor mounted to the flange 356 and spaced from the lock pin aperture 360. The at least one inductive sensor 810 is illustratively configured to sense the proximity of the at least one indicator 820 and provide sensor data indicative of the proximity of the at least one indicator 820 to the at least one inductive sensor 810. In some embodiments, the at least one indicator 820 may produce a magnetic field. In such embodiments, the at least one inductive sensor 810 may be configured to sense the proximity of the at least one indicator 820 based on the magnetic field.

In the illustrative embodiment, the at least one indicator 820 is formed in an indicator region 802 that extends across the crossbar 382 and over a portion of each of the arms 362, 372. The illustrative indicator region 802 is formed in the crossbar 382 above each of the locking holes 384, 386, 388, 390, 392 relative to the ground and in the arms 362, 372 above the respective locking holes 366, 376 relative to the ground such that the indicator region 802 is in close proximity to each of the locking holes 366, 376, 384, 386, 388, 390, 392. In other embodiments, however, the indicator region 802 may be formed in another suitable location on each of the crossbar 382, the arm 362, and the arm 372.

In the illustrative embodiment, the at least one indicator 820 is embodied as, or otherwise includes, at least one machined surface located in the indicator region 802. The at least one machined surface 820 is illustratively recessed from (i.e., has a depth measured with respect to) one or more surfaces of the arm 362, the arm 372, or the crossbar 382. In some embodiments, the at least one machined surface 820 may be formed from ferromagnetic materials. In other embodiments, however, the at least one machined surface 820 may be formed from other suitable materials.

Figure 9:
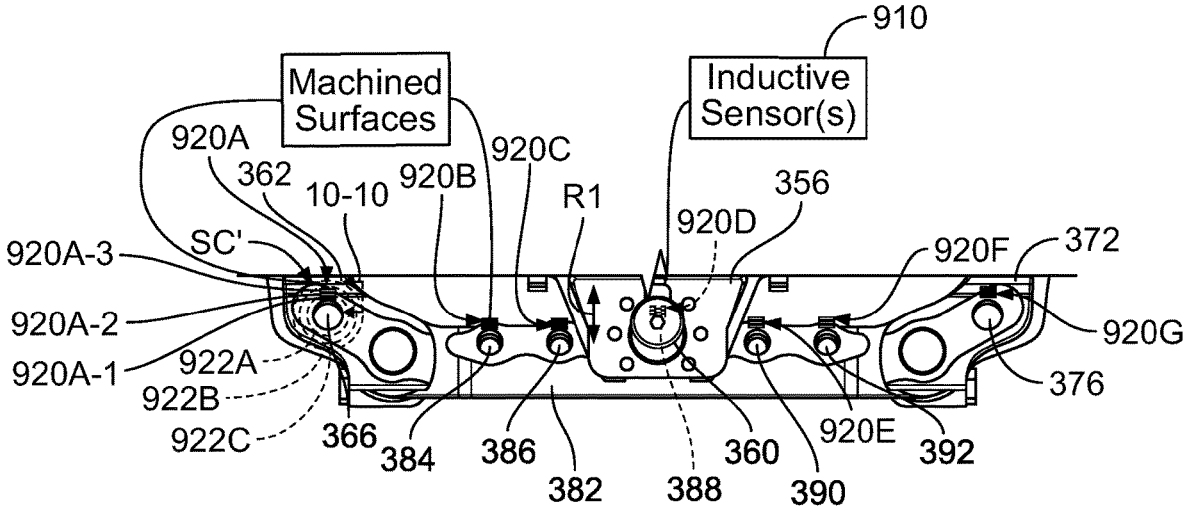
FIG. 9 is a detail view of the saddle linkage and the motion measurement system shown in FIG. 8.

Referring now to FIG. 9, the at least one inductive sensor 810 illustratively includes one inductive sensor 910. In the illustrative embodiment, the inductive sensor 910 is spaced from the lock pin aperture 360 in a radial direction R1. The sensor 910 is illustratively arranged radially outward of the lock pin aperture 360 on the flange 356. Of course, in other embodiments, the sensor 910 may have another suitable arrangement relative to the lock pin aperture 360 on the flange 356. Additionally, in other embodiments, the at least one inductive sensor 810 may include multiple inductive sensors, such as three inductive sensors, for example. In such embodiments, the multiple inductive sensors may be radially spaced from one another and the lock pin aperture 360 such that the sensors form a sensor column in similar fashion to the sensor column SC formed by the sensors 510A, 510B, 510C. Furthermore, in such embodiments, the multiple inductive sensors may have, correspond to, or otherwise be associated with, respective sensing zones similar to the sensing zones 512A, 512B, 512C.

The at least one machined surface 820 illustratively includes machined surface sets 920A, 920B, 920C, 920D, 920E, 920F, 920G. The illustrative machined surface sets 920A, 920B, 920C, 920D, 920E, 920F, 920G correspond to, and are located in close proximity to, respective locking holes 366, 384, 386, 388, 390, 392, 376. In the illustrative embodiment, each of the machined surface sets 920A, 920B, 920C, 920D, 920E, 920F, 920G includes three machined surfaces. Because the machined surface sets 920A, 920B, 920C, 920D, 920E, 920F, 920G are identical to one another, only one machined surface set (i.e., machined surface set 920A) is discussed below. Of course, in other embodiments, the at least one machined surface 820 may include another suitable number of machined surfaces, and, presuming inclusion of the machined surface sets 920A, 920B, 920C, 920D, 920E, 920F, 920G, each machined surface set may include another suitable number of machined surfaces.

The illustrative machined surface set 920A includes machined surfaces 920A-1, 920A-2, 920A-3. In the illustrative embodiment, the machined surfaces 920A-1, 920A-2, 920A-3 are radially spaced from one another and the locking hole 366 such that the machined surfaces 920A-1, 920A-2, 920A-3 form a surface column SC'. The machined surfaces 920A-1, 920A-2, 920A-3 are illustratively arranged radially outward of the locking hole 366 on the arm 362. Of course, in other embodiments, the machined surfaces 920A-1, 920A-2, 920A-3 may have another suitable arrangement relative to one another and the locking hole 366 on the arm 362.

In some embodiments, the machined surfaces 920A-1, 920A-2, 920A-3 may have, correspond to, or otherwise be associated with, respective indicating zones 922A, 922B, 922C that may be sensed by the inductive sensor 910. In such embodiments, the indicating zones 922A, 922B, 922C may be similar to the indicating zones 522A, 522B, 522C. Of course, in other embodiments, the machined surfaces 920A-1, 920A-2, 920A-3 may have, correspond to, or otherwise be associated with, other suitable indicating zones. Furthermore, in other embodiments, the machined surfaces 920A-1, 920A-2, 920A-3 may not have, or be associated with, indicating zones.

Figure 10:
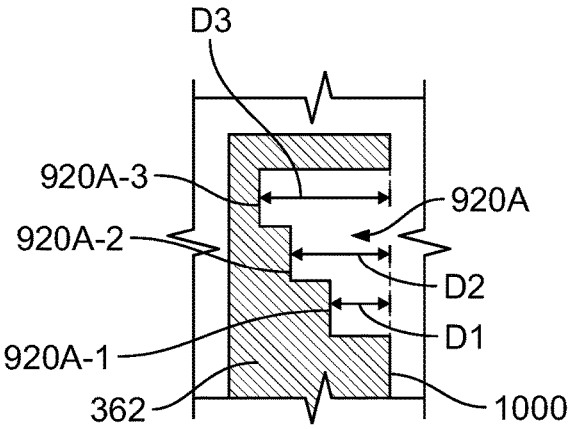
FIG. 10 is a detail view taken about line 10-10 of a set of machined surfaces included in the motion measurement system shown in FIG. 8.

Referring now to FIG. 10, and again using the machined surface set 920A as an example, the machined surfaces 920A-1, 920A-2, 920A-3 are recessed different distances from an exterior face 1000 of the arm 362. More specifically, the machined surface 920A-1 is recessed a distance D1 from the face 1000, the machined surface 920A-2 is recessed a distance D2 from the face 1000, and the machined surface 920A-3 is recessed a distance D3 from the face 1000. In the illustrative embodiment, the distance D1 is less than the distance D2 and the distance D2 is less than the distance D3. Of course, it should be appreciated that in other embodiments, the machined surfaces 920A-1, 920A-2, 920A-3 may be recessed other suitable distances from the face 1000.

Figure 11:
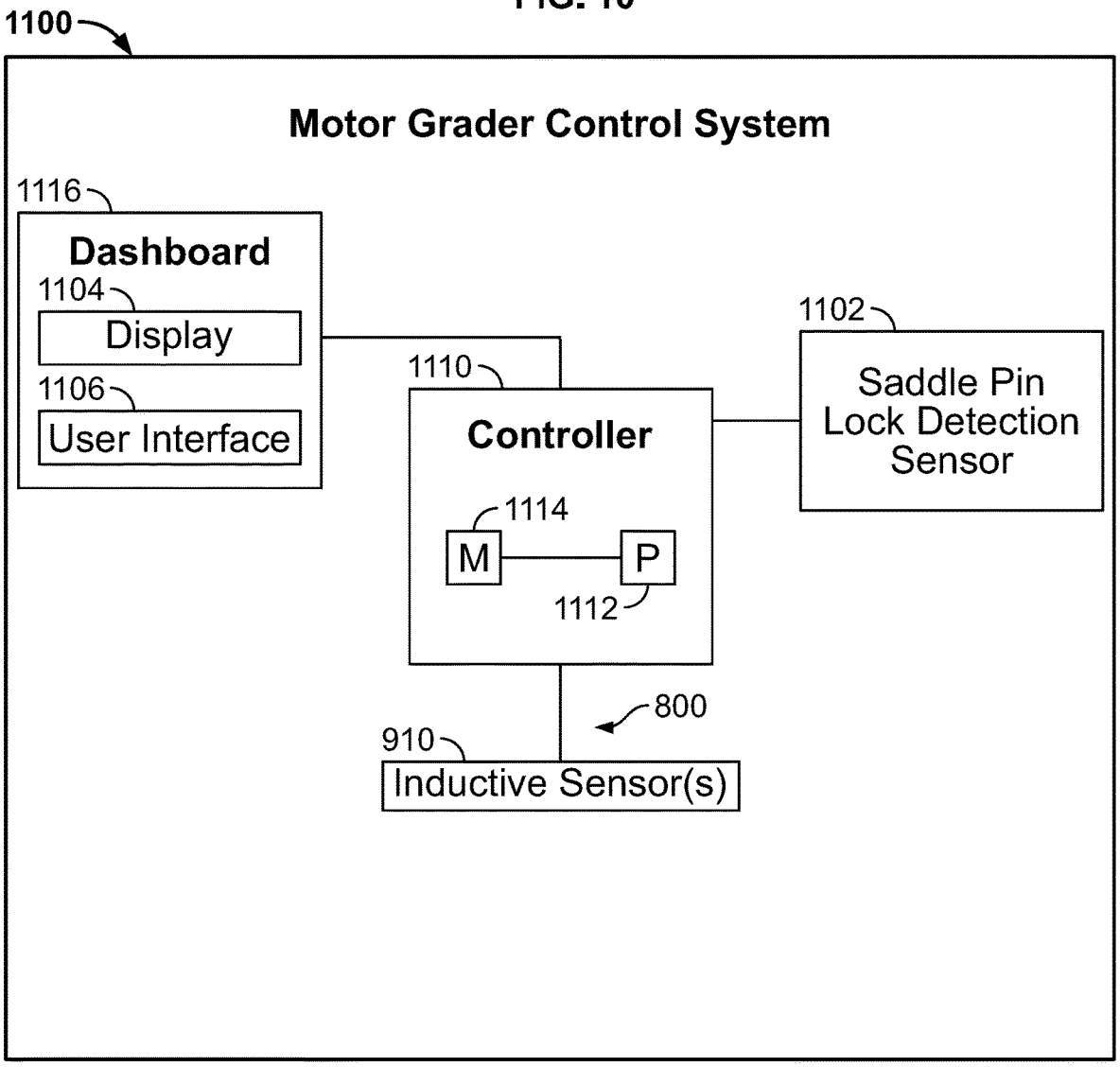
FIG. 11 is a diagrammatic view of a motor grader control system adapted for use with the motion measurement system shown in FIG. 8.

Referring now to FIG. 11, an illustrative control system 1100, which may be used to control operation of some components of the motor grader 100 in some embodiments, includes, is coupled to, or is otherwise adapted for use with, the motion measurement system 800. As such, for ease of discussion, the control system 1100 is shown to include the controller 1110 and the inductive sensor 910 coupled thereto. The controller 1110 illustratively includes a processor 1112 and a memory device 1114 coupled to the processor 1112.

The processor 1112 may be embodied as, or otherwise include, any type of processor, controller, or other compute circuit capable of performing various tasks such as compute functions and/or controlling the functions of the motor grader 100 and/or the motion measurement system 800. For example, the processor 1112 may be embodied as a single or multi-core processor(s), a microcontroller, or other processor or processing/controlling circuit. In some embodiments, the processor 1112 may be embodied as, include, or be coupled to an FPGA, an application specific integrated circuit (ASIC), reconfigurable hardware or hardware circuitry, or other specialized hardware to facilitate performance of the functions described herein. Additionally, in some embodiments, the processor 1112 may be embodied as, or otherwise include, a high-power processor, an accelerator co-processor, or a storage controller. In some embodiments still, the processor 1112 may include more than one processor, controller, or compute circuit.

The memory device 1114 may be embodied as any type of volatile (e.g., dynamic random access memory (DRAM), etc.) or non-volatile memory capable of storing data therein. Volatile memory may be embodied as a storage medium that requires power to maintain the state of data stored by the medium. Non-limiting examples of volatile memory may include various types of random access memory (RAM), such as dynamic random access memory (DRAM) or static random access memory (SRAM). One particular type of DRAM that may be used in a memory module is synchronous dynamic random access memory (SDRAM). In particular embodiments, DRAM of a memory component may comply with a standard promulgated by JEDEC, such as JESD79F for DDR SDRAM, JESD79-2F for DDR2 SDRAM, JESD79-3F for DDR3 SDRAM, JESD79-4A for DDR4 SDRAM, JESD209 for Low Power DDR (LPDDR), JESD209-2 for LPDDR2, JESD209-3 for LPDDR3, and JESD209-4 for LPDDR4 (these standards are available at www.jedec.org). Such standards (and similar standards) may be referred to as DDR-based standards and communication interfaces of the storage devices that implement such standards may be referred to as DDR-based interfaces.

In some embodiments, the memory device 1114 may be embodied as a block addressable memory, such as those based on NAND or NOR technologies. The memory device 1114 may also include future generation nonvolatile devices, such as a three dimensional crosspoint memory device (e.g., Intel 3D XPoint™ memory), or other byte addressable write-in-place nonvolatile memory devices. In some embodiments, the memory device 1114 may be embodied as, or may otherwise include, chalcogenide glass, multi-threshold level NAND flash memory, NOR flash memory, single or multi-level Phase Change Memory (PCM), a resistive memory, nanowire memory, ferroelectric transistor random access memory (FeTRAM), anti-ferroelectric memory, magnetoresistive random access memory (MRAM) memory that incorporates memristor technology, resistive memory including the metal oxide base, the oxygen vacancy base and the conductive bridge Random Access Memory (CB-RAM), or spin transfer torque (STT)-MRAM, a spintronic magnetic junction memory based device, a magnetic tunneling junction (MTJ) based device, a DW (Domain Wall) and SOT (Spin Orbit Transfer) based device, a thyristor based memory device, or a combination of any of the above, or other memory. The memory device may refer to the die itself and/or to a packaged memory product. In some embodiments, 3D crosspoint memory (e.g., Intel 3D XPoint™ memory) may comprise a transistor-less stackable cross point architecture in which memory cells sit at the intersection of word lines and bit lines and are individually addressable and in which bit storage is based on a change in bulk resistance.

The illustrative control system 1100 includes a lock pin detection sensor 1102 coupled to the controller 1110 that is substantially identical to the lock pin detection sensor 602. In some embodiments, the lock pin detection sensor 1102 may be included in the motion measurement system 800. The illustrative control system 1100 also includes a dashboard 1116 that is coupled to the controller 1110 and has a display 1104 and a user interface 1106. The dashboard 1116 is substantially identical to the dashboard 116, and as such, the display 1104 and the user interface 1106 are substantially identical to the display 604 and the user interface 606, respectively.

Of course, it should be appreciated that the control system 1100 may include components in addition to, and/or in lieu of, the components depicted in FIG. 11. However, for the sake of simplicity, discussion of those additional and/or alternative components is omitted.

Figure 12:
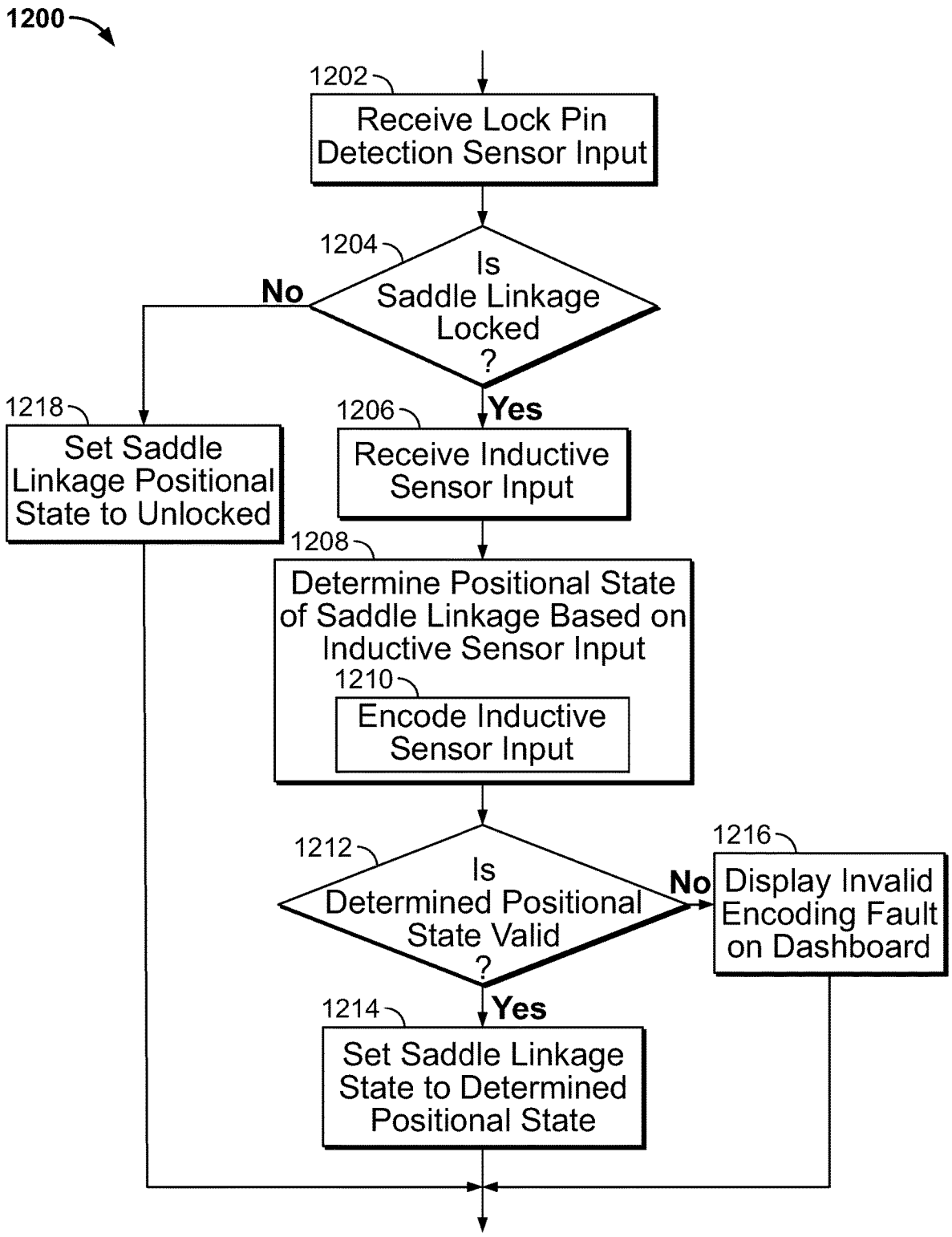
FIG. 12 is a simplified flowchart of a method of operating a motor grader that may be performed by the motor grader control system of FIG. 11.

Referring now to FIG. 12, an illustrative method 1200 of operating the motor grader 100 (i.e., in embodiments in which the motor grader 100 includes the motion measurement system 800) may be embodied as, or otherwise include, a set of instructions that are executable by the control system 1100 to control operation of the motor grader 100 and/or the motion measurement system 800. The method 1200 corresponds to, or is otherwise associated with, performance of the blocks described below in the illustrative sequence of FIG. 12. It should be appreciated, however, that the method 1200 may be performed in one or more sequences different from the illustrative sequence.

The illustrative method 1200 begins with block 1202. In block 1202, the controller 1110 receives the lock detection sensor input provided by the lock pin detection sensor 1102. From the block 1202, the method 1200 subsequently proceeds to block 1204.

In block 1204 of the illustrative method 1200, the controller 1110 determines whether the saddle linkage 150 is locked in one of a plurality of positional states (i.e., whether the lock pin 394 is received by the lock pin aperture 360 and the one of the locking holes 366, 376, 384, 386, 388, 390, 392) based on the lock detection sensor input received in block 1202. If the controller 1110 determines that the saddle linkage 150 is locked in block 1204, the method 1200 subsequently proceeds to block 1206.

In block 1206 of the illustrative method 1200, the controller 1110 receives the sensor input provided by the inductive sensor 910. In the illustrative embodiment, the sensor input provided by the inductive sensor 910 is indicative of the distance between the inductive sensor 910 and one or more of the machined surfaces of the machined surface sets 920A, 920B, 920C, 920D, 920E, 920F, 920G corresponding to the locking holes 366, 384, 386, 388, 390, 392, 376. In some embodiments, the sensor input provided by the inductive sensor 910 may be based on the detection (or lack thereof) of one or more machined surfaces of the machined surface sets 920A, 920B, 920C, 920D, 920E, 920F, 920G. In any case, from block 1206, the method 1200 subsequently proceeds to block 1208.

In block 1208 of the illustrative method 1200, the controller 1110 determines a positional state of the saddle linkage 150 based on the sensor input provided by the inductive sensor 910 in block 1206. To do so, in block 1210, the controller 1110 encodes the sensor input provided by the inductive sensor 910. The inductive sensor 910 provides sensor input based on proximity sensing at each of the seven locking holes 366, 384, 386, 388, 390, 392, 376, as indicated above. Consequently, for each of the seven locking holes 366, 384, 386, 388, 390, 392, 376, the inductive sensor 910 provides sensor input. Therefore, to encode the sensor input in block 1210, the controller 1110 encodes sensor input or data corresponding to each locking hole 366, 384, 386, 388, 390, 392, 376 to determine a positional state of the saddle linkage 150. In some embodiments, each of multiple inductive sensors (e.g., three) may provide sensor input for each of the seven locking holes 366, 384, 386, 388, 390, 392, 376 such that each of the locking holes 366, 384, 386, 388, 390, 392, 376 may be characterized by, or otherwise associated with, a multi-bit data string (e.g., a three-bit data string). In such embodiments, to encode the sensor input in block 1210, the controller 1110 may encode a 3-bit data string corresponding to each locking hole 366, 384, 386, 388, 390, 392, 376 (e.g., the controller 1110 may encode a total of seven 3-bit data strings) to determine a positional state of the saddle linkage 150. In any case, from block 1210, the method 1200 subsequently proceeds to block 1212.

In block 1212 of the illustrative method 1200, the controller 1110 determines whether the positional state of the saddle linkage 150 determined in block 1208 is valid. It should be appreciated that the sensor data encoded in block 1210 may be compared to reference data corresponding to, or otherwise associated with, a discrete positional state of the saddle linkage 150. Based on that comparison, the controller 1110 may determine whether the positional state of the saddle linkage 150 determined in block 1208 is valid. If the controller 1110 determines in block 1212 that the positional state of the saddle linkage 150 determined in step 1208 is valid, the method 1200 subsequently proceeds to block 1214.

In block 1214 of the illustrative method 1200, the controller 1110 sets the positional state of the saddle linkage 150 to the positional state determined in step 1208. In some embodiments, performance of the block 1214 may correspond to, or otherwise be associated with, execution of one iteration of the method 1200 by the controller 1110.

Returning to block 1212, if the controller 1110 determines that the positional state of the saddle linkage 150 determined in step 1208 is not valid, the method 1200 subsequently proceeds to block 1216. In block 1216, the controller 1110 directs a fault to be displayed on the dashboard 1116 (e.g., on the display 1104). The fault, which may be displayed on the display 1104 as "Invalid Encoding," may indicate that the data encoded in block 1210 did not match, or was otherwise inconsistent with, reference data corresponding to the discrete positional states of the saddle linkage 150.

Returning to block 1204, if the controller 1110 determines that the saddle linkage 150 is not locked in one of the plurality of positional states, the method 1200 subsequently proceeds to block 1218. In block 1218, the controller 1110 sets the positional state of the saddle linkage 150 to unlocked.

Figure 13:
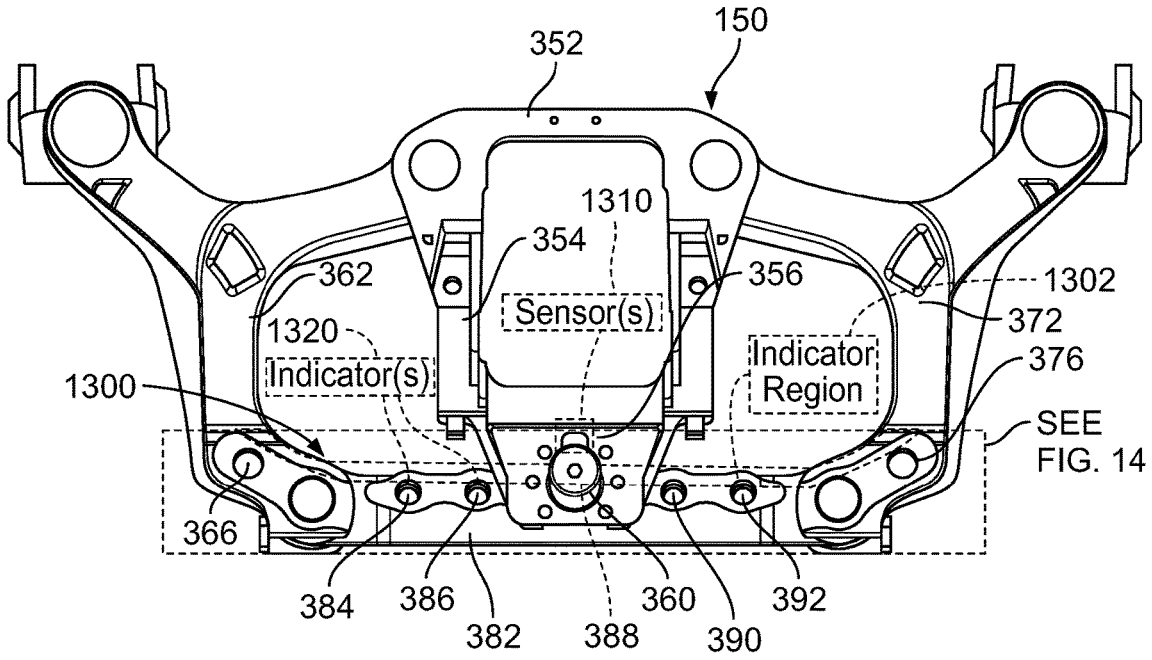
FIG. 13 is an elevation view of the saddle linkage shown in FIG. 3 and another embodiment of a motion measurement system coupled to the saddle linkage.

Referring now to FIG. 13, the saddle linkage 150 is yet again shown with the work implement assembly 120 omitted for the sake of simplicity. In the illustrative embodiment, a motion measurement system 1300 coupled to the saddle linkage 150 is configured to measure movement or position of one or more components of the motor grader 100 in use thereof. The motion measurement system 1300 includes at least one sensor 1310 mounted to the mount 352 in close proximity to the lock pin aperture 360 and at least one indicator 1320 mounted in close proximity to at least one of the locking holes 366, 376, 384, 386, 388, 390, 392, as further discussed below. The at least one sensor 1310 is configured to sense the at least one indicator 1320 and provide sensor input indicative of one or more characteristics of the at least one indicator 1320, as further discussed below. The motion measurement system 1300 also includes a controller 1510 (see FIG. 15) that is coupled to the at least one sensor 1310 and configured to receive the sensor input and determine a positional state of the saddle linkage 150 based on the sensor input, as further discussed below.

In the illustrative embodiment, the at least one sensor 1310 is embodied as, or otherwise includes, at least one light sensor (e.g., a photodetector or photosensor) mounted to the flange 356 and spaced from the lock pin aperture 360. In some embodiments, as further discussed below, the at least one light sensor 1310 is configured to sense light reflected theretoward by the at least one indicator 1320 and provide sensor data indicative of light detection, or lack thereof. In other embodiments, as further discussed below, the at least one light sensor 1310 is configured is detect one or more characteristics (e.g., color) of the at least one indicator 820 and provide sensor data indicative of color-based light detection, or lack thereof. In any case, detection of light by the at least one light sensor 1310 is based on the proximity of the at least one light sensor 1310 to the at least one indicator 1320 such that the detection of the light is indicative of the proximity of the at least one sensor 1310 to the at least one indicator 1820.

In the illustrative embodiment, the at least one indicator 1320 is located in an indicator region 1302 that extends across the crossbar 382 and over a portion of each of the arms 362, 372. The illustrative indicator region 1302 is located on the crossbar 382 above each of the locking holes 384, 386, 388, 390, 392 relative to the ground and on the arms 362, 372 above the respective locking holes 366, 376 relative to the ground such that the indicator region 1302 is in close proximity to each of the locking holes 366, 376, 384, 386, 388, 390, 392. In other embodiments, however, the indicator region 1302 may be formed in another suitable location on each of the crossbar 382, the arm 362, and the arm 372.

In the illustrative embodiment, the at least one indicator 1320 is embodied as, or otherwise includes, at least one optical target located in the indicator region 1302. In some embodiments, the at least one optical target 1320 is configured to reflect light toward the at least one light sensor 1310. In other embodiments, the at least one optical target 1320 is configured to provide one or more colors that may be detected by the at least one light sensor 1310.

Figure 14:
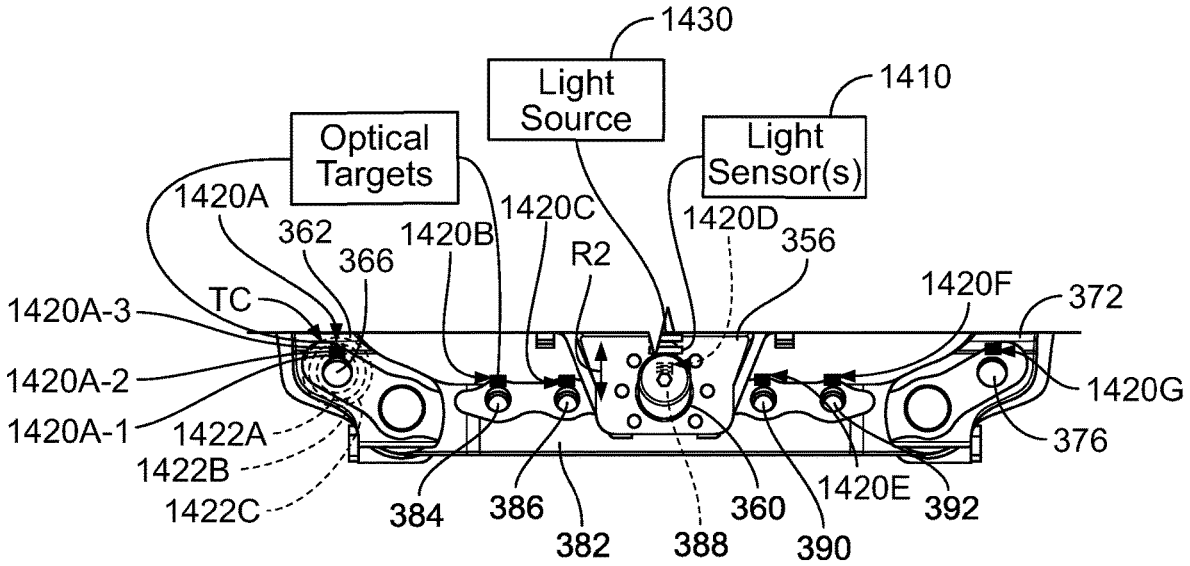
FIG. 14 is a detail view of the saddle linkage and the motion measurement system shown in FIG. 13.

Referring now to FIG. 14, the at least one light sensor 1310 illustratively includes one light sensor 1410. In the illustrative embodiment, the light sensor 1410 is mounted to the flange 356 and spaced from the lock pin aperture 360 in a radial direction R2. The sensor 1410 is illustratively arranged radially outward of the lock pin aperture 360 on the flange 356. Of course, in other embodiments, the sensor 1410 may have another suitable arrangement relative to the lock pin aperture 360 on the flange 356. Additionally, in other embodiments, the at least one light sensor 1310 may include multiple light sensors, such as three light sensors, for example. In such embodiments, the multiple light sensors may be radially spaced from one another and the lock pin aperture 360 such that the sensors form a sensor column in similar fashion to the sensor column SC formed by the sensors 510A, 510B, 510C. Furthermore, in such embodiments, the multiple light sensors may have, correspond to, or otherwise be associated with, respective sensing zones similar to the sensing zones 512A, 512B, 512C.

The at least one optical target 1320 illustratively includes optical target sets 1420A, 1420B, 1420C, 1420D, 1420E, 1420F, 1420G. The illustrative optical target sets 1420A, 1420B, 1420C, 1420D, 1420E, 1420F, 1420G correspond to, and are located in close proximity to, respective locking holes 366, 384, 386, 388, 390, 392, 376. In the illustrative embodiment, each of the optical target sets 1420A, 1420B, 1420C, 1420D, 1420E, 1420F, 1420G includes three optical targets. Because the optical target sets 1420A, 1420B, 1420C, 1420D, 1420E, 1420F, 1420G are identical to one another, only one optical target set (i.e., optical target set 1420A) is discussed below. Of course, in other embodiments, the at least one optical target 1320 may include another suitable number of optical targets, and, presuming inclusion of the optical target sets 1420A, 1420B, 1420C, 1420D, 1420E, 1420F, 1420G, each optical target set may include another suitable number of optical targets.

The illustrative optical target set 1420A includes optical targets 1420A-1, 1420A-2, 1420A-3. In the illustrative embodiment, the optical targets 1420A-1, 1420A-2, 1420A-3 are radially spaced from one another and the locking hole 366 such that the optical targets 1420A-1, 1420A-2, 1420A-3 form a target column TC. The optical targets 1420A-1, 1420A-2, 1420A-3 are illustratively arranged radially outward of the locking hole 366 on the arm 362. Of course, in other embodiments, the optical targets 1420A-1, 1420A-2, 1420A-3 may have another suitable arrangement relative to one another and the locking hole 366 on the arm 362.

In some embodiments, the optical targets 1420A-1, 1420A-2, 1420A-3 may have, correspond to, or otherwise be associated with, respective indicating zones 1422A, 1422B, 1422C that may be sensed by the light sensor 1410. In such embodiments, the indicating zones 1422A, 1422B, 1422C may be similar to the indicating zones 522A, 522B, 522C. Of course, in other embodiments, the optical targets 1420A-1, 1420A-2, 1420A-3 may have, correspond to, or otherwise be associated with, other suitable indicating zones. Furthermore, in other embodiments, the optical targets 1420A-1, 1420A-2, 1420A-3 may not have, or be associated with, indicating zones.

In some embodiments, each of the optical target sets 1420A, 1420B, 1420C, 1420D, 1420E, 1420F, 1420G may include, or otherwise be embodied as, three reflectors. Each reflector may be configured to reflect light toward the light sensor 1410 so that the light may be detected by the light sensor 1410. In other embodiments, each of the optical target sets 1420A, 1420B, 1420C, 1420D, 1420E, 1420F, 1420G may include, or otherwise be embodied as, three markers. Each marker may be configured to provide a particular color and/or hue that may be detected by the light sensor 1410.

In the illustrative embodiment, the motion measurement system 1300 includes a light source 1430 that is located in close proximity to the light sensor 1410 and the lock pin aperture 360. The light source 1430 may be embodied as, or otherwise include, any device capable of producing light that may be reflected by the optical target sets 1420A, 1420B, 1420C, 1420D, 1420E, 1420F, 1420G toward the light sensor 1410, at least in some embodiments (e.g., where the optical targets include reflectors). In other embodiments (e.g., where the optical targets include markers), the light source 1430 may be configured to provide light to illuminate the optical target sets 1420A, 1420B, 1420C, 1420D, 1420E, 1420F, 1420G to facilitate detection thereof by the light sensor 1410. In any case, the illustrative light source 1430 is mounted to the flange 356 such that the light source 1430 is spaced from the light sensor 1410 and the lock pin aperture 360. Of course, in other embodiments, the light source 1430 may have another suitable arrangement relative to the light sensor 1410 and the lock pin aperture 360 on the flange 356.

Figure 15:
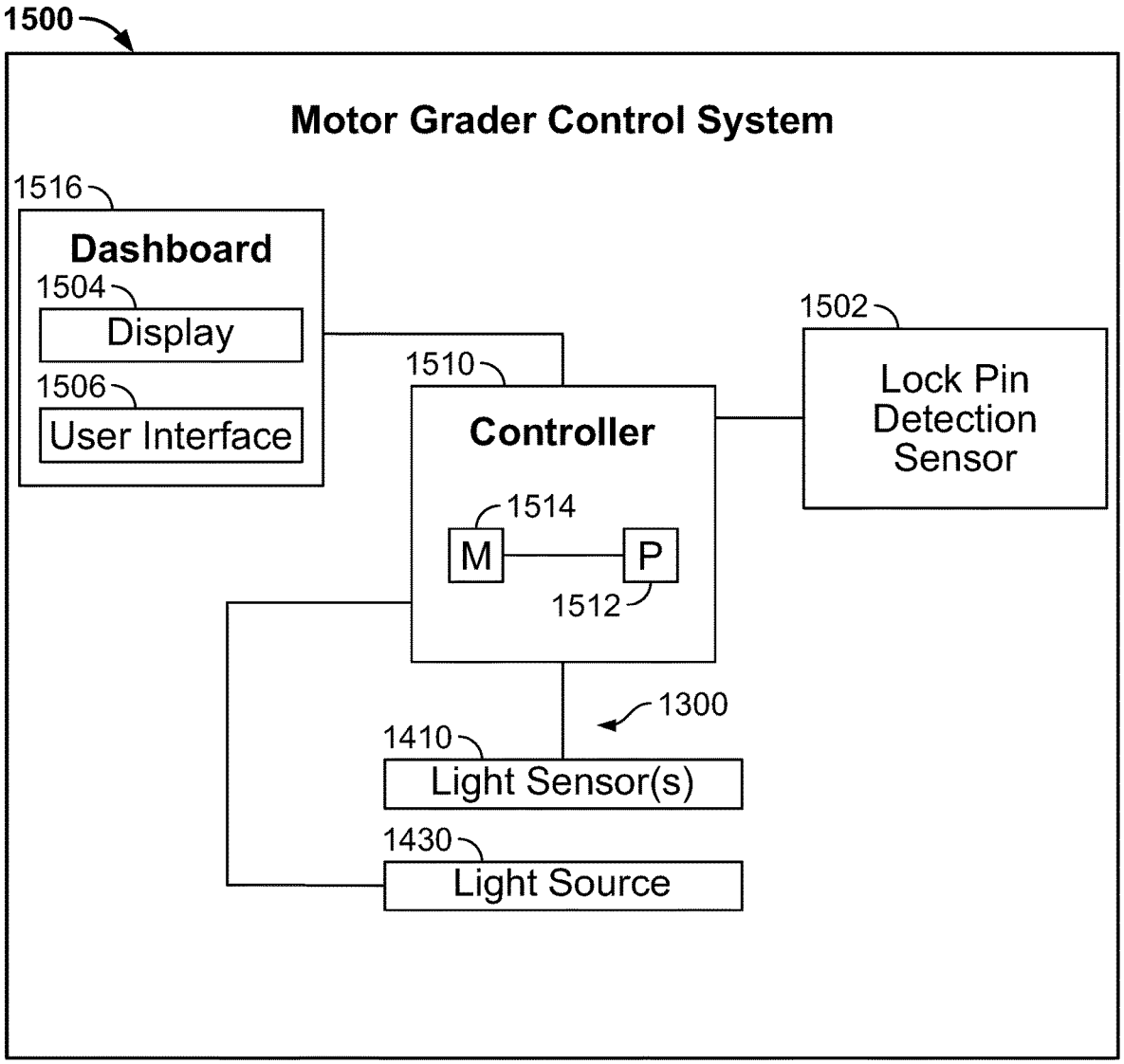
FIG. 15 is a diagrammatic view of a motor grader control system adapted for use with the motion measurement system shown in FIG. 13.

Referring now to FIG. 15, an illustrative control system 1500, which may be used to control operation of some components of the motor grader 100 in some embodiments, includes, is coupled to, or is otherwise adapted for use with, the motion measurement system 1300. As such, for ease of discussion, the control system 1500 is shown to include the controller 1510 and the light sensor 1410 coupled thereto, as well as the light source 1430 which may be coupled to the controller 1510. The controller 1510 illustratively includes a processor 1512 and a memory device 1514 coupled to the processor 1512.

The processor 1512 may be embodied as, or otherwise include, any type of processor, controller, or other compute circuit capable of performing various tasks such as compute functions and/or controlling the functions of the motor grader 100 and/or the motion measurement system 1300. For example, the processor 1512 may be embodied as a single or multi-core processor(s), a microcontroller, or other processor or processing/controlling circuit. In some embodiments, the processor 1512 may be embodied as, include, or be coupled to an FPGA, an application specific integrated circuit (ASIC), reconfigurable hardware or hardware circuitry, or other specialized hardware to facilitate performance of the functions described herein. Additionally, in some embodiments, the processor 1512 may be embodied as, or otherwise include, a high-power processor, an accelerator co-processor, or a storage controller. In some embodiments still, the processor 1512 may include more than one processor, controller, or compute circuit.

The memory device 1514 may be embodied as any type of volatile (e.g., dynamic random access memory (DRAM), etc.) or non-volatile memory capable of storing data therein. Volatile memory may be embodied as a storage medium that requires power to maintain the state of data stored by the medium. Non-limiting examples of volatile memory may include various types of random access memory (RAM), such as dynamic random access memory (DRAM) or static random access memory (SRAM). One particular type of DRAM that may be used in a memory module is synchronous dynamic random access memory (SDRAM). In particular embodiments, DRAM of a memory component may comply with a standard promulgated by JEDEC, such as JESD79F for DDR SDRAM, JESD79-2F for DDR2 SDRAM, JESD79-3F for DDR3 SDRAM, JESD79-4A for DDR4 SDRAM, JESD209 for Low Power DDR (LPDDR), JESD209-2 for LPDDR2, JESD209-3 for LPDDR3, and JESD209-4 for LPDDR4 (these standards are available at www.jedec.org). Such standards (and similar standards) may be referred to as DDR-based standards and communication interfaces of the storage devices that implement such standards may be referred to as DDR-based interfaces.

In some embodiments, the memory device 1514 may be embodied as a block addressable memory, such as those based on NAND or NOR technologies. The memory device 1514 may also include future generation nonvolatile devices, such as a three dimensional crosspoint memory device (e.g., Intel 3D XPoint™ memory), or other byte addressable write-in-place nonvolatile memory devices. In some embodiments, the memory device 1514 may be embodied as, or may otherwise include, chalcogenide glass, multi-threshold level NAND flash memory, NOR flash memory, single or multi-level Phase Change Memory (PCM), a resistive memory, nanowire memory, ferroelectric transistor random access memory (FeTRAM), anti-ferroelectric memory, magnetoresistive random access memory (MRAM) memory that incorporates memristor technology, resistive memory including the metal oxide base, the oxygen vacancy base and the conductive bridge Random Access Memory (CB-RAM), or spin transfer torque (STT)-MRAM, a spintronic magnetic junction memory based device, a magnetic tunneling junction (MTJ) based device, a DW (Domain Wall) and SOT (Spin Orbit Transfer) based device, a thyristor based memory device, or a combination of any of the above, or other memory. The memory device may refer to the die itself and/or to a packaged memory product. In some embodiments, 3D crosspoint memory (e.g., Intel 3D XPoint™ memory) may comprise a transistor-less stackable cross point architecture in which memory cells sit at the intersection of word lines and bit lines and are individually addressable and in which bit storage is based on a change in bulk resistance.

The illustrative control system 1500 includes a lock pin detection sensor 1502 coupled to the controller 1510 that is substantially identical to the lock pin detection sensor 602. In some embodiments, the lock pin detection sensor 602 may be included in the motion measurement system 1300. The illustrative control system 1500 also includes a dashboard 1516 that is coupled to the controller 1510 and has a display 1504 and a user interface 1506. The dashboard 1516 is substantially identical to the dashboard 116, and as such, the display 1504 and the user interface 1506 are substantially identical to the display 604 and the user interface 606, respectively.

Of course, it should be appreciated that the control system 1500 may include components in addition to, and/or in lieu of, the components depicted in FIG. 15. However, for the sake of simplicity, discussion of those additional and/or alternative components is omitted.

Figure 16:
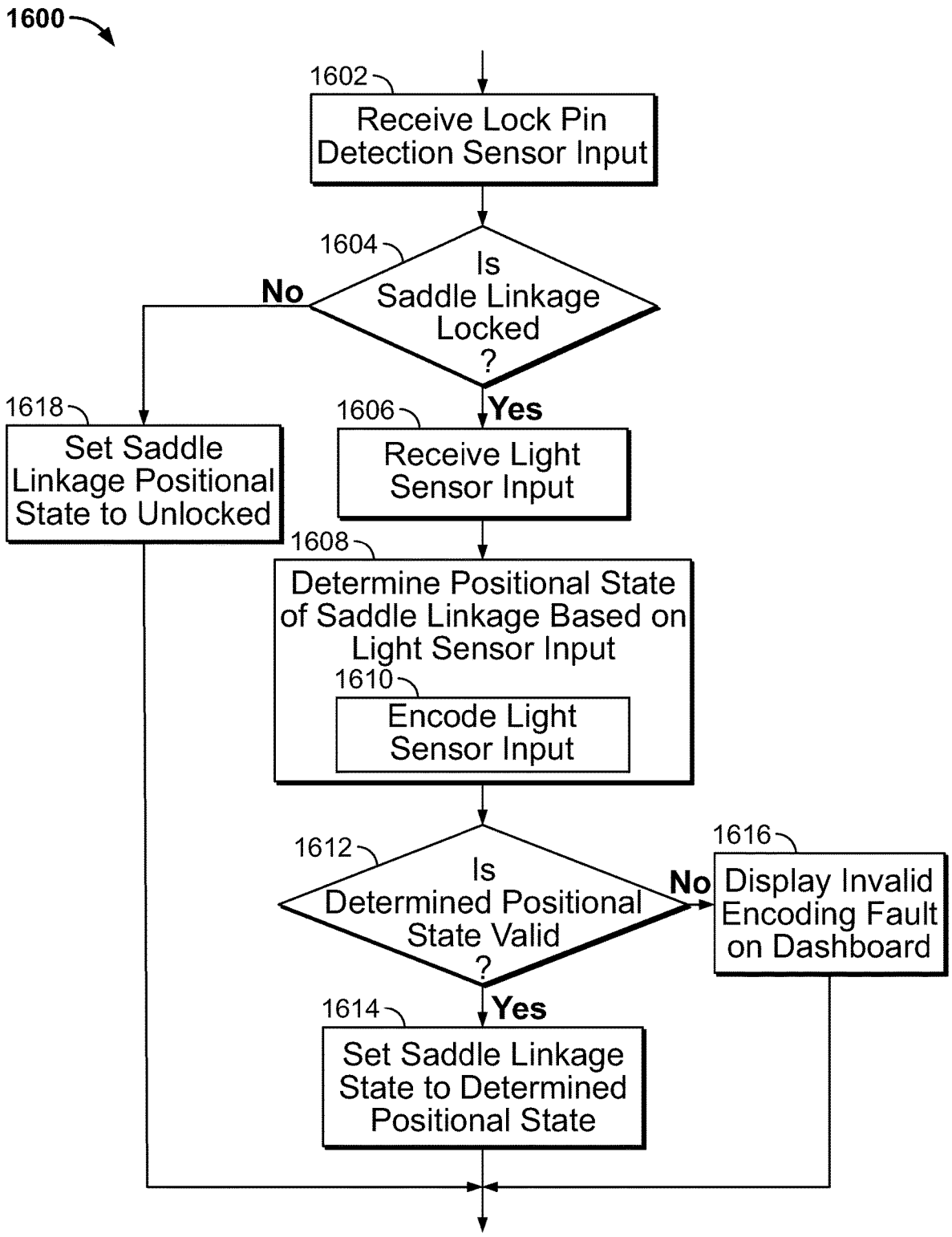
FIG. 16 is a simplified flowchart of a method of operating a motor grader that may be performed by the motor grader control system of FIG. 15.

Referring now to FIG. 16, an illustrative method 1600 of operating the motor grader 100 (i.e., in embodiments in which the motor grader 100 includes the motion measurement system 1300) may be embodied as, or otherwise include, a set of instructions that are executable by the control system 1500 to control operation of the motor grader 100 and/or the motion measurement system 1300. The method 1600 corresponds to, or is otherwise associated with, performance of the blocks described below in the illustrative sequence of FIG. 16. It should be appreciated, however, that the method 1600 may be performed in one or more sequences different from the illustrative sequence.

The illustrative method 1600 begins with block 1602. In block 1602, the controller 1510 receives the lock detection sensor input provided by the lock pin detection sensor 1502. From the block 1602, the method 1600 subsequently proceeds to block 1604.

In block 1604 of the illustrative method 1600, the controller 1510 determines whether the saddle linkage 150 is locked in one of a plurality of positional states (i.e., whether the lock pin 394 is received by the lock pin aperture 360 and the one of the locking holes 366, 376, 384, 386, 388, 390, 392) based on the lock detection sensor input received in block 1602. If the controller 1510 determines that the saddle linkage 150 is locked in block 1604, the method 1600 subsequently proceeds to block 1606.

In block 1606 of the illustrative method 1600, the controller 1510 receives the sensor input provided by the light sensor 1410. In the illustrative embodiment, the sensor input provided by the light sensor 1410 is indicative of the proximity of the light sensor 1410 to one or more optical targets of the optical target sets 1420A, 1420B, 1420C, 1420D, 1420E, 1420F, 1420G corresponding to the locking holes 366, 384, 386, 388, 390, 392, 376. From block 1606, the method 1600 subsequently proceeds to block 1608.

In block 1608 of the illustrative method 1600, the controller 1510 determines a positional state of the saddle linkage 150 based on the sensor input provided by the light sensor 1410 in block 1606. To do so, in block 1610, the controller 1510 encodes the sensor input provided by the light sensor 1410. The light sensor 1410 provides sensor input based on light proximity sensing at each of the seven locking holes 366, 384, 386, 388, 390, 392, 376, as indicated above. Consequently, for each of the seven locking holes 366, 384, 386, 388, 390, 392, 376, the light sensor 1410 provides sensor input. Therefore, to encode the sensor input in block 1610, the controller 1510 encodes sensor input or data corresponding to each locking hole 366, 384, 386, 388, 390, 392, 376 to determine a positional state of the saddle linkage 150. In some embodiments, each of multiple light sensors (e.g., three) may provide sensor input for each of the seven locking holes 366, 384, 386, 388, 390, 392, 376 such that each of the locking holes 366, 384, 386, 388, 390, 392, 376 may be characterized by, or otherwise associated with, a multi-bit data string (e.g., a three-bit data string). In such embodiments, to encode the sensor input in block 1610, the controller 1510 may encode a 3-bit data string corresponding to each locking hole 366, 384, 386, 388, 390, 392, 376 (e.g., the controller 1510 may encode a total of seven 3-bit data strings) to determine a positional state of the saddle linkage 150. In any case, from block 1610, the method 1600 subsequently proceeds to block 1612.

In block 1612 of the illustrative method 1600, the controller 1510 determines whether the positional state of the saddle linkage 150 determined in block 1608 is valid. It should be appreciated that the sensor data encoded in block 1610 may be compared to reference data corresponding to, or otherwise associated with, a discrete positional state of the saddle linkage 150. Based on that comparison, the controller 1510 may determine whether the positional state of the saddle linkage 150 determined in block 1608 is valid. If the controller 1510 determines in block 1612 that the positional state of the saddle linkage 150 determined in step 1608 is valid, the method 1600 subsequently proceeds to block 1614.

In block 1614 of the illustrative method 1600, the controller 1510 sets the positional state of the saddle linkage 150 to the positional state determined in step 1608. In some embodiments, performance of the block 1614 may correspond to, or otherwise be associated with, execution of one iteration of the method 1600 by the controller 1610.

Returning to block 1612, if the controller 1510 determines that the positional state of the saddle linkage 150 determined in step 1608 is not valid, the method 1600 subsequently proceeds to block 1616. In block 1616, the controller 1510 directs a fault to be displayed on the dashboard 1616 (e.g., on the display 1604). The fault, which may be displayed on the display 1604 as "Invalid Encoding," may indicate that the data encoded in block 1610 did not match, or was otherwise inconsistent with, reference data corresponding to the discrete positional states of the saddle linkage 150.

Returning to block 1604, if the controller 1510 determines that the saddle linkage 150 is not locked in one of the plurality of positional states, the method 1600 subsequently proceeds to block 1618. In block 1618, the controller 1510 sets the positional state of the saddle linkage 150 to unlocked.

Figure 17:
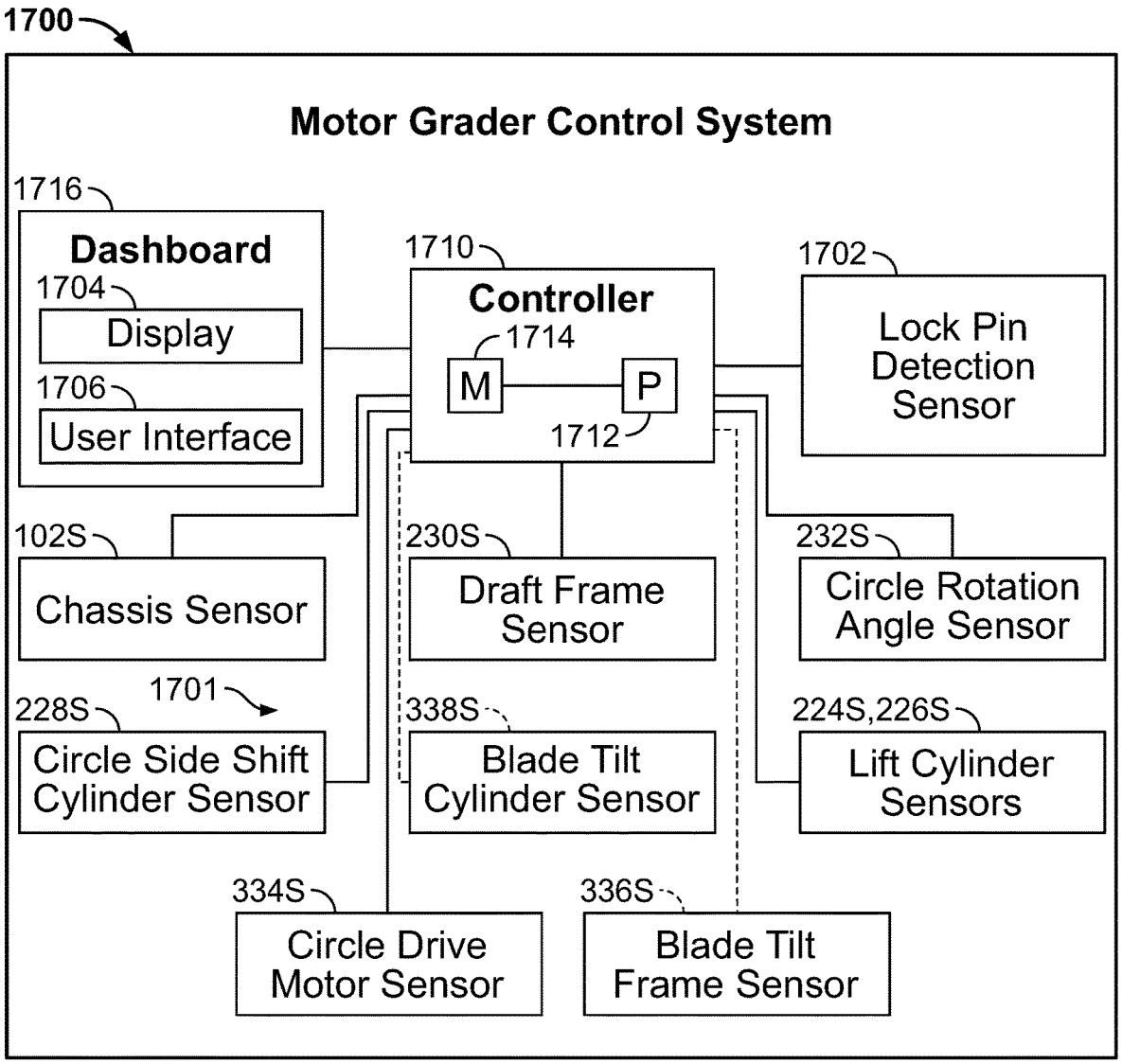
FIG. 17 is a diagrammatic view of a motor grader control system adapted for use with the motor grader of FIG. 1 that includes another embodiment of a motion measurement system.

Referring now to FIG. 17, an illustrative control system 1700, which may be used to control operation of some components of the motor grader 100 in some embodiments, includes, is coupled to, or is otherwise adapted for use with, a motion measurement system 1701. The motion measurement system 1701 is configured to measure movement of one or more components of the grader 100 in use thereof. The illustrative motion measurement system 1701 includes the chassis sensor 102S, the lift cylinder sensors 224S, 226S, the circle side shift cylinder sensor 228S, the draft frame sensor 230S, the circle rotation angle sensor 232S, the circle drive motor sensor 334S, a controller 1710, and a lock pin detection sensor 1702. Each of the sensors 102S, 224S, 226S, 228S, 230S, 232S, 334S, 338S, 1702 is coupled to the controller 1710. In some embodiments, the motion measurement system 1701 may include the blade tilt frame sensor 336S and the blade tilt cylinder sensor 338S, which may be coupled to the controller 1710. In such embodiments, the draft frame sensor 230S may be omitted from the system 1701. As described in greater detail below with reference to FIG. 18, at least in some embodiments, the controller 1710 is configured to establish an orientation of the draft frame 230 relative to the front chassis 102 based at least partially on the draft frame sensor input provided by the draft frame sensor 230S and the chassis sensor input provided by the chassis sensor 102S and determine operational kinematics of the draft frame 230 relative to the front chassis 102 based at least partially on the lift cylinder sensor input provided by the lift cylinder sensors 224S, 226S and the circle side shift cylinder input provided by the circle side shift cylinder sensor 228S. In any case, the controller 1710 illustratively includes a processor 1712 and a memory device 1714 coupled to the processor 1712.

The processor 1712 may be embodied as, or otherwise include, any type of processor, controller, or other compute circuit capable of performing various tasks such as compute functions and/or controlling the functions of the motor grader 100 and/or the motion measurement system 1701. For example, the processor 1712 may be embodied as a single or multi-core processor(s), a microcontroller, or other processor or processing/controlling circuit. In some embodiments, the processor 1712 may be embodied as, include, or be coupled to an FPGA, an application specific integrated circuit (ASIC), reconfigurable hardware or hardware circuitry, or other specialized hardware to facilitate performance of the functions described herein. Additionally, in some embodiments, the processor 1712 may be embodied as, or otherwise include, a high-power processor, an accelerator co-processor, or a storage controller. In some embodiments still, the processor 1712 may include more than one processor, controller, or compute circuit.

The memory device 1714 may be embodied as any type of volatile (e.g., dynamic random access memory (DRAM), etc.) or non-volatile memory capable of storing data therein. Volatile memory may be embodied as a storage medium that requires power to maintain the state of data stored by the medium. Non-limiting examples of volatile memory may include various types of random access memory (RAM), such as dynamic random access memory (DRAM) or static random access memory (SRAM). One particular type of DRAM that may be used in a memory module is synchronous dynamic random access memory (SDRAM). In particular embodiments, DRAM of a memory component may comply with a standard promulgated by JEDEC, such as JESD79F for DDR SDRAM, JESD79-2F for DDR2 SDRAM, JESD79-3F for DDR3 SDRAM, JESD79-4A for DDR4 SDRAM, JESD209 for Low Power DDR (LPDDR), JESD209-2 for LPDDR2, JESD209-3 for LPDDR3, and JESD209-4 for LPDDR4 (these standards are available at www.jedec.org). Such standards (and similar standards) may be referred to as DDR-based standards and communication interfaces of the storage devices that implement such standards may be referred to as DDR-based interfaces.

In some embodiments, the memory device 1714 may be embodied as a block addressable memory, such as those based on NAND or NOR technologies. The memory device 1714 may also include future generation nonvolatile devices, such as a three dimensional crosspoint memory device (e.g., Intel 3D XPoint™ memory), or other byte addressable write-in-place nonvolatile memory devices. In some embodiments, the memory device 1714 may be embodied as, or may otherwise include, chalcogenide glass, multi-threshold level NAND flash memory, NOR flash memory, single or multi-level Phase Change Memory (PCM), a resistive memory, nanowire memory, ferroelectric transistor random access memory (FeTRAM), anti-ferroelectric memory, magnetoresistive random access memory (MRAM) memory that incorporates memristor technology, resistive memory including the metal oxide base, the oxygen vacancy base and the conductive bridge Random Access Memory (CB-RAM), or spin transfer torque (STT)-MRAM, a spintronic magnetic junction memory based device, a magnetic tunneling junction (MTJ) based device, a DW (Domain Wall) and SOT (Spin Orbit Transfer) based device, a thyristor based memory device, or a combination of any of the above, or other memory. The memory device may refer to the die itself and/or to a packaged memory product. In some embodiments, 3D crosspoint memory (e.g., Intel 3D XPoint™ memory) may comprise a transistor-less stackable cross point architecture in which memory cells sit at the intersection of word lines and bit lines and are individually addressable and in which bit storage is based on a change in bulk resistance.

The lock pin detection sensor 1702 is substantially identical to the lock pin detection sensor 602. The illustrative control system 1700 also includes a dashboard 1716 that is coupled to the controller 1710 and has a display 1704 and a user interface 1706. The dashboard 1716 is substantially identical to the dashboard 116, and as such, the display 1704 and the user interface 1706 are substantially identical to the display 604 and the user interface 606, respectively.

Of course, it should be appreciated that the control system 1700 may include components in addition to, and/or in lieu of, the components depicted in FIG. 17. However, for the sake of simplicity, discussion of those additional and/or alternative components is omitted.

Figure 18:
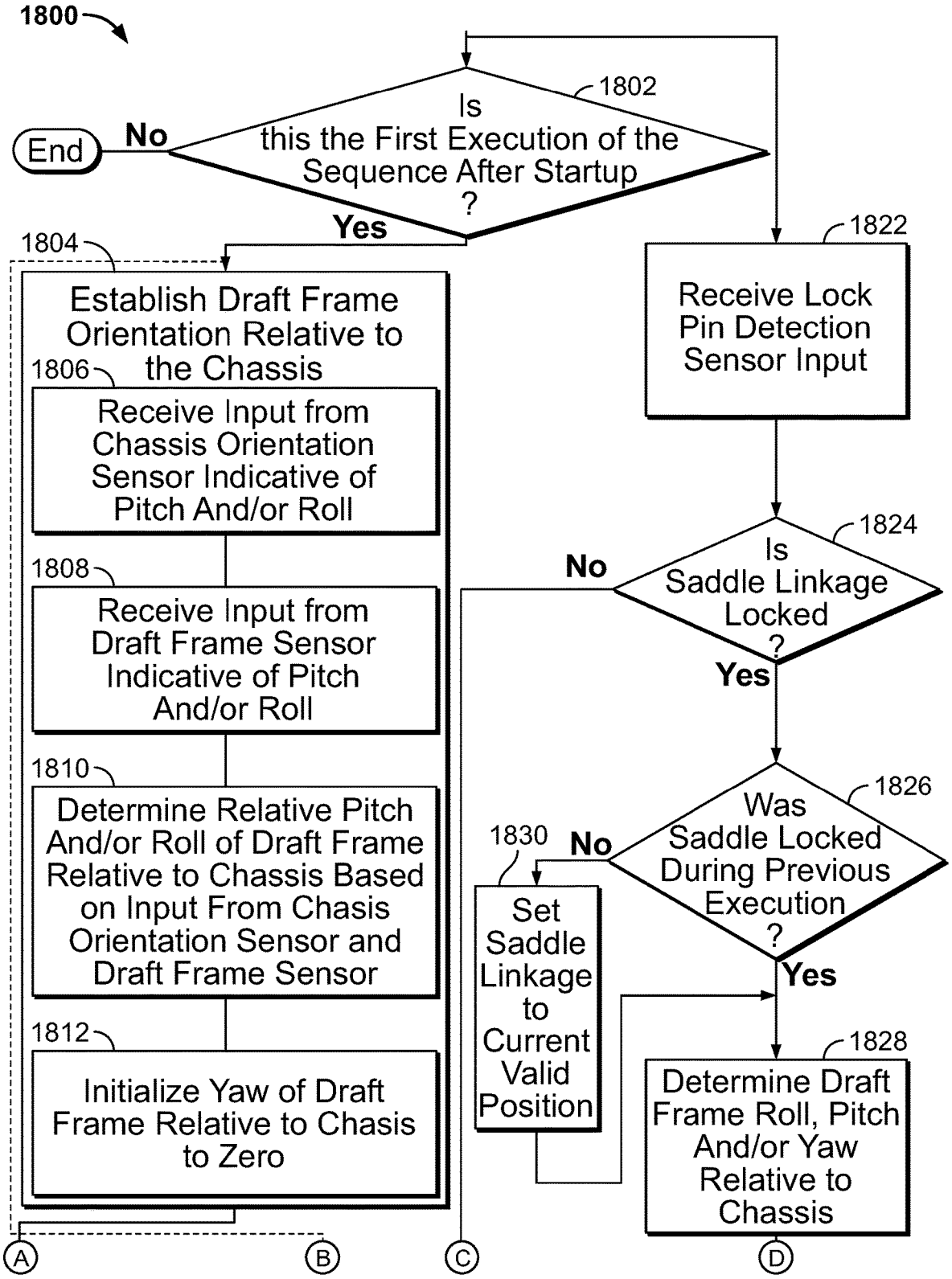
FIG. 18 is a simplified flowchart of a method of operating a motor grader that may be performed by the motor grader control system of FIG. 17.
Figure 18:
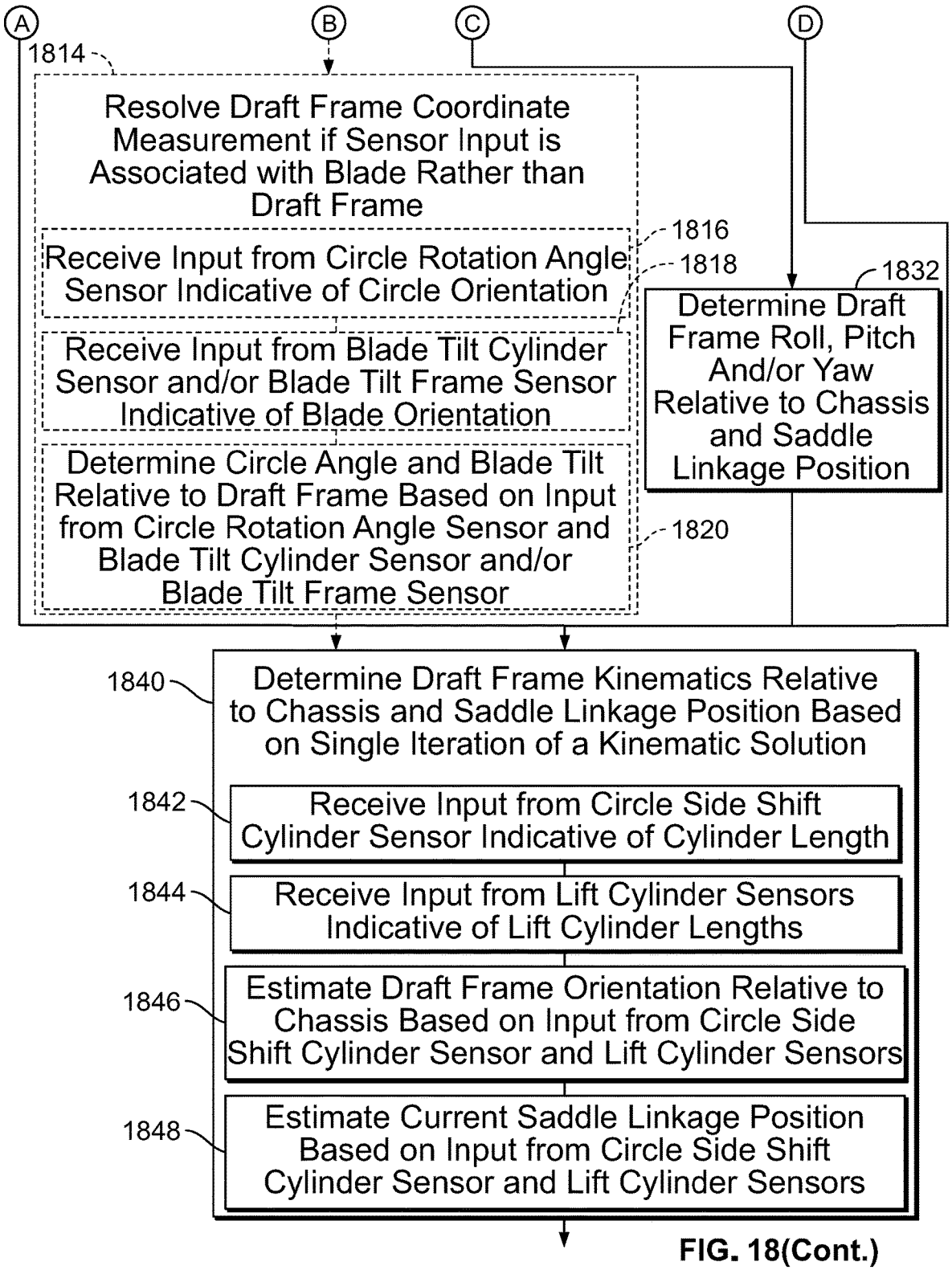

Referring now to FIG. 18, an illustrative method 1800 of operating the motor grader 100 (i.e., in embodiments in which the motor grader 100 includes the motion measurement system 1701) may be embodied as, or otherwise include, a set of instructions that are executable by the control system 1700 to control operation of the motor grader 100 and/or the motion measurement system 1701. The method 1800 corresponds to, or is otherwise associated with, performance of the blocks described below in the illustrative sequence of FIG. 18. It should be appreciated, however, that the method 1800 may be performed in one or more sequences different from the illustrative sequence. Furthermore, it should be appreciated that some blocks of the method 1800 may be performed contemporaneously and/or in parallel with one another, and that some of the blocks may be omitted from the method 1800, at least in some embodiments.

In some embodiments, the method 1800 may begin with one of either block 1802 or block 1822. Presuming a determination by the controller 1710 that the execution of the method 1800 is the first execution thereof following startup of the motor grader 100 (i.e., in block 1802 as discussed below), the controller 1710 executes the method 1800 to determine operational kinematics of the draft frame 230 relative to the front chassis 102 and the positional state of the saddle linkage 150 based on a single iteration of a kinematic solution (i.e., in block 1840 as discussed below) regardless of whether the method 1800 begins with block 1802 or 1822. Accordingly, at least in some embodiments, the method 1800 may be intended to generate, and may be resolved upon the determination of, a single iteration of a kinematic solution for expressing the operational kinematics of the draft frame 230 relative to the front chassis 102 and the positional state of the saddle linkage 150.

In block 1802, the controller 1710 determines whether the execution of the method 1800 is the first execution thereof following startup of the motor grader 100. If the controller 1710 determines in block 1802 that the execution of the method 1800 is the first execution thereof following startup, the method 1800 may subsequently proceed to block 1804, at least in some embodiments.

In block 1804 of the illustrative method 1800, the controller 1710 establishes an orientation of the draft frame 230 relative to the front chassis 102. It should be appreciated that inclusion of block 1804 in the method 1800 is dependent upon whether the system 1701 is configured to measure (e.g., via the one or more draft frame sensors 230S) one or more characteristics (e.g., roll, pitch, and/or yaw) of the draft frame 230 in use of the grader 100. Depiction of the block 1804 in solid in FIG. 18 presumes that the system 1701 is configured to measure one or more operational characteristics of the draft frame 230 via the one or more draft frame sensors 230S. In any case, to perform block 1804, the controller 1710 performs blocks 1806, 1808, 1810, 1812. In block 1806, the controller 1710 receives chassis sensor input from the chassis sensor 102S indicative of one or more operational characteristics (e.g., roll, pitch, and/or yaw) of the front chassis 102. In block 1808, the controller 1710 receives draft frame sensor input from the one or more draft sensors 230S indicative of one or more operational characteristics of the draft frame 230. In block 1810, the controller 1710 determines one or more characteristics of movement and/or position (e.g., pitch and/or roll) of the draft frame 230 relative to the front chassis 102 based on the chassis sensor input and the draft frame sensor input. In block 1812, the controller 1710 initializes at least one characteristic of movement and/or position (i.e., yaw) of the draft frame 230 relative to the front chassis 102 to zero. From block 1812, the method 1800 subsequently proceeds to block 1840.

Returning to block 1802, if the controller 1710 determines in block 1802 that the execution of the method 1800 is the first execution thereof following startup, the method 1800 may subsequently proceed to block 1814, at least in some embodiments. Regardless of whether the method 1800 proceeds to block 1804 or block 1814, it should again be appreciated that, at least in some embodiments, the method 1800 may be intended to generate, and may be resolved upon the determination of, a single iteration of a kinematic solution for expressing the operational kinematics of the draft frame 230 relative to the front chassis 102 and the positional state of the saddle linkage 150. In block 1814, the controller 1710 resolves coordinate measurement of the draft frame 230. It should be appreciated that inclusion of block 1814 in the method 1800 presumes that the system 1701 is configured to measure one or more operational characteristics of the blade tilt frame 336 and/or the blade tilt cylinder 338 via the one or more tilt frame sensors 336S or the one or more tilt cylinder sensors 338S without measurement of one or more operational characteristics of the draft frame 230 (e.g., via the one or more draft frame sensors 230S) in use of the grader 100. Therefore, block 1814 is performed based on the presumption that the system 1701 receives sensor input associated with the blade tilt frame 336 and/or the blade tilt cylinder 338 rather than sensor input associated with the draft frame 230. In any case, to perform block 1814, the controller 1710 performs blocks 1816, 1818, and 1820. In block 1816, the controller 1710 receives circle rotation angle input from the circle angle rotation sensor 232S indicative of an orientation of the circle frame 232. In block 1818, the controller 1710 receives blade tilt frame input from the sensor 336S and/or blade tilt cylinder input from the sensor 338S indicative of an orientation of the blade 122. In block 1820, the controller 1710 determines the orientation of the circle frame 232 (e.g., a rotation angle of the circle frame 232 relative to the draft frame 230) and an orientation of the blade 122 (e.g., a tilt of the blade 122 relative to the draft frame 230) based on the circle rotation angle input, the blade tilt frame input, and/or the blade tilt cylinder input. From block 1820, the method 1800 subsequently proceeds to block 1840.

As mentioned above, the illustrative method 1800 may begin with one of either block 1802 or block 1822. In block 1822, the controller 1710 receives the lock detection sensor input provided by the lock pin detection sensor 1702. From the block 1822, the method 1800 subsequently proceeds to block 1824.

In block 1824 of the illustrative method 1800, the controller 1710 determines whether the saddle linkage 150 is locked in one of a plurality of positional states (i.e., whether the lock pin 394 is received by the lock pin aperture 360 and the one of the locking holes 366, 376, 384, 386, 388, 390, 392) based on the lock pin detection sensor input received in block 1822. If the controller 1710 determines that the saddle linkage 150 is locked in one of the positional states, the method 1800 subsequently proceeds to block 1826.

In block 1826 of the illustrative method 1800, the controller 1710 determines whether the saddle linkage 150 was locked in one of the positional states during a previous execution of the method 1800 (e.g., an execution of the method 1800 prior to startup). If the controller 1710 determines that the saddle linkage 150 was locked in one of the positional states during a previous execution, the method 1800 subsequently proceeds to block 1828.

In block 1828 of the illustrative method 1800, the controller 1710 determines operational characteristics (e.g., roll, pitch, and/or yaw) of the draft frame 230 relative to the front chassis 102. From block 1828, the method 1800 subsequently proceeds to block 1840.

Returning to block 1826 of the illustrative method 1800, if the controller 1710 determines that the saddle linkage 150 was not locked in one of the positional states during a previous execution in block 1826, the method 1800 subsequently proceeds to block 1830. In block 1830, the controller 1710 sets the saddle linkage 150 to its current valid position. That is, in block 1830, the controller 1710 sets the saddle linkage 150 position (e.g., in the memory device 1714) based on the current position of the saddle linkage 150 as that position is defined by, or otherwise associated with, positioning of the lock pin 394 in one of the locking holes 366, 376, 384, 386, 388, 390, 392. From block 1830, the method 1800 subsequently proceeds to block 1828.

Returning to block 1824 of the illustrative method 1800, if the controller 1710 determines that the saddle linkage 150 is not locked in one of the positional states in block 1824, the method 1800 subsequently proceeds to block 1832. In block 1832, the controller 1710 determines operational characteristics (e.g., roll, pitch, and/or yaw) of the draft frame 230 relative to the front chassis 102 and the positional state of the saddle linkage 150. From block 1832, the method 1800 subsequently proceeds to block 1840.

In block 1840 of the illustrative method 1800, the controller 1710 determines the operational kinematics of the draft frame 230 relative to the front chassis 102 and the positional state of the saddle linkage 150 based on a single iteration of a kinematic solution. To do so, the controller 1710 performs blocks 1842, 1844, 1846, and 1848. In block 1842, the controller 1710 receives circle side shift cylinder sensor input provided by the sensor 228S that is indicative of one or more lengths of the circle side shift cylinder 228. In block 1844, the controller 1710 receives lift cylinder sensor input provided by the lift cylinders 224S, 226S that is indicative of one or more lengths of the respective lift cylinders 224, 226. In block 1846, the controller 1710 determines an estimate of one or more characteristics of movement and/or position (e.g., roll, pitch, and/or yaw) of the draft frame 230 relative to the front chassis 102 based on the circle side shift cylinder input and the lift cylinder input. In block 1848, the controller 1710 determines an estimate of a positional state of the saddle linkage 150 based on the circle side shift cylinder input and the lift cylinder input. In some embodiments, performance of the block 1840 may correspond to, or otherwise be associated with, execution of one iteration of the method 1800, as well as one iteration of the kinematic solution, by the controller 1710.

Returning to block 1802 of the illustrative method 1800, if the controller 1710 determines that the execution of the method 1800 is not the first execution thereof following startup in block 1802, the method 1800 ends. Of course, it should be appreciated that in at least some embodiments, if the controller 1710 determines that that the execution of the method 1800 is not the first execution thereof following startup in block 1802, the method 1800 may restart from the beginning. In any case, it should be appreciated that the illustrative method 1800 may be intended to generate, and may be resolved upon the determination of, a single iteration of a kinematic solution for expressing the operational kinematics of the draft frame 230 relative to the front chassis 102 and the positional state of the saddle linkage 150 in the event that the controller 1710 determines that the execution of the method 1800 is the first execution thereof following startup in block 1802, as indicated above.

Figure 19:
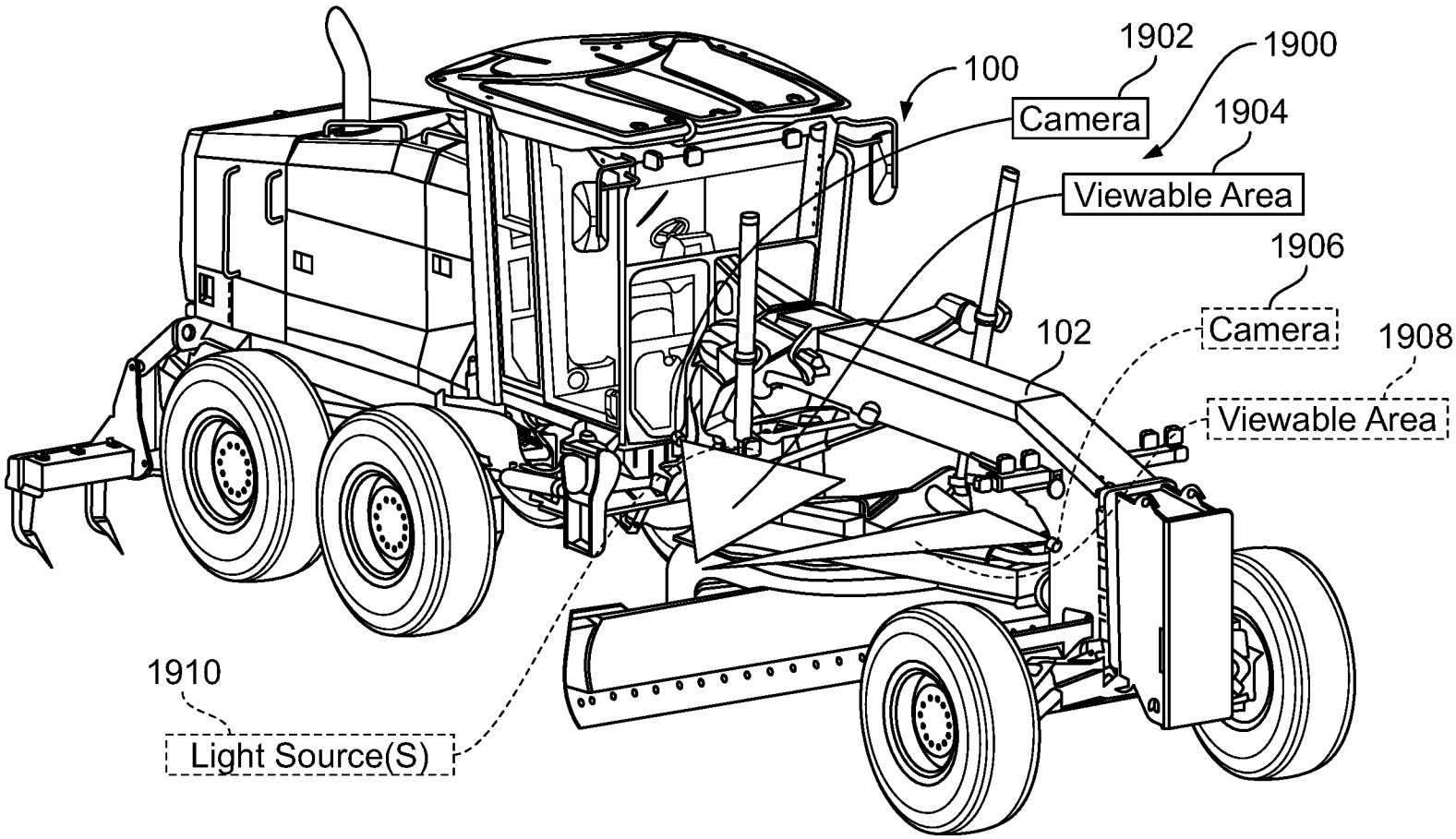
FIG. 19 is a front perspective view of the motor grader of FIG. 1 that includes another embodiment of a motion measurement system.

Referring now to FIG. 19, the motor grader 100 illustratively includes a motion measurement system 1900 configured to measure movement or position of one or more components of the motor grader 100 in use thereof. The motion measurement system 1900 illustratively includes a camera 1902 coupled to the chassis 102 and a controller 2010 (see FIG. 20). The camera 1902 is configured to capture one or more images of one or more components of the motor grader 100 in use thereof, as further discussed below. The controller 2010 is configured to determine locations of the locking holes 366, 376, 384, 386, 388, 390, 392 and/or the crossbar 382 based on the one or more images captured by the camera 1902 and to determine a positional state of the saddle linkage 150 based on the determined locations of the locking holes 366, 376, 384, 386, 388, 390, 392 and/or the crossbar 382, as described in greater detail below.

The camera 1902 is illustratively embodied as, or otherwise includes, any device capable of capturing and/or storing one or more images of one or more components of the motor grader 100 in use thereof, such as a digital camera, a panoramic camera, or the like, for example. In some embodiments, the camera 1902 may be included in, coupled to, or otherwise adapted for use with, a vision system. In any case, in the illustrative embodiment, the camera 1902 is coupled to the front chassis 102 such that the camera 1902 has a viewable area 1904. It should be appreciated that in the illustrative embodiment, the viewable area 1904 includes, or is otherwise embodied as, an area in which the locking holes 366, 376, 384, 386, 388, 390, 392 and the crossbar 382 may be viewed or otherwise detected by the camera 1902. As such, the camera 1902 is illustratively coupled to the front chassis 102 in relatively close proximity to the saddle linkage 150.

In some embodiments, the motion measurement system 1900 may include a camera 1906 that is coupled to the front chassis 102 and configured to capture one or more images of one or more components of the motor grader 100 in use thereof. The camera 1906 may be similar or substantially identical to the camera 1902. The camera 1906 may be coupled to the front chassis 102 such that the camera 1906 has a viewable area 1908 that is different from the viewable area 1904, at least in some embodiments. Nevertheless, the viewable area 1908 may include, or otherwise be embodied as, an area in which the locking holes 366, 376, 384, 386, 388, 390, 392 and the crossbar 382 may be viewed or otherwise detected by the camera 1906. In some embodiments, the camera 1906 may be coupled to the front chassis 102 in relatively close proximity to the ball and socket coupling 103 (i.e., near the draft frame 230).

Figure 20:
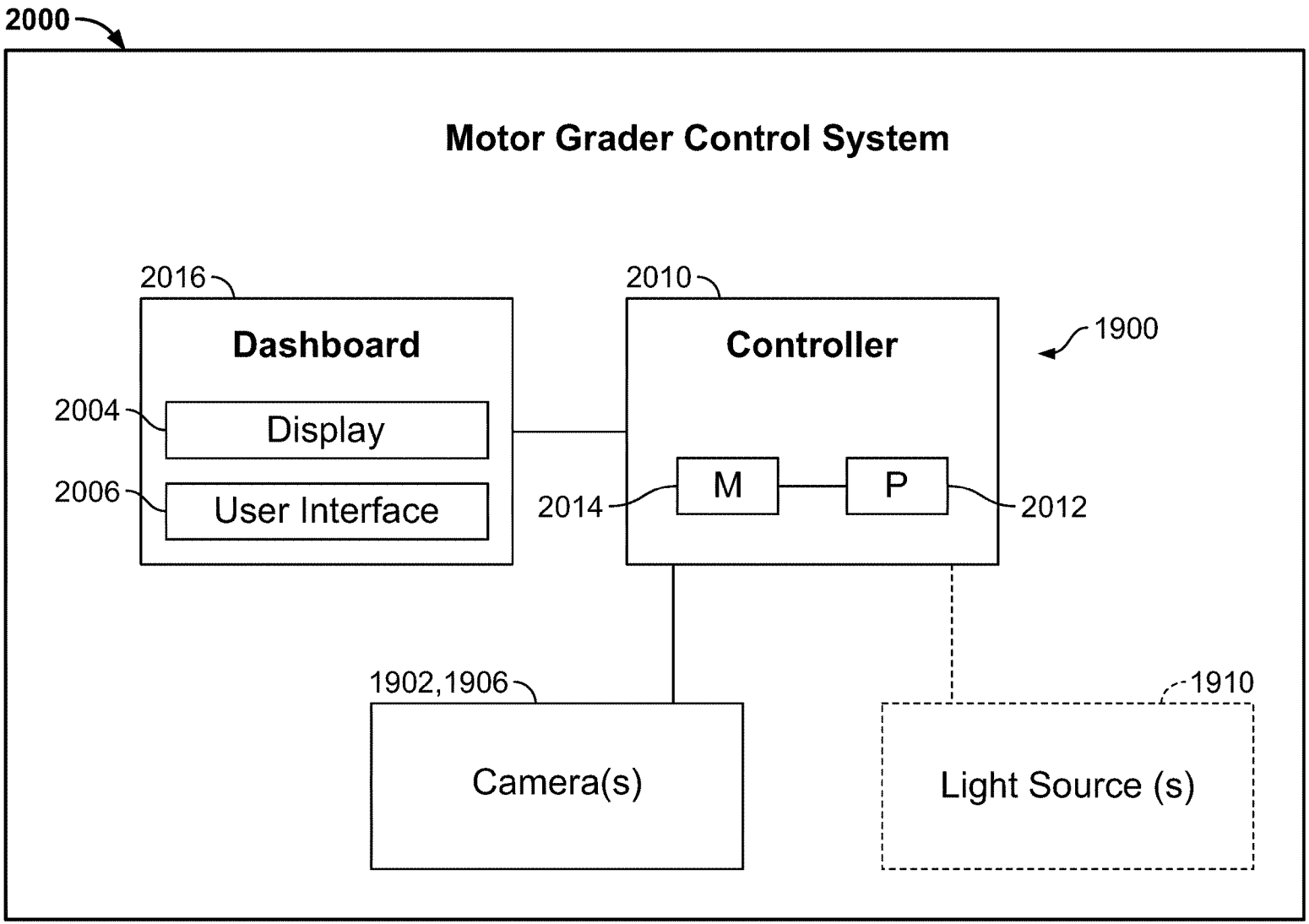
FIG. 20 is a diagrammatic view of a motor grader control system adapted for use with the motion measurement system shown in FIG. 19.

In embodiments in which the motion measurement system 1900 includes the cameras 1902, 1906, the controller 2010 may be coupled to each of the cameras 1902, 1906 as shown in FIG. 20. Furthermore, in such embodiments, the controller 2010 may be configured to determine locations of the locking holes 366, 376, 384, 386, 388, 390, 392 and/or the crossbar 382 based on the one or more images captured by the cameras 1902, 1906 and to determine a positional state of the saddle linkage 150 based on the determined locations of the locking holes 366, 376, 384, 386, 388, 390, 392 and/or the crossbar 382, as described in greater detail below with reference to FIG. 21.

In some embodiments, the motion measurement system 1900 may include one or more light sources 1910. One light source 1910 may be coupled to the front chassis 102 in relatively close proximity to the camera 1902 to facilitate illumination of the viewable area 1904 via the light source 1910, at least in some embodiments. Another light source 1910 may be coupled to the front chassis 102 in relatively close proximity to the camera 1906 to facilitate illumination of the viewable area 1908 via the light source 1910, at least in embodiments in which the cameras 1902, 1906 are included in the motion measurement system 1900. Each light source 1910 may be embodied as, or otherwise include, any device capable of producing light to facilitate capture and/or identification of one or more components of the motor grader 100 (e.g., the locking holes 366, 376, 384, 386, 388, 390, 392 and/or the crossbar 382).

Referring now to FIG. 20, an illustrative control system 2000, which may be used to control operation of some components of the motor grader 100 in some embodiments, includes, is coupled to, or is otherwise adapted for use with, the motion measurement system 1900. As such, for ease of discussion, the control system 2000 is shown to include the controller 2010 and the camera(s) 1902, 1906 coupled thereto, as well as the light source 1910 which may be coupled to the controller 2010. The controller 2010 illustratively includes a processor 2012 and a memory device 2014 coupled to the processor 2012.

The processor 2012 may be embodied as, or otherwise include, any type of processor, controller, or other compute circuit capable of performing various tasks such as compute functions and/or controlling the functions of the motor grader 100 and/or the motion measurement system 1900. For example, the processor 2012 may be embodied as a single or multi-core processor(s), a microcontroller, or other processor or processing/controlling circuit. In some embodiments, the processor 2012 may be embodied as, include, or be coupled to an FPGA, an application specific integrated circuit (ASIC), reconfigurable hardware or hardware circuitry, or other specialized hardware to facilitate performance of the functions described herein. Additionally, in some embodiments, the processor 2012 may be embodied as, or otherwise include, a high-power processor, an accelerator co-processor, or a storage controller. In some embodiments still, the processor 2012 may include more than one processor, controller, or compute circuit.

The memory device 2014 may be embodied as any type of volatile (e.g., dynamic random access memory (DRAM), etc.) or non-volatile memory capable of storing data therein. Volatile memory may be embodied as a storage medium that requires power to maintain the state of data stored by the medium. Non-limiting examples of volatile memory may include various types of random access memory (RAM), such as dynamic random access memory (DRAM) or static random access memory (SRAM). One particular type of DRAM that may be used in a memory module is synchronous dynamic random access memory (SDRAM). In particular embodiments, DRAM of a memory component may comply with a standard promulgated by JEDEC, such as JESD79F for DDR SDRAM, JESD79-2F for DDR2 SDRAM, JESD79-3F for DDR3 SDRAM, JESD79-4A for DDR4 SDRAM, JESD209 for Low Power DDR (LPDDR), JESD209-2 for LPDDR2, JESD209-3 for LPDDR3, and JESD209-4 for LPDDR4 (these standards are available at www.jedec.org). Such standards (and similar standards) may be referred to as DDR-based standards and communication interfaces of the storage devices that implement such standards may be referred to as DDR-based interfaces.

In some embodiments, the memory device 2014 may be embodied as a block addressable memory, such as those based on NAND or NOR technologies. The memory device 2014 may also include future generation nonvolatile devices, such as a three dimensional crosspoint memory device (e.g., Intel 3D XPoint™ memory), or other byte addressable write-in-place nonvolatile memory devices. In some embodiments, the memory device 2014 may be embodied as, or may otherwise include, chalcogenide glass, multi-threshold level NAND flash memory, NOR flash memory, single or multi-level Phase Change Memory (PCM), a resistive memory, nanowire memory, ferroelectric transistor random access memory (FeTRAM), anti-ferroelectric memory, magnetoresistive random access memory (MRAM) memory that incorporates memristor technology, resistive memory including the metal oxide base, the oxygen vacancy base and the conductive bridge Random Access Memory (CB-RAM), or spin transfer torque (STT)-MRAM, a spintronic magnetic junction memory based device, a magnetic tunneling junction (MTJ) based device, a DW (Domain Wall) and SOT (Spin Orbit Transfer) based device, a thyristor based memory device, or a combination of any of the above, or other memory. The memory device may refer to the die itself and/or to a packaged memory product. In some embodiments, 3D crosspoint memory (e.g., Intel 3D XPoint™ memory) may comprise a transistor-less stackable cross point architecture in which memory cells sit at the intersection of word lines and bit lines and are individually addressable and in which bit storage is based on a change in bulk resistance.

The illustrative control system 2000 includes a dashboard 2016 that is coupled to the controller 2010 and has a display 2004 and a user interface 2006. The dashboard 2016 is substantially identical to the dashboard 116, and as such, the display 2004 and the user interface 2006 are substantially identical to the display 604 and the user interface 606, respectively.

Of course, it should be appreciated that the control system 2000 may include components in addition to, and/or in lieu of, the components depicted in FIG. 20. However, for the sake of simplicity, discussion of those additional and/or alternative components is omitted.

Figure 21:
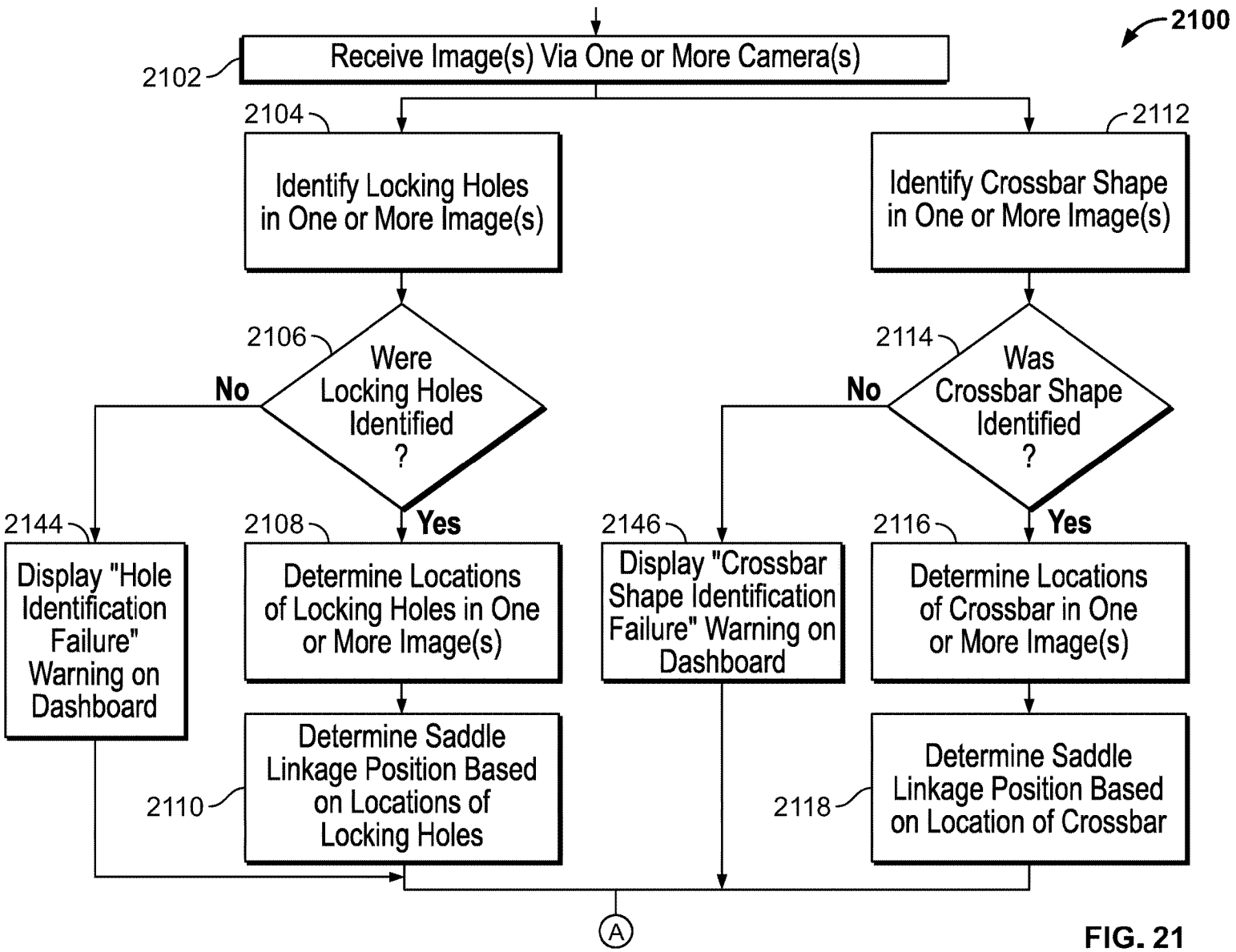
FIG. 21 is a simplified flowchart of a method of operating a motor grader that may be performed by the motor grader control system of FIG. 20.
Figure 21:
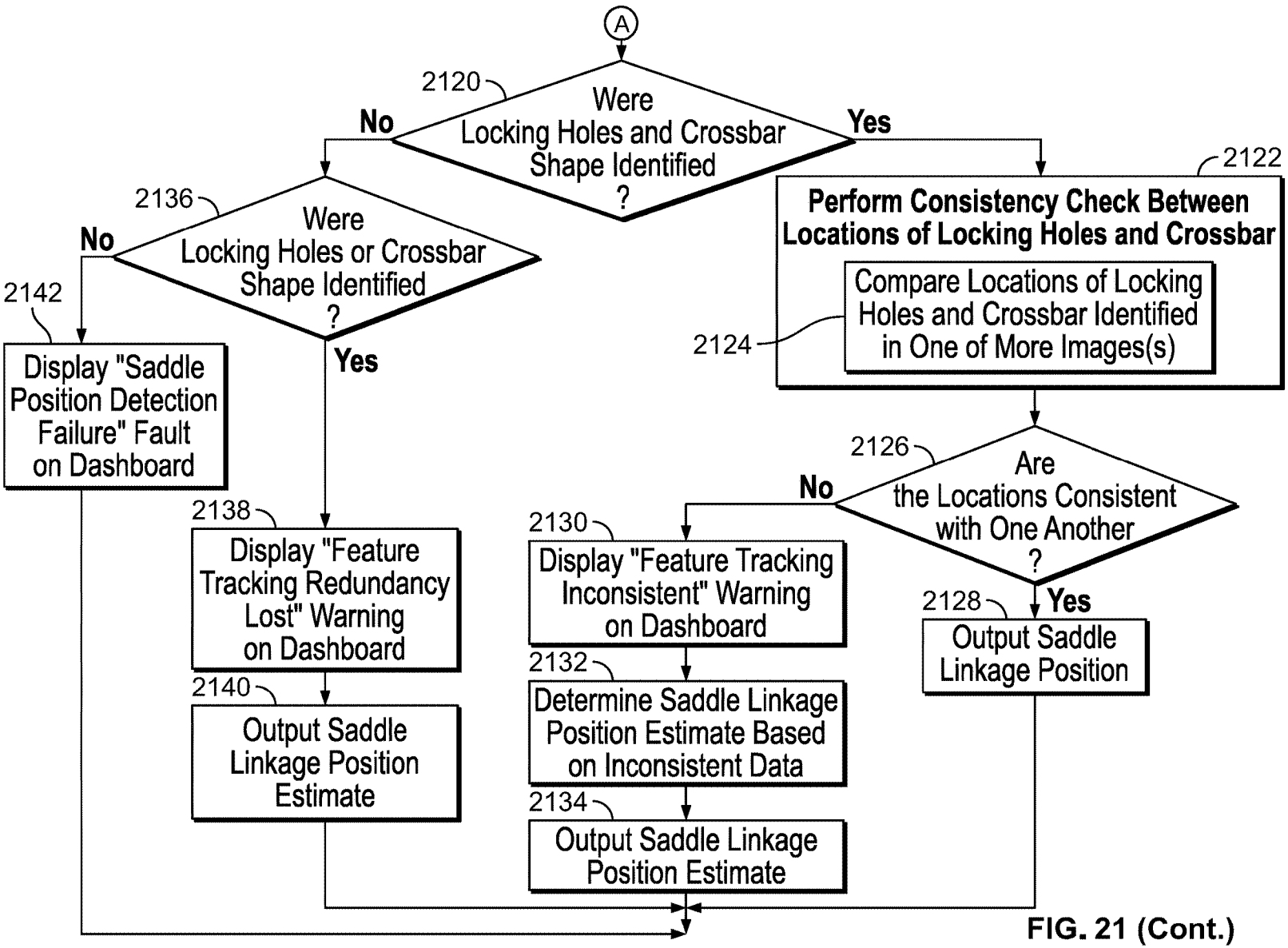

Referring now to FIG. 21, an illustrative method 2100 of operating the motor grader 100 (i.e., in embodiments in which the motor grader 100 includes the motion measurement system 1900) may be embodied as, or otherwise include, a set of instructions that are executable by the control system 2000 to control operation of the motor grader 100 and/or the motion measurement system 1900. The method 2100 corresponds to, or is otherwise associated with, performance of the blocks described below in the illustrative sequence of FIG. 21. It should be appreciated, however, that the method 2100 may be performed in one or more sequences different from the illustrative sequence. Furthermore, it should be appreciated that some blocks of the method 2100 may be performed contemporaneously and/or in parallel with one another, and that some of the blocks may be omitted from the method 2100, at least in some embodiments.

The illustrative method 2100 begins with block 2102. In block 2102, the controller 2010 receives one or more images that are captured by the camera 1902 and/or the camera 1906 during operation of the motor grader 100. In some embodiments, from block 2102, the illustrative method 2100 may subsequently proceed to block 2104. In other embodiments, from block 2102, the illustrative method 2100 may subsequently proceed to block 2112.

In block 2104 of the illustrative method 2100, the controller 2010 identifies (or attempts to identify) the locking holes 366, 376, 384, 386, 388, 390, 392 in the one or more images captured by the camera 1902 and/or the camera 1906. From the block 2104, the illustrative method 2100 subsequently proceeds to block 2106.

In block 2106 of the illustrative method 2100, the controller 2010 determines whether the locking holes 366, 376, 384, 386, 388, 390, 392 were identified in the one or more images captured by the camera 1902 and/or the camera 1906 (i.e., the controller 2010 determines whether the attempt at identifying the holes 366, 376, 384, 386, 388, 390, 392 in block 2104 was successful). If the controller 2010 determines in block 2106 that the locking holes 366, 376, 384, 386, 388, 390, 392 were successfully identified, the illustrative method 2100 subsequently proceeds to block 2108.

In block 2108 of the illustrative method 2100, the controller 2010 determines the locations of the locking holes 366, 376, 384, 386, 388, 390, 392 in the one or more images captured by the camera 1902 and/or the camera 1906. From block 2108, the illustrative method 2100 proceeds to block 2110.

In block 2110 of the illustrative method 2100, the controller 2010 determines a positional state of the saddle linkage 150 based on the locations of the locking holes 366, 376, 384, 386, 388, 390, 392 determined in block 2108. From block 2110, the illustrative method 2100 subsequently proceeds to block 2120.

As mentioned above, from block 2102, the illustrative method 2100 may subsequently proceed to either block 2104 or block 2112. In block 2112, the controller 2010 identifies (or attempts to identify) the shape of the crossbar 382 in the one or more images captured by the camera 1902 and/or the camera 1906. From the block 2112, the illustrative method 2100 subsequently proceeds to block 2114.

In block 2114 of the illustrative method 2100, the controller 2010 determines whether the shape of the crossbar 382 was identified in the one or more images captured by the camera 1902 and/or the camera 1906 (i.e., the controller 2010 determines whether the attempt at identifying the shape of the crossbar 382 in block 2112 was successful). If the controller 2010 determines in block 2114 that the shape of the crossbar 382 was successfully identified, the illustrative method 2100 subsequently proceeds to block 2116.

In block 2116 of the illustrative method 2100, the controller 2010 determines the location of the crossbar 382 in the one or more images captured by the camera 1902 and/or the camera 1906 (i.e., based on successful identification of the shape of the crossbar 382 in block 2114). From block 2116, the illustrative method 2100 subsequently proceeds to block 2118.

In block 2118 of the illustrative method 2100, the controller 2010 determines a positional state of the saddle linkage 150 based on the location of the crossbar 382 determined in block 2116. From block 2118, the illustrative method 2100 subsequently proceeds to block 2120.

In block 2120 of the illustrative method 2100, the controller 2010 determines whether both the locking holes 366, 376, 384, 386, 388, 390, 392 and the shape of the crossbar 382 were successfully identified (i.e., in respective blocks 2106 and 2114). If the controller 2010 determines that both the locking holes 366, 376, 384, 386, 388, 390, 392 and the shape of the crossbar 382 were successfully identified, the illustrative method 2100 subsequently proceeds to block 2122.

In block 2122 of the illustrative method 2100, the controller 2010 performs a consistency check between the locations of the locking holes 366, 376, 384, 386, 388, 390, 392 and the crossbar 382. To do so, in block 2124, the controller 2010 compares the locations of the locking holes 366, 376, 384, 386, 388, 390, 392 and the crossbar 382 in the one or more images captured by the camera 1902 and/or the camera 1906. From block 2124, the illustrative method 2100 subsequently proceeds to block 2126.

In block 2126 of the illustrative method 2100, the controller 2010 determines, based on the comparison performed in block 2124, whether the locations of the locking holes 366, 376, 384, 386, 388, 390, 392 and the crossbar 382 are consistent with one another. If the controller 2010 determines that the locations of the locking holes 366, 376, 384, 386, 388, 390, 392 and the crossbar 382 are consistent with one another, the illustrative method 2100 subsequently proceeds to block 2128.

In block 2128 of the illustrative method 2100, the controller 2010 outputs a positional state of the saddle linkage 150 based on the consistent locations of the locking holes 366, 376, 384, 386, 388, 390, 392 and the crossbar 382 determined in block 2126. It should be appreciated that the positional state of the saddle linkage 150 output by the controller 2010 in block 2128 corresponds to the positional states of the saddle linkage 150 determined in blocks 2110 and 2118. In some embodiments, performance of the block 2128 may correspond to, or otherwise be associated with, execution of one iteration of the method 2100 by the controller 2010.

Returning to block 2126 of the illustrative method 2100, if the controller 2010 determines in block 2126 that the locations of the locking holes 366, 376, 384, 386, 388, 390, 392 and the crossbar 382 are not consistent with one another, the illustrative method 2100 subsequently proceeds to block 2130.

In block 2130 of the illustrative method 2100, the controller 2010 displays a warning on the dashboard 2016 (e.g., the display 2004 thereof) indicative of the inconsistency between the locations of the locking holes 366, 376, 384, 386, 388, 390, 392 and the crossbar 382. In some embodiments, that warning may read "Feature Tracking Inconsistent." In any case, from block 2130, the illustrative method 2100 subsequently proceeds to block 2132.

In block 2132 of the illustrative method 2100, the controller 2010 determines an estimate of a positional state of the saddle linkage 150 based on the inconsistent locations of the locking holes 366, 376, 384, 386, 388, 390, 392 and the crossbar 382. From block 2132, the illustrative method 2100 subsequently proceeds to block 2134.

In block 2134 of the illustrative method 2100, the controller 2010 outputs the estimate of the positional state of the saddle linkage 150 determined in block 2132. It should be appreciated that the positional state of the saddle linkage 150 output by the controller 2010 in block 2134 is based on the positional states of the saddle linkage 150 determined in blocks 2110 and 2118. In some embodiments, performance of the block 2134 may correspond to, or otherwise be associated with, execution of one iteration of the method 2100 by the controller 2010.

Returning to block 2120 of the illustrative method 2100, if the controller 2010 determines in block 2120 that both the locking holes 366, 376, 384, 386, 388, 390, 392 and the shape of the crossbar 382 were not successfully identified, the illustrative method 2100 subsequently proceeds to block 2136.

In block 2136 of the illustrative method 2100, the controller 2010 determines whether one of (i) the locking holes 366, 376, 384, 386, 388, 390, 392 or (ii) the shape of the crossbar 382 was successfully identified (i.e., in either block 2106 or block 2114). If the controller 2010 determines that one of (i) the locking holes 366, 376, 384, 386, 388, 390, 392 or (ii) the shape of the crossbar 382 was successfully identified, the illustrative method 2100 subsequently proceeds to block 2138.

In block 2138 of the illustrative method 2100, the controller 2010 displays a warning on the dashboard 2016 (e.g., the display 2004 thereof) indicative of the lack of redundancy tracking of the locations of the locking holes 366, 376, 384, 386, 388, 390, 392 and the crossbar 382. In some embodiments, that warning may read "Feature Tracking Redundancy Lost." In any case, from block 2138, the illustrative method 2100 subsequently proceeds to block 2140.

In block 2140 of the illustrative method 2100, the controller 2010 outputs an estimate of a positional state of the saddle linkage 150. It should be appreciated that the estimate of the positional state of the saddle linkage 150 output by the controller 2010 in block 2140 corresponds to one of the positional states of the saddle linkage 150 determined in blocks 2110 and 2118. In some embodiments, performance of the block 2140 may correspond to, or otherwise be associated with, execution of one iteration of the method 2100 by the controller 2010.

Returning to block 2136 of the illustrative method 2100, if the controller 2010 determines in block 2136 that neither the locking holes 366, 376, 384, 386, 388, 390, 392 nor the shape of the crossbar 382 was successfully identified, the illustrative method 2100 subsequently proceeds to block 2142.

In block 2142 of the illustrative method 2100, the controller 2010 displays a fault on the dashboard 2016 (e.g., the display 2004 thereof) indicative of the failure of the motion measurement system 1900 to detect the positional state of the saddle linkage 150. In some embodiments, that fault may read "Saddle Position Detection Failure." In some embodiments, performance of the block 2142 may correspond to, or otherwise be associated with, execution of one iteration of the method 2100 by the controller 2010.

Returning now to block 2106, if the controller 2010 determines in block 2106 that the locking holes 366, 376, 384, 386, 388, 390, 392 were not successfully identified, the method 2100 subsequently proceeds to block 2144.

In block 2144 of the illustrative method 2100, the controller 2010 displays a warning on the dashboard 2016 (e.g., the display 2004 thereof) indicative of the failure of the motion measurement system 1900 to detect the locking holes 366, 376, 384, 386, 388, 390, 392. In some embodiments, that warning may read "Hole Identification Failure." From block 2144, the illustrative method 2100 subsequently proceeds to block 2120.

Returning now to block 2114, if the controller 2010 determines in block 2114 that the shape of the crossbar 382 was not successfully identified, the illustrative method 2100 subsequently proceeds to block 2146.

In block 2146 of the illustrative method 2100, the controller 2010 displays a warning on the dashboard 2016 (e.g., the display 2004 thereof) indicative of the failure of the motion measurement system 1900 to detect the shape of the crossbar 382. In some embodiments, that warning may read "Crossbar Shape Identification Failure." From block 2146, the illustrative method 2100 subsequently proceeds to block 2120.

Figure 22:
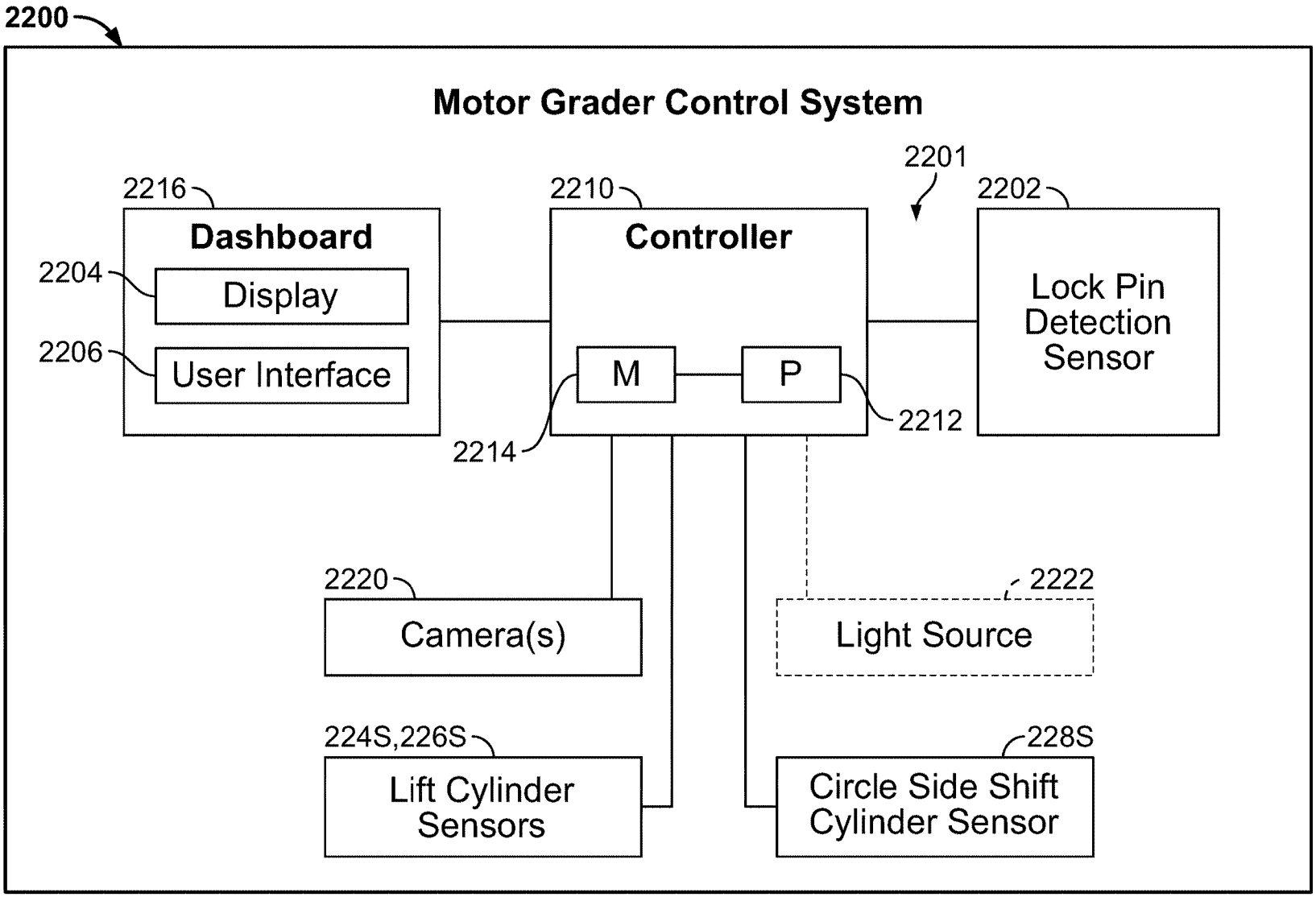
FIG. 22 is a diagrammatic view of a motor grader control system adapted for use with the motor grader of FIG. 1 that includes another embodiment of a motion measurement system.

Referring now to FIG. 22, an illustrative control system 2200, which may be used to control operation of some components of the motor grader 100 in some embodiments, includes, is coupled to, or is otherwise adapted for use with, a motion measurement system 2201. The motion measurement system 2201 is configured to measure movement of one or more components of the grader 100 in use thereof. The illustrative motion measurement system 2201 includes the lift cylinder sensors 224S, 226S, the circle side shift cylinder sensor 228S, a controller 2210, one or more cameras 2220, and a lock pin detection sensor 2202 that is substantially identical to the lock pin detection sensor 602. The lift cylinder sensors 224S, 226S, the circle side shift cylinder 228S, the one or more cameras 2220, and the lock pin detection sensor 2202 are coupled to the controller 2210. In some embodiments, the motion measurement system 2201 may include a light source 2222, which may be coupled to the controller 2210. As described in greater detail below with reference to FIG. 23, at least in some embodiments, the controller 2210 is configured to determine operational kinematics of the draft frame 230 relative to the front chassis 102 based at least partially on the lift cylinder sensor input provided by the lift cylinder sensors 224S, 226S, the circle side shift cylinder input provided by the circle side shift cylinder sensor 228S, and one or more images captured by the one or more cameras 2220. In any case, the controller 2210 illustratively includes a processor 2212 and a memory device 2214 coupled to the processor 2212.

The processor 2212 may be embodied as, or otherwise include, any type of processor, controller, or other compute circuit capable of performing various tasks such as compute functions and/or controlling the functions of the motor grader 100 and/or the motion measurement system 2201. For example, the processor 2212 may be embodied as a single or multi-core processor(s), a microcontroller, or other processor or processing/controlling circuit. In some embodiments, the processor 2212 may be embodied as, include, or be coupled to an FPGA, an application specific integrated circuit (ASIC), reconfigurable hardware or hardware circuitry, or other specialized hardware to facilitate performance of the functions described herein. Additionally, in some embodiments, the processor 2212 may be embodied as, or otherwise include, a high-power processor, an accelerator co-processor, or a storage controller. In some embodiments still, the processor 2212 may include more than one processor, controller, or compute circuit.

The memory device 2214 may be embodied as any type of volatile (e.g., dynamic random access memory (DRAM), etc.) or non-volatile memory capable of storing data therein. Volatile memory may be embodied as a storage medium that requires power to maintain the state of data stored by the medium. Non-limiting examples of volatile memory may include various types of random access memory (RAM), such as dynamic random access memory (DRAM) or static random access memory (SRAM). One particular type of DRAM that may be used in a memory module is synchronous dynamic random access memory (SDRAM). In particular embodiments, DRAM of a memory component may comply with a standard promulgated by JEDEC, such as JESD79F for DDR SDRAM, JESD79-2F for DDR2 SDRAM, JESD79-3F for DDR3 SDRAM, JESD79-4A for DDR4 SDRAM, JESD209 for Low Power DDR (LPDDR), JESD209-2 for LPDDR2, JESD209-3 for LPDDR3, and JESD209-4 for LPDDR4 (these standards are available at www.jedec.org). Such standards (and similar standards) may be referred to as DDR-based standards and communication interfaces of the storage devices that implement such standards may be referred to as DDR-based interfaces.

In some embodiments, the memory device 2214 may be embodied as a block addressable memory, such as those based on NAND or NOR technologies. The memory device 2214 may also include future generation nonvolatile devices, such as a three dimensional crosspoint memory device (e.g., Intel 3D XPoint™ memory), or other byte addressable write-in-place nonvolatile memory devices. In some embodiments, the memory device 2214 may be embodied as, or may otherwise include, chalcogenide glass, multi-threshold level NAND flash memory, NOR flash memory, single or multi-level Phase Change Memory (PCM), a resistive memory, nanowire memory, ferroelectric transistor random access memory (FeTRAM), anti-ferroelectric memory, magnetoresistive random access memory (MRAM) memory that incorporates memristor technology, resistive memory including the metal oxide base, the oxygen vacancy base and the conductive bridge Random Access Memory (CB-RAM), or spin transfer torque (STT)-MRAM, a spintronic magnetic junction memory based device, a magnetic tunneling junction (MTJ) based device, a DW (Domain Wall) and SOT (Spin Orbit Transfer) based device, a thyristor based memory device, or a combination of any of the above, or other memory. The memory device may refer to the die itself and/or to a packaged memory product. In some embodiments, 3D crosspoint memory (e.g., Intel 3D XPoint™ memory) may comprise a transistor-less stackable cross point architecture in which memory cells sit at the intersection of word lines and bit lines and are individually addressable and in which bit storage is based on a change in bulk resistance.

In the illustrative embodiment, the one or more cameras 2220 are each substantially identical to each of the cameras 1902, 1906. It should be appreciated that, similar to the cameras 1902, 1906, the one or more cameras 2220 may be mounted to the front chassis 102 such that the one or more cameras 2220 each have a viewable area (not shown) in which one or more feature(s) of interest of the motor grader 100 (e.g., the locking holes 366, 376, 384, 386, 388, 390, 392 and/or the crossbar 382) may be viewed or otherwise detected by the one or more cameras 2220, as further discussed below.

The light source 2222 is substantially identical to the one or more light sources 1910. It should be appreciated that the light source 2222 may be coupled to the front chassis 102 in relatively close proximity to the one or more cameras 2220 to facilitate illumination of the viewable area(s) of the one or more camera(s) 2220.

The illustrative control system 2200 includes a dashboard 2216 that is coupled to the controller 2210 and has a display 2204 and a user interface 2206. The dashboard 2216 is substantially identical to the dashboard 116, and as such, the display 2204 and the user interface 2206 are substantially identical to the display 604 and the user interface 606, respectively.

Of course, it should be appreciated that the control system 2200 may include components in addition to, and/or in lieu of, the components depicted in FIG. 22. However, for the sake of simplicity, discussion of those additional and/or alternative components is omitted.

Figure 23:
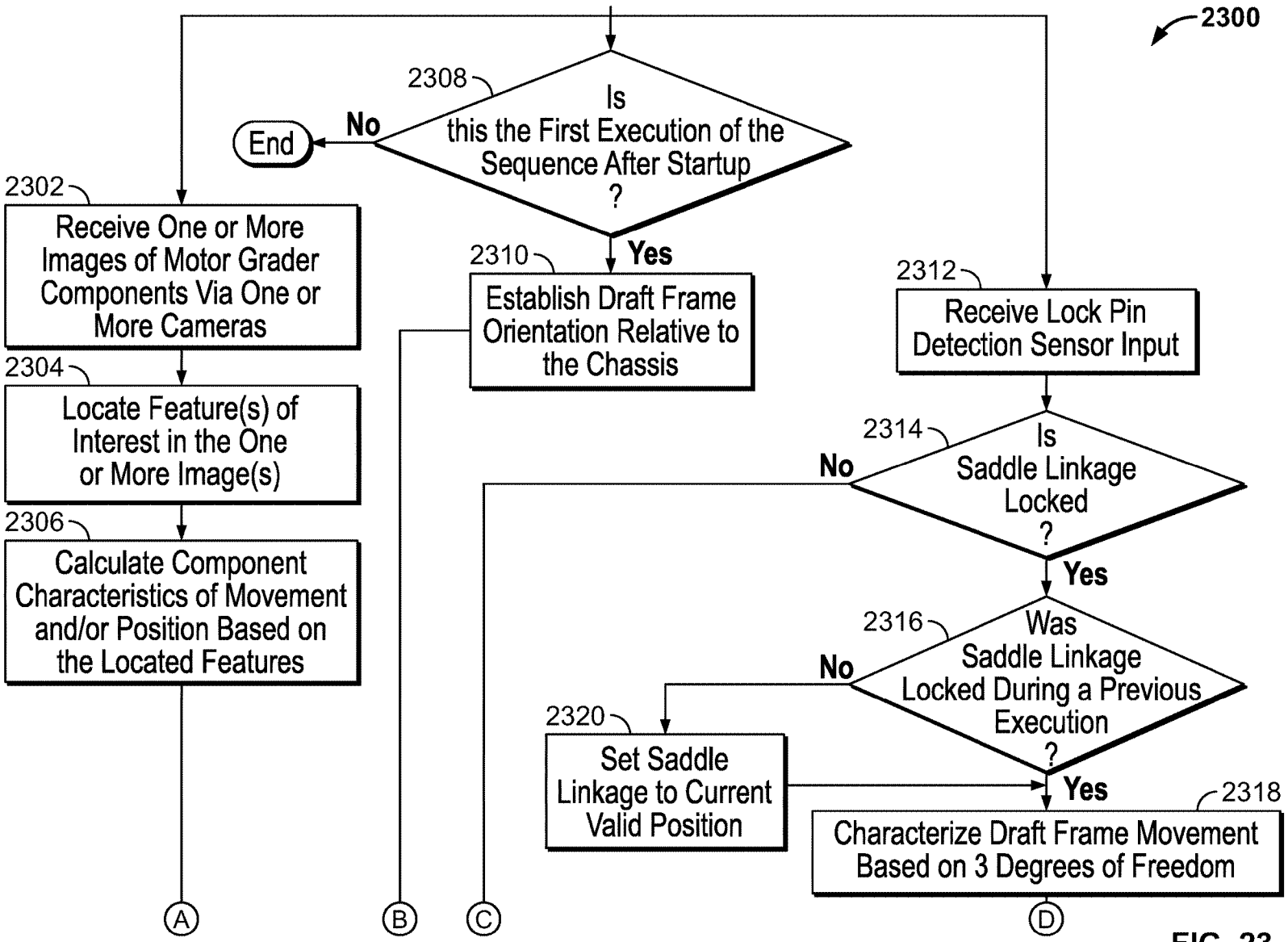
FIG. 23 is a simplified flowchart of a method of operating a motor grader that may be performed by the motor grader control system of FIG. 22.
Figure 23:
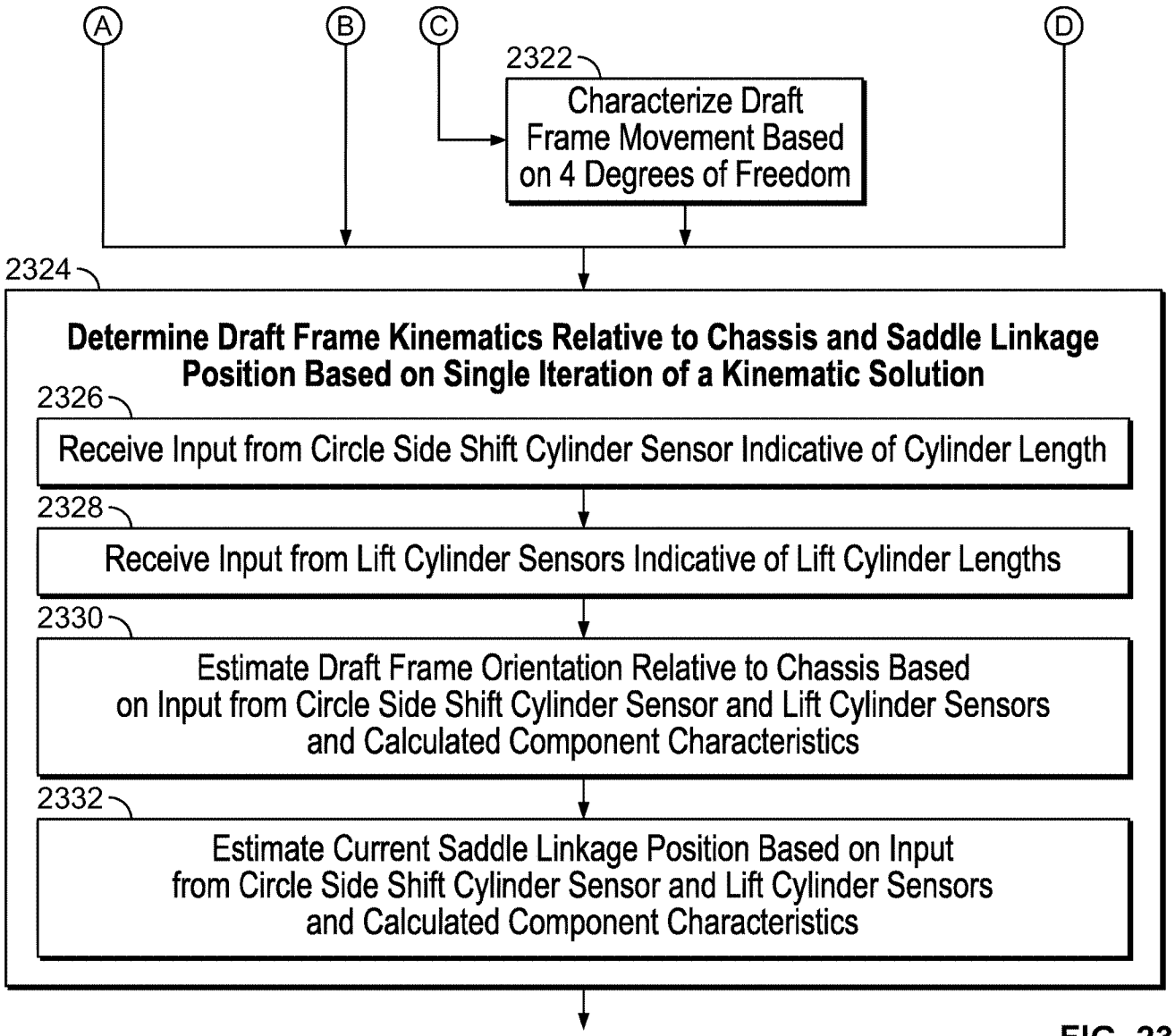

Referring now to FIG. 23, an illustrative method 2300 of operating the motor grader 100 (i.e., in embodiments in which the motor grader 100 includes the motion measurement system 2201) may be embodied as, or otherwise include, a set of instructions that are executable by the control system 2200 to control operation of the motor grader 100 and/or the motion measurement system 2201. The method 2300 corresponds to, or is otherwise associated with, performance of the blocks described below in the illustrative sequence of FIG. 23. It should be appreciated, however, that the method 2300 may be performed in one or more sequences different from the illustrative sequence. Furthermore, it should be appreciated that some blocks of the method 2300 may be performed contemporaneously and/or in parallel with one another, and that some of the blocks may be omitted from the method 2300, at least in some embodiments.

The illustrative method 2300 includes blocks 2302, 2308, and 2312. In some embodiments, the method 2300 may begin with block 2302. In other embodiments, the method 2300 may begin with block 2308. In other embodiments still, the method 2300 may begin with 2312. Presuming a determination by the controller 2210 that the execution of the method 2300 is the first execution thereof following startup (i.e., in block 2308 as discussed below), the controller 2210 executes the method 2300 to determine operational kinematics of the draft frame 230 relative to the front chassis 102 and the positional state of the saddle linkage 150 based on a single iteration of a kinematic solution (i.e., in block 2324 as discussed below) regardless of whether the method 2300 begins with block 2302, 2308, or 2312. Accordingly, at least in some embodiments, the method 2300 may be intended to generate, and may be resolved upon the determination of, a single iteration of a kinematic solution for expressing the operational kinematics of the draft frame 230 relative to the front chassis 102 and the positional state of the saddle linkage 150.

In block 2302, the controller 2210 receives one or more images captured by the one or more cameras 2220 of one or more components of the motor grader 100 (e.g., one or more components of the saddle linkage 150) in use thereof. From block 2302, the illustrative method 2300 subsequently proceeds to block 2304.

In block 2304 of the illustrative method 2300, the controller 2210 locates one or more features of interest in the one or more images captured by the one or more cameras 2220. In some embodiments, the feature(s) of interest may include one or more components of the saddle linkage 150 and/or the work implement assembly 102, for example. In any case, from block 2304, the illustrative method 2300 subsequently proceeds to block 2306.

In block 2306 of the illustrative method 2300, the controller 2210 calculates or otherwise determines one or more characteristics of movement and/or position of the component(s) of the motor grader 100 based on the features located in block 2304. From block 2306, the illustrative method 2300 subsequently proceeds to block 2324.

Returning to the beginning of the illustrative method 2300, as indicated above, the method 2300 may begin with block 2308, at least in some embodiments. In block 2308, the controller 2210 determines whether the execution of the method 2300 is the first execution thereof following startup of the motor grader 100. If the controller 2210 determines in block 2308 that the execution of the method 2300 is the first execution thereof following startup, the method 2300 subsequently proceeds to block 2310.

In block 2310, the controller 2210 establishes an orientation of the draft frame 230 relative to the front chassis 102. To do so, in some embodiments, the controller 2210 may establish a reference orientation based on the chassis 102 and compute or otherwise determine the orientation of the draft frame 230 based on that reference orientation. In any case, from block 2310, the illustrative method 2300 subsequently proceeds to block 2324.

Returning to the beginning of the illustrative method 2300, as indicated above, the method 2300 may begin with block 2312, at least in some embodiments. In block 2312, the controller 2210 receives the lock detection sensor input provided by the lock pin detection sensor 2202. From the block 2312, the method 2300 subsequently proceeds to block 2314.

In block 2314 of the illustrative method 2300, the controller 2210 determines whether the saddle linkage 150 is locked in one of a plurality of positional states (i.e., whether the lock pin 394 is received by the lock pin aperture 360 and the one of the locking holes 366, 376, 384, 386, 388, 390, 392) based on the lock pin detection sensor input received in block 2312. If the controller 2210 determines that the saddle linkage 150 is locked in one of the positional states, the method 2300 subsequently proceeds to block 2316.

In block 2316 of the illustrative method 2300, the controller 2210 determines whether the saddle linkage 150 was locked in one of the positional states during a previous execution of the method 2300 (e.g., an execution of the method 2300 prior to startup). If the controller 2210 determines that the saddle linkage 150 was locked in one of the positional states during a previous execution, the method 2300 subsequently proceeds to block 2318.

In block 2318 of the illustrative method 2300, the controller 2210 characterizes movement of the draft frame 230 relative to the chassis 102 based on three degrees of freedom. In some embodiments, the three degrees of freedom may be embodied as, or otherwise include, roll, pitch, and yaw of the draft frame 230 relative to the front chassis 102. Furthermore, in some embodiments, the characterization of draft frame 230 movement based on roll, pitch, and yaw may be used to determine operational kinematics of the draft frame 230 in block 2324. In any case, from block 2318, the illustrative method 2300 subsequently proceeds to block 2324.

Returning to block 2316 of the illustrative method 2300, if the controller 2210 determines that the saddle linkage 150 was not locked in one of the positional states during a previous execution in block 2316, the method 2300 subsequently proceeds to block 2320. In block 2320, the controller 2210 sets the saddle linkage 150 to its current valid position. That is, in block 2320, the controller 2210 sets the saddle linkage 150 position (e.g., in the memory device 2214) based on the current position of the saddle linkage 150 as that position is defined by, or otherwise associated with, positioning of the lock pin 394 in one of the locking holes 366, 376, 384, 386, 388, 390, 392. From block 2320, the method 2300 subsequently proceeds to block 2318.

Returning to block 2314 of the illustrative method 2300, if the controller 2210 determines that the saddle linkage 150 is not locked in one of the positional states in block 2314, the method 2300 subsequently proceeds to block 2322. In block 2322, the controller 2210 characterizes movement of the draft frame 230 relative to the chassis 102 based on four degrees of freedom. In some embodiments, the four degrees of freedom may be embodied as, or otherwise include, roll, pitch, and yaw of the draft frame 230 relative to the front chassis 102, as well as the positional state of the saddle linkage 150. Furthermore, in some embodiments, the characterization of draft frame 230 movement based on roll, pitch, yaw, and the positional state of the saddle linkage 150 may be used to determine operational kinematics of the draft frame 230 in block 2324. In any case, from block 2322, the illustrative method 2300 subsequently proceeds to block 2324.

In block 2324 of the illustrative method 2300, the controller 2210 determines the operational kinematics of the draft frame 230 relative to the front chassis 102 and the positional state of the saddle linkage 150 based on a single iteration of a kinematic solution. To do so, the controller 2210 performs blocks 2326, 2328, 2330, and 2332. In block 2326, the controller 2210 receives circle side shift cylinder sensor input provided by the sensor 228S that is indicative of one or more lengths of the circle side shift cylinder 228. In block 2328, the controller 2210 receives lift cylinder sensor input provided by the lift cylinders 224S, 226S that is indicative of one or more lengths of the respective lift cylinders 224, 226. In block 2330, the controller 2210 determines an estimate of one or more characteristics of movement and/or position (e.g., roll, pitch, and/or yaw) of the draft frame 230 relative to the front chassis 102 based on the circle side shift cylinder input, the lift cylinder input, and the characteristics calculated in block 2306. In block 2332, the controller 2210 determines an estimate of a positional state of the saddle linkage 150 based on the circle side shift cylinder input, the lift cylinder input, and the characteristics calculated in block 2306. In some embodiments, performance of the block 2324 may correspond to, or otherwise be associated with, execution of one iteration of the method 2300, as well as one iteration of the kinematic solution, by the controller 2210.

Returning to block 2308 of the illustrative method 2300, if the controller 2210 determines that the execution of the method 2300 is not the first execution thereof following startup in block 2308, the method 2300 ends. Of course, it should be appreciated that in at least some embodiments, if the controller 2210 determines that that the execution of the method 2300 is not the first execution thereof following startup in block 2308, the method 2300 may restart from the beginning. In any case, it should be appreciated that the illustrative method 2300 may be intended to generate, and may be resolved upon the determination of, a single iteration of a kinematic solution for expressing the operational kinematics of the draft frame 230 relative to the front chassis 102 and the positional state of the saddle linkage 150 in the event that the controller 2210 determines that the execution of the method 2300 is the first execution thereof following startup in block 2308, as indicated above.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

The invention claimed is:

1. A grader comprising:

a chassis;

a saddle linkage supported for movement relative to the chassis that includes a mount movably coupled to the chassis, first and second arms each movably coupled to the mount, and a crossbar movably coupled to each of the first and second arms, wherein the mount has a lock pin aperture, each of the first and second arms has a locking hole, and the crossbar has a plurality of locking holes, and wherein the lock pin aperture may be aligned with one locking hole of the first arm, the second arm, or the crossbar to position the saddle linkage in use of the grader;

a motion measurement system configured to measure movement or position of one or more components of the grader in use thereof, wherein the motion measurement system includes a first camera coupled to the chassis and configured to capture one or more images of one or more components of the grader in use of the grader and a controller coupled to the first camera, and wherein the controller is configured to determine locations of the locking holes and/or the crossbar based on the one or more images captured by the first camera and to determine a positional state of the saddle linkage based on the determined locations of the locking holes and/or the crossbar.

2. The grader of claim 1, wherein the controller is configured to determine locations of the locking holes and the crossbar based on the one or more images captured by the first camera and to determine the positional state of the saddle linkage based on the determined locations of the locking holes and the crossbar.

3. The grader of claim 2, wherein to determine the locations of the locking holes and the crossbar, the controller is configured to identify the locking holes based on the one or more images captured by the first camera and to identify the shape of the crossbar based on the one or more images captured by the first camera.

4. The grader of claim 3, wherein in response to a determination that the locking holes and the shape of the crossbar are identified, the controller is configured to compare the locations of the locking holes with one or more locations of the crossbar to determine whether the locations are consistent with one another.

5. The grader of claim 3, wherein in response to a determination that the locking holes and the shape of the crossbar are not identified, the controller is configured to estimate a positional state of the saddle linkage based on the lack of identification of the locking holes and the shape of the crossbar.

6. The grader of claim 4, wherein in response to a determination that the locations of the locking holes and the crossbar are inconsistent with one another, the controller is configured to estimate a positional state of the saddle linkage based on the inconsistent locations of the locking holes and the crossbar, and wherein in response to a determination that the locations of the locking holes and the crossbar are consistent with one another, the controller is configured to determine the positional state of the saddle linkage based on the consistent locations of the locking holes and the crossbar.

7. The grader of claim 1, wherein the motion measurement system includes a second camera coupled to the chassis and configured to capture one or images of one or more components of the grader in use of the grader, and wherein the controller is configured to determine locations of the locking holes and/or the crossbar based on the one or more images captured by the first and second cameras and to determine a positional state of the saddle linkage based on the determined locations of the locking holes and/or the crossbar.

8. A grader comprising:

a chassis;

a saddle linkage supported for movement relative to the chassis that includes a mount movably coupled to the chassis, first and second arms each movably coupled to the mount, and a crossbar movably coupled to each of the first and second arms, wherein the mount has a lock pin aperture, each of the first and second arms has a locking hole, and the crossbar has a plurality of locking holes, and wherein the lock pin aperture may be aligned with one locking hole of the first arm, the second arm, or the crossbar to position the saddle linkage in use of the grader;

a motion measurement system configured to measure movement or position of one or more components of the grader in use thereof, wherein the motion measurement system includes a first camera coupled to the chassis and configured to capture one or more images of one or more components of the grader in use of the grader and a controller coupled to the first camera, and wherein the controller is configured to determine locations of one or more of the locking holes and the crossbar based on the one or more images captured by the first camera and to determine a positional state of the saddle linkage based on the determined locations of one or more of the locking holes and the crossbar, wherein the controller is further configured to compare the locations of one or more of the locking holes with one or more locations of the crossbar to determine whether the locations are consistent with one another.

9. The grader of claim 8, wherein in response to a determination that the locations of one or more of the locking holes and the crossbar are inconsistent with one another, the controller is configured to estimate a positional state of the saddle linkage based on the inconsistent locations of one or more of the locking holes and the crossbar, and wherein in response to a determination that the locations of one or more of the locking holes and the crossbar are consistent with one another, the controller is configured to determine the positional state of the saddle linkage based on the consistent locations of one or more of the locking holes and the crossbar.

10. The grader of claim 8, wherein to determine the locations of one or more of the locking holes and the crossbar, the controller is configured to identify one or more of the locking holes based on the one or more images captured by the first camera and to identify the shape of the crossbar based on the one or more images captured by the first camera.

11. The grader of claim 8, wherein the motion measurement system includes a second camera coupled to the chassis and the controller, the second camera configured to capture one or images of one or more components of the grader in use of the grader, and wherein the controller is configured to determine locations of one or more of the locking holes and the crossbar based on the one or more images captured by the first and second cameras and to determine a positional state of the saddle linkage based on the determined locations of one or more of the locking holes and the crossbar.

12. The grader of claim 11, wherein the first camera has a first viewable area and the second camera has a second viewable area, the first camera arranged relative to the second camera such that the first viewable area and/or the second viewable area capture the images of one or more of the locking holes and the crossbar.

13. The grader of claim 12, wherein the first camera is arranged relative to the second camera such that the first viewable area is different from the second viewable area.

14. The grader of claim 8, further comprising:

a light source coupled to the chassis near the first camera to illuminate a first viewable area of the first camera.

15. A grader comprising:

a chassis;

a saddle linkage supported for movement relative to the chassis that includes a mount movably coupled to the chassis, first and second arms each movably coupled to the mount, and a crossbar movably coupled to each of the first and second arms, wherein the mount has a lock pin aperture, each of the first and second arms has a locking hole, and the crossbar has a plurality of locking holes, and wherein the lock pin aperture may be aligned with one locking hole of the first arm, the second arm, or the crossbar to position the saddle linkage in use of the grader;

a motion measurement system configured to measure movement or position of one or more components of the grader in use thereof, wherein the motion measurement system includes a first camera coupled to the chassis and configured to capture one or more images of one or more components of the grader in use of the grader and a controller coupled to the first camera, and wherein the controller is configured to identify one or more of the locking holes based on the one or more images captured by the first camera and to identify the shape of the crossbar based on the one or more images captured by the first camera to determine locations of one or more of the locking holes and the crossbar based on the one or more images captured by the first camera and to determine a positional state of the saddle linkage based on the determined locations of one or more of the locking holes and/or the crossbar.

16. The grader of claim 15, wherein in response to a determination that the locking holes and the shape of the crossbar are identified, the controller is configured to compare the locations of the locking holes with one or more locations of the crossbar to determine whether the locations are consistent with one another.

17. The grader of claim 15, wherein in response to a determination that the locking holes and the shape of the crossbar are not identified, the controller is configured to estimate a positional state of the saddle linkage based on the lack of identification of the locking holes and the shape of the crossbar.

18. The grader of claim 17, wherein in response to a determination that the locations of the locking holes and the crossbar are inconsistent with one another, the controller is configured to estimate a positional state of the saddle linkage based on the inconsistent locations of the locking holes and the crossbar, and wherein in response to a determination that the locations of the locking holes and the crossbar are consistent with one another, the controller is configured to determine the positional state of the saddle linkage based on the consistent locations of the locking holes and the crossbar.

19. The grader of claim 15, wherein the motion measurement system includes a second camera coupled to the chassis and the controller, the second camera configured to capture one or images of one or more components of the grader in use of the grader, and wherein the controller is configured to determine locations of one or more of the locking holes and the crossbar based on the one or more images captured by the first and second cameras and to determine a positional state of the saddle linkage based on the determined locations of one or more of the locking holes and the crossbar.

20. The grader of claim 19, wherein the first camera has a first viewable area and the second camera has a second viewable area, the first camera arranged relative to the second camera such that the first viewable area and/or the second viewable area capture the images of one or more of the locking holes and the crossbar.

21. The grader of claim 15, further comprising:

a light source coupled to the chassis near the first camera to illuminate a first viewable area of the first camera.

* * * * *